US012448191B2

(12) United States Patent
Wimmer et al.

(10) Patent No.: US 12,448,191 B2
(45) Date of Patent: Oct. 21, 2025

(54) PACKAGING DEVICE, PACKAGING UNIT, AND METHOD FOR PRODUCING PACKAGING UNITS

(71) Applicant: Krones Aktiengesellschaft, Neutraubling (DE)

(72) Inventors: Thomas Wimmer, Rosenheim (DE); Marcus Kreis, Kolbermoor (DE); Herbert Spindler, Niedermoosen (DE); Johann Luber, Bad Feilnbach (DE); Thomas Hensel, Aying (DE)

(73) Assignee: Krones Aktiengesellschaft, Neutraubling (DE)

( * ) Notice: Subject to any disclaimer, the term of this patent is extended or adjusted under 35 U.S.C. 154(b) by 3 days.

(21) Appl. No.: 18/574,488

(22) PCT Filed: Jun. 21, 2022

(86) PCT No.: PCT/EP2022/066876
§ 371 (c)(1),
(2) Date: Dec. 27, 2023

(87) PCT Pub. No.: WO2023/030718
PCT Pub. Date: Mar. 9, 2023

(65) Prior Publication Data

US 2024/0253883 A1 Aug. 1, 2024

(30) Foreign Application Priority Data

Aug. 30, 2021 (DE) ..... 10 2021 122 384.9

(51) Int. Cl.
*B65B 17/02* (2006.01)
*B65D 71/42* (2006.01)

(52) U.S. Cl.
CPC ..... *B65D 71/42* (2013.01); *B65B 17/025* (2013.01); *B65D 2571/00141* (2013.01); *B65D 2571/0066* (2013.01)

(58) Field of Classification Search
USPC ..... 53/398
See application file for complete search history.

(56) References Cited

U.S. PATENT DOCUMENTS 3,330,408 A 7/1967 Wanderer
3,721,337 A 3/1973 Braun et al.
(Continued)

FOREIGN PATENT DOCUMENTS

DE 202012103324 9/2012
EP 0825129 A2 2/1998
(Continued)

OTHER PUBLICATIONS

PCT Application: PCT/EP2022/066876—Filed Jun. 21, 2022—International Preliminary Report on Patentability and English Translation dated Mar. 14, 2024.
(Continued)

*Primary Examiner* — Chinyere J Rushing-Tucker
(74) *Attorney, Agent, or Firm* — Simmons Perrine PLC

(57) ABSTRACT

The invention discloses a method for producing packaging units and the produced packaging units, comprising at least two substantially similar articles, wherein the articles are held together by at least one packaging blank (14). A main surface of the packaging blank (14) is applied to first end faces of an article grouping (20), forming a connection between the articles and primary fixing element of the packaging blank (14). The primary fixing element fixes the positions of the articles relative to one another. The side surfaces (24) of the packaging blank (14) are subsequently folded over, wherein secondary fixing element interacts with
(Continued)

the shell surfaces of the articles. The secondary fixing elements are formed by strapping sections, which surround the article grouping (20) and fixes the articles in a substantially parallel alignment to one another. The invention also relates to a packaging device for carrying out the method.

19 Claims, 25 Drawing Sheets

(56) References Cited

U.S. PATENT DOCUMENTS

| | | | |
|---|---|---|---|
| 3,946,862 | A | 3/1976 | Klygis et al. |
| 4,403,689 | A | 9/1983 | Wood |
| 5,058,735 | A | 10/1991 | Bienaime |
| 5,328,024 | A | 7/1994 | Sutherland |
| 5,579,625 | A | 12/1996 | Olson et al. |
| 5,775,486 | A | 7/1998 | Edqvist |
| 6,315,111 | B1 | 11/2001 | Sutherland |
| 2009/0308763 | A1 | 12/2009 | Oster |
| 2011/0030311 | A1 | 2/2011 | Martini |
| 2023/0406589 | A1* | 12/2023 | Merzeau ..... B65D 71/46 |
| 2024/0336381 | A1* | 10/2024 | Limousin ..... B65B 17/025 |
| 2024/0409258 | A1* | 12/2024 | Martini ..... B65D 71/42 |

FOREIGN PATENT DOCUMENTS

| | | | |
|---|---|---|---|
| EP | 1075419 | B1 | 10/2003 |
| EP | 2085314 | A2 | 8/2009 |
| FR | 1493669 | A | 9/1967 |
| GB | 1275765 | A | 5/1972 |
| WO | 9523091 | A1 | 8/1995 |
| WO | 2010101852 | A1 | 9/2010 |
| WO | 2021043632 | A1 | 3/2021 |

OTHER PUBLICATIONS

PCT Application: PCT/EP2022/066876 Filed Jun. 21, 2022—International Search Report dated Oct. 20, 2022.

Priority Application: DE 10 2021 122 384.9 Filed Aug. 30, 2021—German Search Report dated Aug. 28, 2022.

* cited by examiner

Fig. 1C
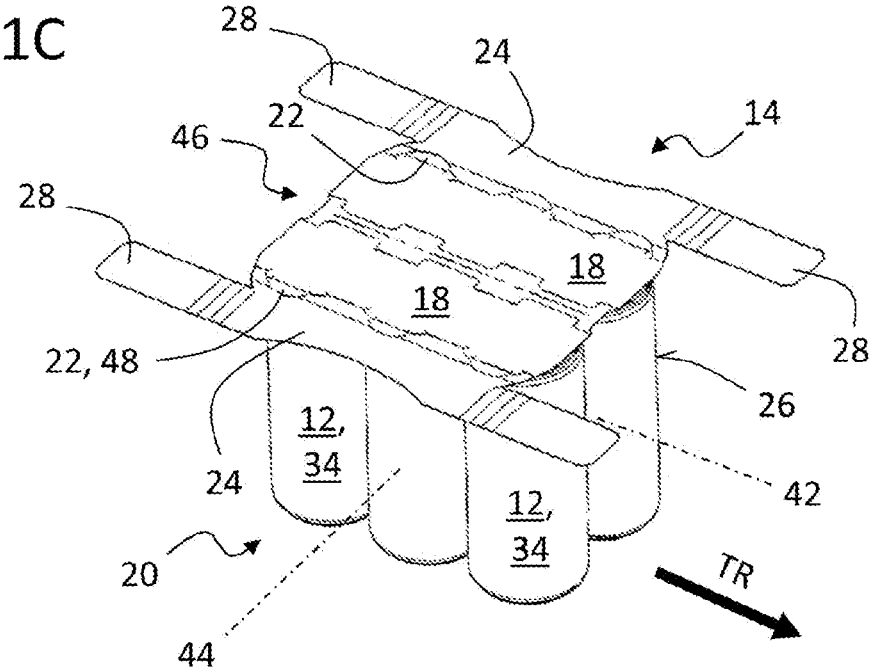
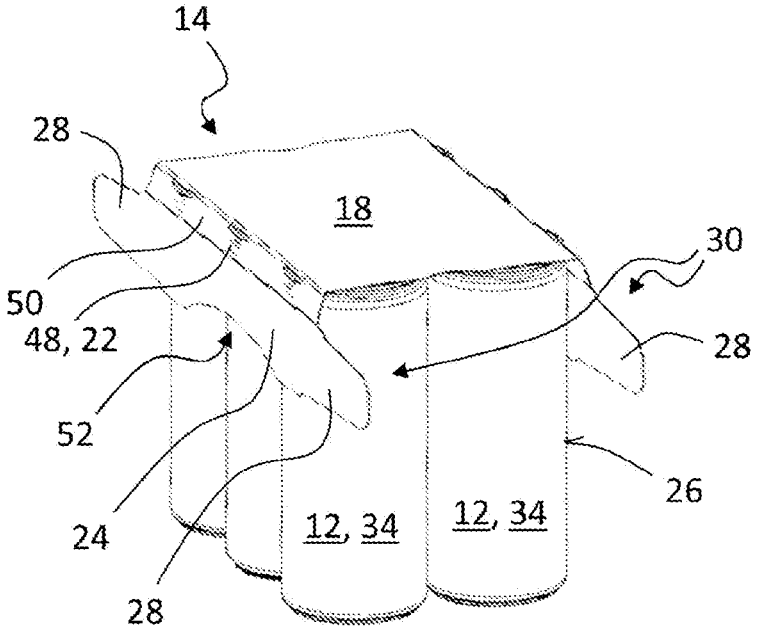
Fig. 1D

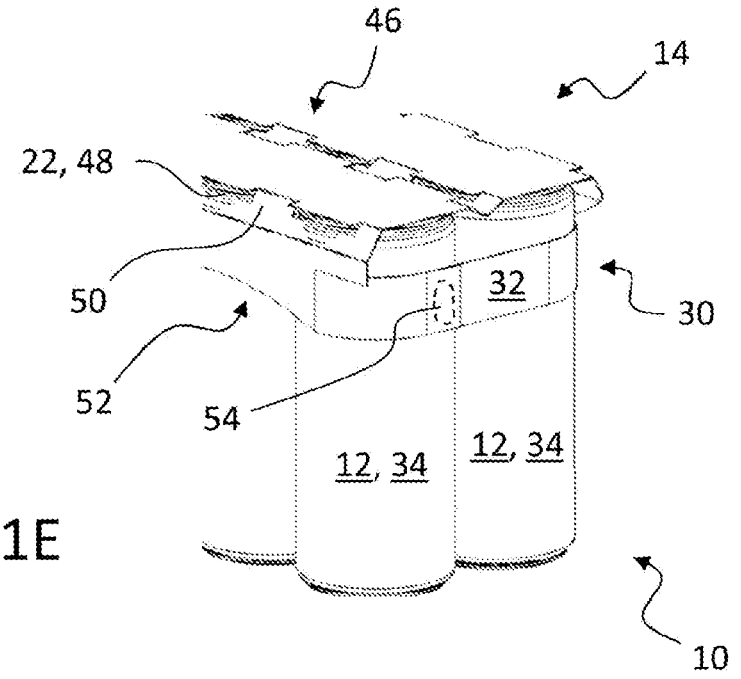
Fig. 1E
Fig. 1F
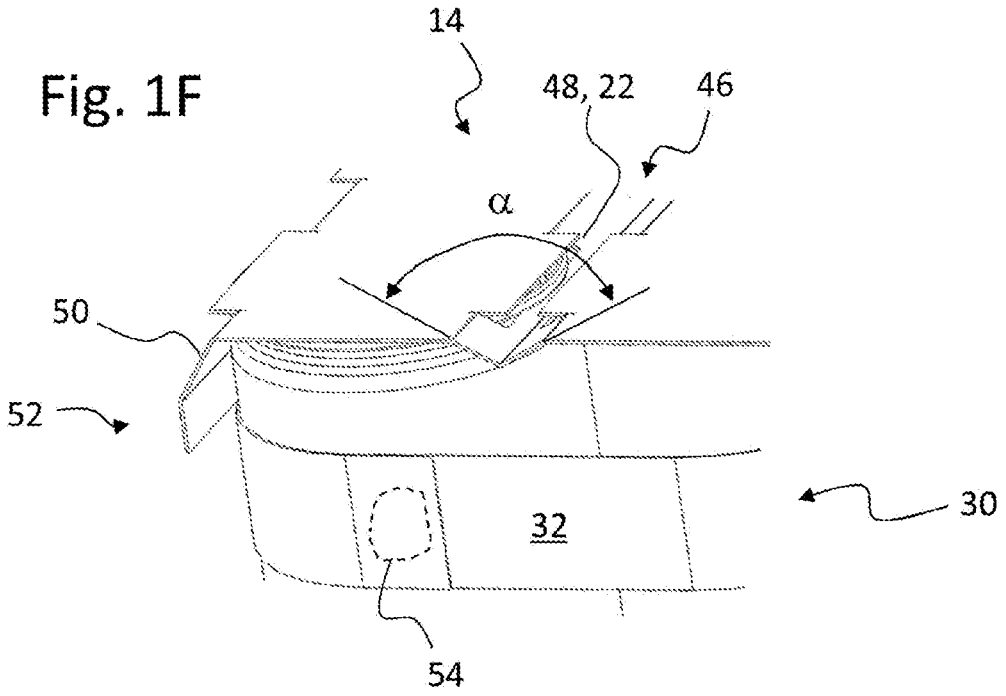

Fig. 2A
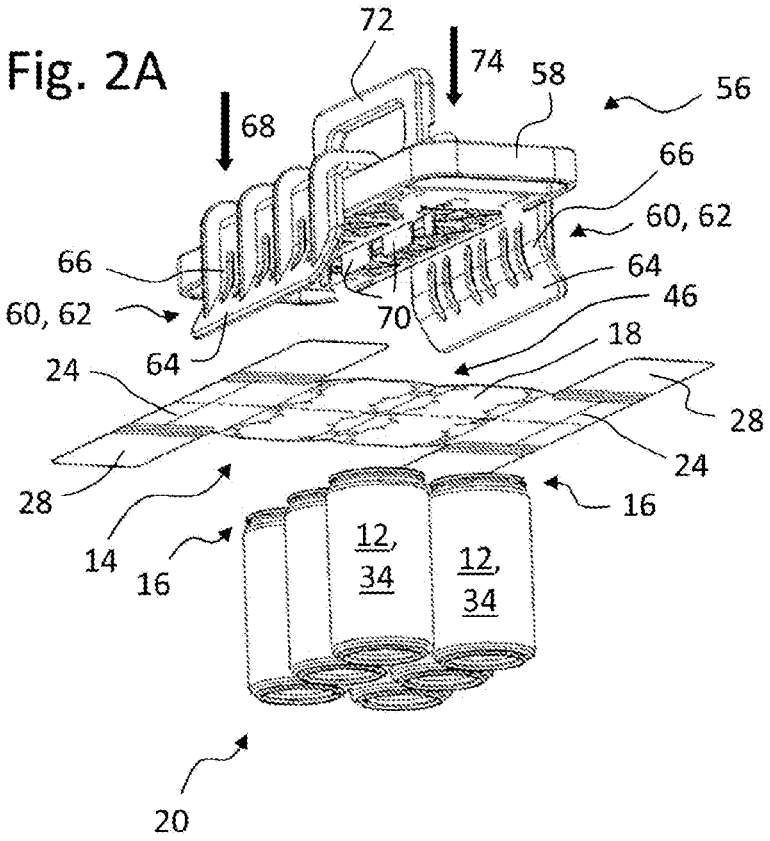
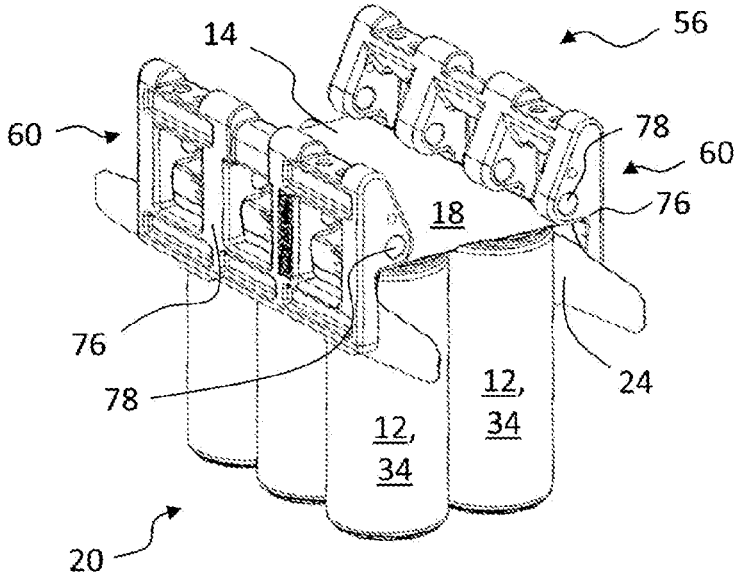
Fig. 2B

Fig. 10A
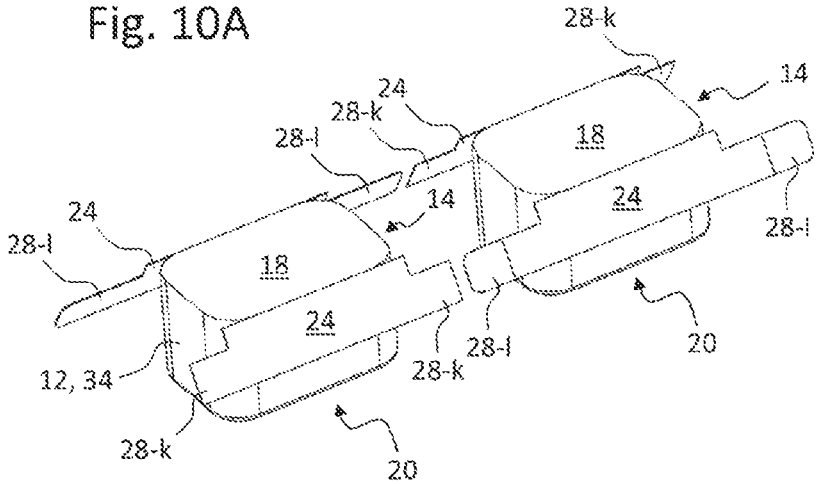
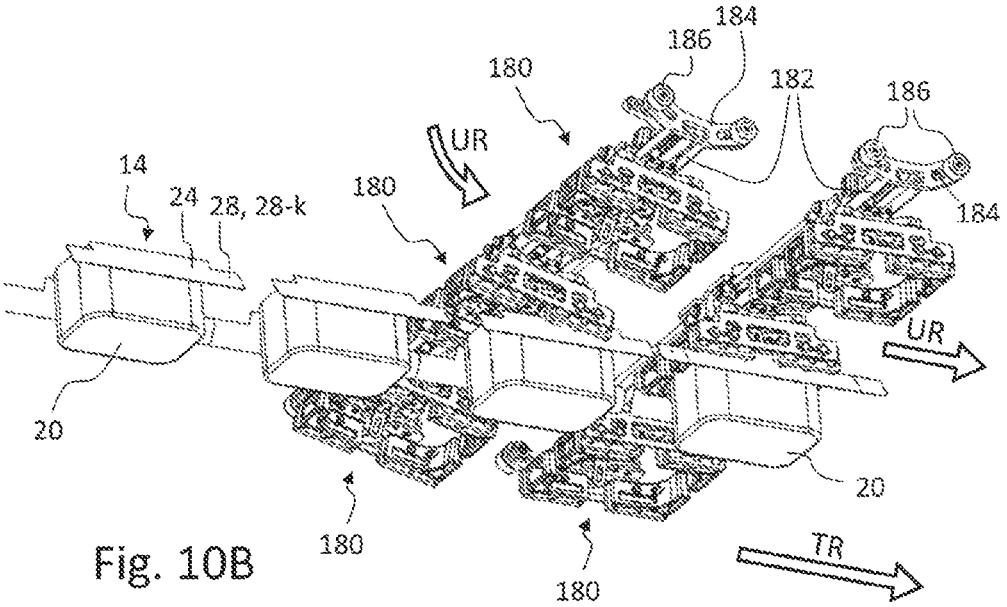
Fig. 10B

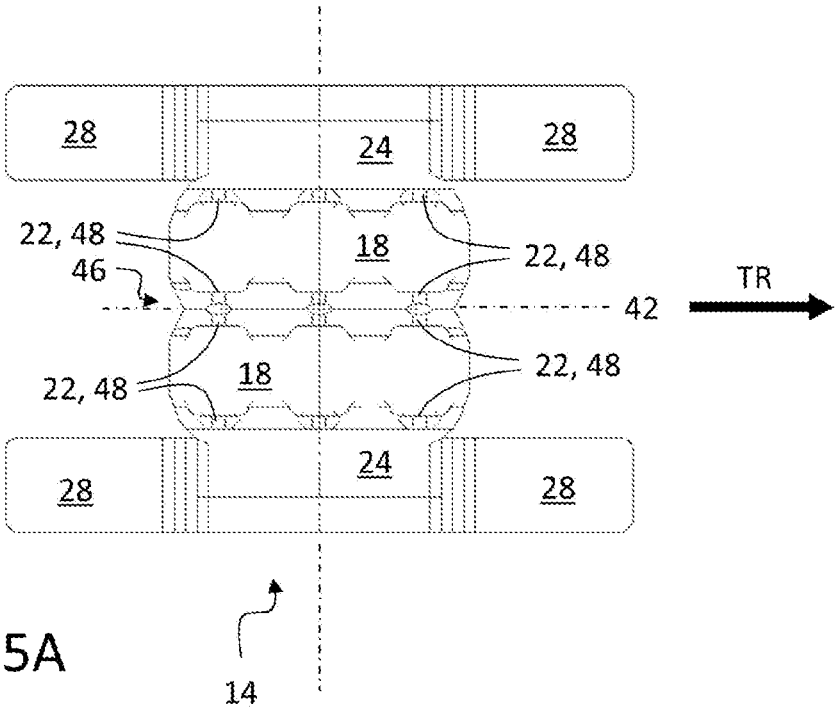
Fig. 15A
Fig. 15B
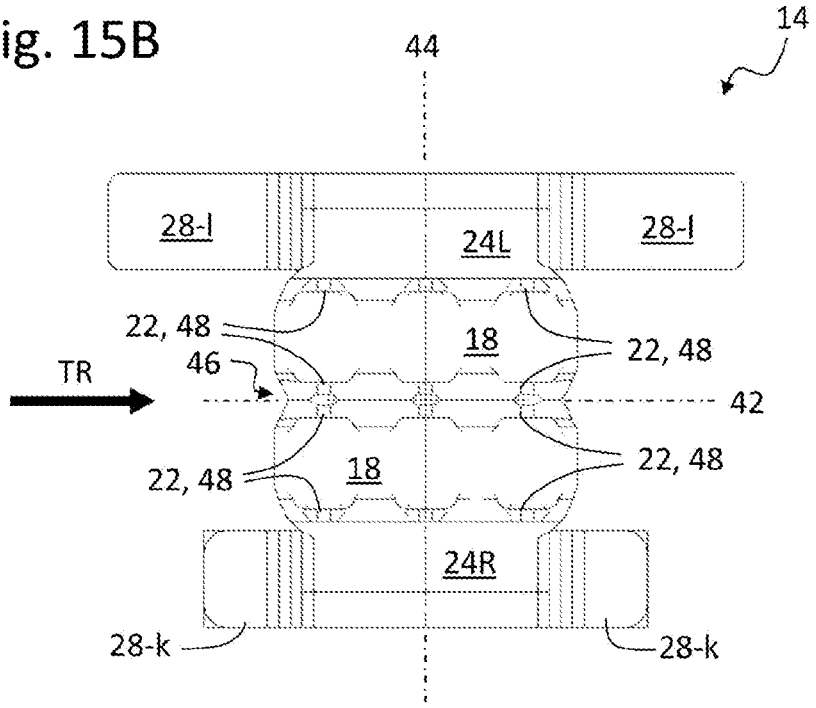

PACKAGING DEVICE, PACKAGING UNIT, AND METHOD FOR PRODUCING PACKAGING UNITS

CLAIM OF PRIORITY

The present application claims priority to International Application PCT/EP2022/066876, dated Jun. 21, 2022, which in turn claims priority to German Application DE 10 2021 122 384.9, dated Aug. 30, 2021, which are incorporated by reference.

FIELD OF THE INVENTION

The present invention relates to a packaging device for producing packaging units and a method for producing packaging units according to the features of the independent claims. In addition, the invention relates to a packaging unit having the features of the corresponding independent claim.

BACKGROUND OF THE INVENTION

Beverage cans, along with bottles and beverage cartons, are one of the most important and widely produced and used commercial packaging for beverages—especially since they can also serve as drinking vessels. Beverage cans are mainly used for carbonated drinks such as canned beer and soft drinks such as, for example, cola drinks, lemonades of all kinds, and energy drinks. Beverage cans are typically opened for consumption by tear-off tabs arranged on the lid.

Beverage cans currently in use usually consist of one-piece, cylindrically-shaped containers made of aluminum or tinplate, produced by suitable deep-drawing processes, and aluminum lids with an oval scored line and a riveted metal tab that are folded or flanged onto the upper rims of the can. This tab acts as a kind of built-in can opener when it presses the scored oval into the inside of the can by leverage when it is lifted, thus forming a pouring or drinking opening. The cans normally have a tapered diameter in the upper shell region directly below the lid. This means that the lid normally also has an outer diameter that is at least slightly smaller than the cylindrical shell region of the can.

There are different types of packaging for processing, assembling, grouping, and packaging articles such as, for example, beverage containers in the form of cans. A suitable type of packaging is, for example, the grouping of articles or containers into portable, relatively handy, bundle units, which can generally also be regarded as packaging units. Here as well, various options are known for combining individual cans into larger bundles. Beverage containers, for example, are often shrink-wrapped and packed in bundles of four, six, or more containers. The production of such bundles or packaging units is unavoidable in many cases, since they are the most common variant of sales units or packaging units for beverage containers, and in particular cans made of metal or plastic or bottles made of PET plastic. This is because the handling of a large number of articles or beverage cans on the way from the production and filling of such so-called primary packaging to the retailer and the end customer is hardly conceivable without the use of so-called secondary packaging and possibly also additional tertiary packaging. The bundles, which can also be considered secondary packaging, are sometimes combined again for transport and/or assembled in layers and palletized, which is sometimes also referred to as tertiary packaging.

Specific fabrication steps are required in the production of known bundle types in order to be able to process the shrink films normally used for the bundles. Such fabrication steps require a relatively high energy input, not least because of the shrinking process of the film that takes place under the effect of heat. In addition, the film used incurs costs for production, provision, handling, and subsequent disposal, since it is no longer required after the articles or containers have been sold and unpacked. The machine configuration for providing the so-called film wrapping modules and other handling stations also incurs high investment costs. Finally, the provision of the so-called shrink tunnel, in which the film wrapped around the bundles is shrunk around the containers by the application of hot air, also requires a relatively high capital investment.

A variant in which the use of shrink film can generally be dispensed with is so-called strapping packaging. Here, several articles or containers are connected to one another by so-called strapping bands and combined to form a bundle. In strapping machines that work continuously or in cycles, containers, articles, or bottles are grouped into formations and then strapped with one or more bands with the aid of strapping units. It is practical for such bands to run in the horizontal direction around the containers or bottles and hold them together in the bundle assembly. Typical formations can, for example, be 1×2 arrangements (two containers in a row), 2×2 arrangements (four containers in a square or diamond formation), 3×2, 4×3, or, in principle, also variable n×m arrangements.

Furthermore, the use of so-called gripping cardboard packages or upper gripping cardboard packages is known, for combining several articles such as, for example, beverage containers, and in particular bottles or cans, via their neck regions. A packaging machine for placing such upper gripping cardboard packages is described in the patent specification EP 1 075 419 B1. There, the articles are arranged in a box, and the gripping cardboard package is placed on top of the at least one article arranged in the box. In particular, a plurality of articles are arranged in the box, and by placing a smaller number of upper gripping cardboard packages on top, subgroups are formed, each of which combines some of the articles arranged in the box.

In addition, packaging units are known that combine different types of secondary packaging means and combine the plurality of articles with a first packaging means and a second packaging means—in particular, with a first secondary packaging means in the form of an upper gripping cardboard package and with a second secondary packaging means in the form of a strapping and/or in the form of at least one adhesive connection between adjacent and touching articles.

The patent specification DE 22 06 071 C2 discloses a container packaging with a carrier device for holding together and transporting the containers made of an elastically deformable plastic material. The carrier device has openings for the containers and finger tabs for tearing open the carrier device.

The published patent application DE 25 31 325 A1 describes a container packaging with a carrier means made of plastic film. An upper support member comprises first end parts of each container, and a second sheet metal or film support member comprises parts connected to one another and holds each group of containers.

The published patent application DE 10 2006 028 661 A1 shows a packaging unit with bottles and a bottle carrier, such that the packaging units can also be stacked securely in large numbers. The bottles are combined in the packaging units by a carrier body with a carrier handle and at least one band.

The utility model specification DE 20 2012 103 324 U1 discloses a bundle template for joining together packaging units, and in particular beverage bottles, to form bundles. The bundle template has recesses for receiving one part of each packaging unit and centrally-arranged incisions for forming a carrying handle, wherein the incisions are symmetrically surrounded by the recesses.

DE 1 457 489 A also discloses a bundle with several bottles that are held together in the form of a package by endless bands. A handle enables the package to be carried.

A further bundle arrangement is disclosed in U.S. Pat. No. 5,775,486 A. Rows of three or six bottles or cans are in each instance fixed with upper-side attachments made of cardboard and combined into larger bundles by strapping bands.

Many different can sizes are now commonly used and available as primary packaging for receiving liquid contents, and in particular drinks. While cans with a capacity of approximately one-third of a liter or half a liter have traditionally been offered, cans with other capacities, e.g., 0.15 liters, a quarter of a liter, 0.355 liters, or other volumes, are now also frequently available.

In addition to these varying can volumes, different can shapes are known. While the lid of a standard can has a significantly smaller diameter than the adjoining can cylinder, the cylinder diameter and the lid diameter of so-called slim cans or sleek cans are substantially the same or nearly the same, such that there are no significant tapers in the lid and/or base region relative to the shell region of the can.

For combining standard cans, upper gripping cardboard packages that have a number of openings for the standard cans, which simultaneously define the positions of the cans within the packaging unit, are known. The gripping cardboard packages are pressed onto a set of standard cans from above, such that the lid region of the standard cans can pass through an assigned opening. Preferably, the gripping cardboard package is anchored below the lid region of the standard cans, and in particular in the region with a reduced diameter. The cans are arranged close together within the packaging unit produced in this way.

On the other hand, the use of such gripping cardboard packages is not usually appropriate for slim or sleek cans. Since the diameter in the lid region and the diameter in the cylinder region are largely the same in such can shapes, there is a lack of material between the openings of the gripping cardboard, such that the remaining narrow regions between the openings can easily tear out, as a result of which the gripping cardboard lacks the necessary stability.

In order to counter such disadvantages, WO 2021/043632 A1 proposes a combination of a gripping cardboard package, acting as the primary packaging means, with a further packaging means. Such additional packaging, referred to as secondary packaging, is then attached to the packaging already equipped with the gripping cardboard package. Strapping bands, adhesive connections between the articles, or shrink-wrap connections are suggested as secondary packaging materials. Multi-phase production processes are required in order to equip several articles, and in particular the so-called slim cans mentioned above, with primary and secondary packaging materials, since these are fundamentally different types of packaging and therefore also different mechanical fabrication and packaging steps.

SUMMARY OF THE INVENTION

In view of the known types of packaging and packaging methods, it can be regarded as a primary objective of the invention to better combine or integrate the necessary process steps for the production of packaging units with several different packaging means. In addition, it is an objective of the invention to be able to produce packaging units in an advantageous manner, in which a plurality of articles are combined with first and second packaging means, wherein such packaging means interact more closely than is the case with previously-known packaging variants. Finally, a supplementary objective, which may also need to be taken into account, is to provide improved tool variants, each of which enables more rapid and better processing of grouped articles for the purpose of producing packaging units.

These objectives of the invention are achieved with the subject matter of the independent claims. Features of advantageous further developments of the invention are apparent from the respective dependent claims.

In order to achieve at least some of the above objectives, the invention proposes a packaging device for producing packaging units, which packaging units comprise at least two substantially similar articles, and which at least two articles are held together by at least one packaging blank with primary and with secondary fixing element.

This packaging device according to the invention comprises at least one feed device for the at least two articles or for groupings of at least two articles in each instance, an application device for applying a main surface of the packaging blank to first end faces of the grouped articles and for establishing a connection between the articles and the primary fixing element of the packaging blank. This substantially serves to fix the positions of the articles relative to one another by the primary fixing element.

The feed device can be formed, for example, by a horizontal conveying device for transporting articles in a mass flow or in several aisle guides or the like. The application device is formed by a handling device, to be explained in more detail below, with complex, interlocking, and/or sequentially executable functions and functionalities.

Furthermore, the packaging device according to the invention comprises a suitable manipulating and/or shaping device for folding over at least one side surface, adjacent to a longitudinal side of the main surface of the packaging blank, of the packaging blank, forming secondary fixing element interacting with shell surfaces of the articles.

Finally, the device comprises a fixing device for forming the secondary fixing elements formed by strapping sections, wherein the strapping sections surround defined regions of the shell surfaces of the articles and fix the articles in a substantially parallel alignment to one another. The strapping sections are formed by parts of the packaging blank, which are initially folded over and then subjected to further handling and treatment steps.

In particular, the packaging device can have a handling tool that can serve to fold over two side surfaces adjacent to opposite longitudinal sides of the main surface of the packaging blank, forming secondary fixing element interacting with the shell surfaces of the articles.

Optionally, the handling tool can be formed to fold over the side surfaces of the strip sections and to reshape the strip sections into strapping sections.

With the packaging device, the handling tool can also be equipped with devices for fixing overlapping end regions of the strip sections to one another and/or to the shell surfaces of the articles.

In addition, with the packaging device, the handling tool can comprise devices for reshaping, folding, and/or notching the main surface of the packaging blank in a region between bordering articles.

Finally, with the packaging device, the devices for reshaping, folding, and/or notching the main surface of the packaging blank can comprise a folding punch that can be lowered onto the main surface and that can be an immovable or movable part of the handling tool.

In addition to the features and properties of the packaging device mentioned above, it should be emphasized that some or all of the variations or embodiment variants of the packaging device mentioned above according to the invention can optionally also be combined with one another, provided that the variants can be practically combined with one another from the point of view of the person skilled in the art addressed, in order to at least partially achieve the objective(s) formulated above, and/or in order to achieve the desired effect of the invention.

Furthermore, in an advantageous design, the packaging device according to the invention can be equipped with at least one controllable application head that can move within a defined movement space and that can carry out some of the handling steps mentioned above in conjunction with the application of the packaging blanks to article groupings provided for this purpose and with the formation of the primary fixing element. The application head described in more detail below initially serves to apply packaging blanks to groups of at least two articles.

To accomplish this, each of the application heads or each of several application heads comprises a receiving device for receiving at least one packaging blank and for placing the packaging blank on an upper side of the respective article grouping.

Furthermore, the application head is equipped with a fixing device for establishing a mechanical connection between the packaging blank and the article grouping or between the packaging blank and the respective article grouping.

The receiving device of the application head comprises at least one suction device that can be subjected to controllable and/or variable negative pressure, and can be subjected to increased negative pressure for receiving and holding a packaging blank and to reduced negative pressure for releasing a packaging blank held in the application head. Further optional handling tools of the application head are described in detail below.

The application head according to the invention or the application head forming part of the packaging device according to the invention can be equipped with at least one application unit for treating in each instance one article grouping and for equipping it with a packaging blank. However, in particular, the application head or each of possibly several application heads comprises in each instance two or more such application units for the substantially synchronous treatment of two or more separate article groupings and for their respective equipping with packaging blanks.

The application head can preferably be moved within a movement space between a stockpile or a supply point for several stacked packaging blanks and a respective location of the article groupings to be handled.

In addition, the application head can be designed in such a way that each of its application units is equipped with a contact plate that can be moved vertically between two end positions for flat contact with the packaging blank held there in each instance, and in each instance with at least one controllable suction element for negative pressure-controlled holding or releasing of a packaging blank held there with negative pressure.

Furthermore, each application unit of the application head can be equipped with a shaping element for deforming a defined folding region of a packaging blank placed on a respective article grouping. In particular, it can be provided that the shaping element serve to form primary fixing element for establishing mechanical connections between the articles of the article grouping and the packaging blank or support the formation of the primary fixing element.

In addition, each application unit of the application head can optionally be equipped with folding elements for folding over side surfaces of the packaging blank that project beyond the upper side of the article grouping and for preparing secondary fixing element between the article grouping and the packaging blank.

Furthermore, with the application head according to the invention, it can be provided that the movable contact plate, the suction elements that can be subjected to negative pressure, the folding elements, and the shaping element of each application unit be able to, in conjunction with the application head that can be lowered onto or lifted from the article grouping, in each instance carry out handling steps that are matched with one another for forming the primary fixing element and at least preparing the secondary fixing element.

The subsequent finishing of the secondary fixing element, which are formed in particular by strapping sections, can take place in subsequent handling or process steps, unless corresponding tools are provided in the application head that are capable of finishing the strapping sections—for example, by bonding overlapping strip sections of the packaging blank.

The fixing device of the packaging device according to the invention, which has already been mentioned several times above and which serves to form the secondary fixing elements formed by strapping sections, can in particular be formed by strapping heads suitable for this purpose and equipped in a corresponding manner, which can provide that the strapping sections be attached to defined regions of the shell surfaces of the articles and fixed there in order to fix the articles in this way in a substantially parallel alignment to one another. As already mentioned and explained several times, the strapping sections are formed by parts of the packaging blank, which are initially folded over and then subjected to further handling and treatment steps.

The strapping head, which in addition to the aforementioned application head can in particular be a further or additional component of the packaging device according to the invention, comprises at least suitable handling elements for folding over foldable sections of the packaging blank that are adjacent to the longitudinal sides of a main surface of the packaging blank and project beyond an upper side of the article grouping, and for applying the foldable sections to the opposite side surfaces of the article grouping, while preparing and/or forming secondary fixing element interacting with shell surfaces of the articles. As mentioned, such secondary fixing element are formed by strapping sections that surround defined regions of the shell surfaces of the articles and fix the alignments of the articles to one another.

However, it should already be emphasized at this point that the packaging device or packaging machine can be equipped with a plurality of such strapping heads, which can be controlled in a matched manner in order to successively process a plurality or multiplicity of article groupings to form packaging units, wherein in each instance several strapping heads can act simultaneously upon a corresponding number of article groupings in synchronized control.

With the strapping head or with each of several strapping heads, it can be provided in particular that the handling elements have elastically-deformable molded parts for pressing on and adhesively connecting respective overlapping regions of the foldable sections of the strapping sections.

The strapping head, which is to be regarded as a practical additional option for the packaging device according to the invention, can have at least two handling elements that can be applied against opposite longitudinal sides of the article groupings and can be fed towards one another, wherein each of the handling elements can be equipped with elastic molded parts that can interact with sections of the packaging blank folded onto the shell surfaces of the articles of the article grouping and can reshape these into strapping sections.

In addition, each of the handling elements of the strapping head, together with the molded parts arranged thereon, can be movable between two end positions, wherein the molded parts are at least slightly spaced apart from the article grouping in the first end position of the respective handling elements when the strapping head is placed on the article grouping, and wherein the molded parts are placed against the side surfaces of the article grouping in the second end position of the respective handling elements and are subjected there to an actuating force in the feed direction of the handling elements.

In the strapping head or in each of several strapping heads, the molded parts subjected to an actuating force in a defined feed direction of the handling elements can be elastically deformed and can thereby place at least partial regions of the strapping sections under pretensioning.

The strapping head or each of several strapping heads can also be assigned a slot control for position-dependent specification of the feed movements of the handling elements.

In particular, the strapping head can be guided in a rail system parallel to a transport section for the groups of articles conveyed on it in the transport direction, wherein the slot control for the position-dependent specification of the feed movements of the handling elements of the strapping head can be assigned to at least part of the transport section. Optionally, several strapping heads can be guided in such a rail system parallel to the transport section with the article groupings conveyed on it.

Optionally, the strapping head or each individual strapping head can be equipped with a defined number of molded parts. In particular, a total of four elastically-deformable molded parts can be provided, with which each individual strapping head can be equipped. Such a molded part can, for example, have a base section with which it can be anchored in a holder of the associated handling element. The strapping head can normally have two holders of the handling element that can be fed towards one another, in each of which two such molded parts are anchored.

A tool section can also be connected to the base section of the molded part, which tool section serves to act upon the article groupings and to interact in such a way that the strapping sections can be produced in the desired manner from the superimposed strip sections of the side surfaces.

According to a practical embodiment variant, the tool section of the molded part can in particular have an L-shaped contour with a rounded transition between the two legs of the L-shaped tool section, wherein the rounded region, which can also be referred to as the shaping region or elastic shaping element, practically corresponds to the contour of the article grouping to be processed in its respective corner regions.

The connection of the tool section to the base section is preferably elastically deformable, which can provide a defined deformation behavior when the tool section is pressed against the longitudinal side of the article grouping in a direction perpendicular to the surface of the first leg connected to the base section.

The material selection of the preferably integrally-formed and produced molded part, which can be formed in particular by an elastically-deformable thermoplastic material or by a suitable elastomer material, possibly equipped with incorporated fiber reinforcement, provides the desired deformability when the strapping head is used, if the holders of the handling elements with the molded parts fastened therein are moved towards one another and form the strapping sections.

A pure feed movement in the feed direction of the two holders of the handling elements, which are placed against the longitudinal sides of the article grouping, does not normally deform the molded parts yet; rather, they initially only rest with their shaping elements against the article grouping and the already partially folded-down side surfaces and the strip sections. With an even further feed movement, the molded parts begin to deform structurally. In particular, this provides that the adhesive or bonding points be pressed onto the overlapping regions of the strip sections, such that a defined pretensioning can be imposed on the strapping sections of the secondary fixing points formed in this way.

The feed movements for the holders of the handling elements located in the strapping head, which can be fed towards one another, with the molded parts fastened to them, can be controlled, for example, by a suitable slot guide. For example, the holders can be equipped with suitable guide pins, which can be guided in guide slots located above the article groupings conveyed along the transport level in the transport direction, such that the cross members moving in the lower section of the rail guide in the direction of circulation with the strapping heads arranged on them can come into contact with the guide slots. This means that the guide pins move within the guide slots and are guided there in a sliding manner. In this way, the holders can be fed towards one another or moved away from one another, i.e., they can be moved over defined adjustment paths parallel to the longitudinal extension direction of the respective cross member, while they are being moved in the rail system.

The guide pins are controlled by the guide slots, which in each instance comprise straight and parallel sections, in which the guide pins are spaced closer together, and other straight and parallel sections, in which the guide pins are spaced further apart. Such parallel sections are connected by symmetrically converging or diverging curved sections, which can provide the respective actuating movements of the holders.

The movements of the strapping heads required for folding over the strip sections of the packaging blanks and for forming the strapping sections can be generated with the circulation of the cross members and the guide pins guided by them in the correspondingly contoured guide slots.

In addition to the packaging device according to the invention, as explained in various embodiment variants and equipping stages, the invention further proposes a method for producing packaging units, each comprising at least two substantially similar articles, wherein the at least two articles are held together by at least one packaging blank, in order to achieve at least some of the objectives mentioned above. The method comprises at least the following steps: initially, a main surface of the packaging blank is applied to first end faces of the grouped articles, wherein a connection is formed between the articles and primary fixing element of the packaging blank. Such primary fixing element initially fix the positions of the articles relative to one another.

Subsequently, with the method according to the invention, at least one side surface adjacent to a longitudinal side of the main surface of the packaging blank is folded over, forming secondary fixing element interacting with the shell surfaces of the articles. The secondary fixing element are formed by strapping sections that surround defined regions of the shell surfaces of the articles and fix the articles in a substantially parallel alignment to one another.

The method can optionally provide for two side surfaces adjacent to opposite longitudinal sides of the main surface of the packaging blank to be folded over, forming secondary fixing element interacting with the shell surfaces of the articles.

In addition, the method can provide for the strapping sections of the secondary fixing element to be formed by strip sections of the packaging blank that extend the side faces in each instance in directions along the longitudinal extension directions of the side faces.

It has proven to be advantageous for the method if the side surfaces and the strip sections are folded over by handling devices and reshaped into strapping sections, in which overlapping end regions are fixed to one another and/or to the shell surfaces of the articles.

However, it should be emphasized at this point that fixing and/or bonding the strip sections to the shell surfaces of the articles is merely an option that can be implemented as desired in practice. Due to the fixing of the packaging blank to the articles with the formation of the primary fixing element, the holding together of the bundle structure may already be sufficient, such that an adhesive fixing of the strip sections to the underlying shell surfaces of the articles is not necessary.

However, if the articles are not only to be surrounded by the strapping sections in sections, but also fixed there in their relative positions to one another, it can be practical to additionally fix the strip sections to the shell surfaces of the articles in conjunction with the fixing of their superimposed and thus overlapping sections to one another.

In addition, the method can provide that the main surface of the packaging blank be reshaped, folded, or notched in a region between bordering articles, wherein adjacent primary fixing element, together with the articles held therein, are brought closer to one another—in particular, until the adjacent articles are in touching contact.

If the application head mentioned above is to be used, it can be used in particular to transfer a flat packaging blank from a stockpile, from a feeder, or from another supply point. After being received or transferred, the packaging blank is held in the application head and, in particular, held ready for subsequent process steps.

Purely as a precaution, it should already be noted at this point that, with the variants of the method described below, an application head can optionally be used, which can comprise at least one application unit, but preferably two, three, or more application units of the same type, for the simultaneous and in particular synchronous handling of several article groupings that are kept ready. Therefore, when the following refers to the handling steps of an application head, this is not generally meant as a restrictive statement, such that several such application heads can optionally be available for carrying out the method steps described.

With one embodiment variant of the method according to the invention, the application head, together with the packaging blank held or held ready therein, is moved to an article grouping, consisting of the specified, at least two, grouped articles, which has previously been provided and held ready for the handling steps described here, where the application head can be lowered directly onto the article grouping or initially positioned at a vertical distance above the article grouping. Such positioning of the application head at a vertical distance above the article grouping held ready can be practical, for example, if the article grouping is not stationary, but is moved along a conveyor line, because in this case it makes sense for the application head to move in the same direction as the article grouping moving in a conveying direction on the conveyor line, which is also commonly referred to as synchronization.

If it is ensured that the packaging blank is in a desired position with respect to the article grouping by precise positioning of the application head, the application head can be lowered onto the article grouping, which also entails and enables the application of the packaging blank to an upper end face of the article grouping. Such application of the packaging blank to the upper end face of the article grouping, which generally refers to the upper lid sides of the grouped articles, implies the establishment of a mechanical connection between the packaging blank and the article grouping.

This mechanical connection between the upper end face of the article grouping or the upper lid sides or lid regions of the grouped articles is also referred to in the present context and in the following as a primary connection, as a primary fixing, or as a production, attachment, or formation of primary fixing element. As a rule, this refers to latching connections between punched-out circular apertures in the packaging blank and upper rim sections of the articles formed in particular by metal beverage cans, which will be explained in more detail below.

To prepare additional secondary fixing element, which in the packaging units to be produced here are formed by strapping sections formed from parts of the packaging blank, after the mechanical connection between the packaging blank and the article grouping has been established, at least one foldable section of the packaging blank projecting beyond an upper side of the article grouping is folded over and applied against a side surface of the article grouping.

Normally, two foldable sections located opposite one another on the longitudinal sides of the main surface of the packaging blank covering the upper side of the article grouping are folded over and placed against the opposite side surfaces of the article grouping, which corresponds to a folding process with a folding angle of approximately 90 degrees. The strapping sections to be described in more detail are subsequently formed from such foldable sections of the packaging blank, which are also regarded as secondary fixing element of the packaging units in the present connection and are referred to as such.

The primary fixing element mentioned above initially fix the positions of the articles relative to one another, while the secondary fixing element formed below additionally fix the angular positions of the articles to one another and provide a firmer mechanical holding together of the articles in the packaging unit.

After the packaging blank has been fastened to the article grouping provided for this purpose, forming the primary fixing element, at least one side surface adjacent to a longitudinal side of the main surface of the packaging blank is folded over, forming secondary fixing element interacting with the shell surfaces of the articles. The secondary fixing element are formed by strapping sections that surround defined regions of the shell surfaces of the articles and fix the articles in a substantially parallel alignment to one another. The strapping sections of the secondary fixing element are formed in particular by strip sections of the packaging blank, which extend the side surfaces in directions along the longitudinal extension directions of the side surfaces.

Only after the aforementioned foldable lateral sections of the packaging blank have been folded or folded down is the application head lifted from the article grouping equipped with the packaging blank and mechanically held together by it, and able subsequently to be removed from the article grouping, in order to receive a further packaging blank from a supply point or a stockpile and to repeat the described process steps on a further article grouping.

The application head can thereby be moved within its movement space between a stockpile or a supply point for the flat and normally unfolded, but provided with the required punch-outs and apertures, packaging blanks and a supply point or a conveyor section with the article grouping located there. It is thereby provided that the application head as a whole, together with the packaging blank held therein, be lowered onto the article grouping.

The at least one packaging blank can be received from the stockpile stack or from a supply point suitable and equipped for this purpose, in particular, with the aid or support of negative pressure, i.e., for example, by suitable suction elements that are located in the application head and that can be subjected to negative pressure in order to receive a flat packaging blank. Preferably, such negative pressure can be deactivated for dispensing the packaging blanks. Therefore, if a packaging blank is to be placed on an article grouping after synchronization and the lowering of the application head and pressed on and latched there while forming the primary fixing element, it is practical to deactivate the negative pressure applied to the suction elements, which can release the packaging blank and release its previously temporarily maintained fixing in the application head.

The release of the packaging blank and its latching on the upper side of the article grouping provided for this purpose can be supported by additional components in the application head. The formation of the primary fixing element can be supported, for example, by lowering a flat contact plate of the application head while simultaneously deactivating the negative pressure of the suction elements or suction punches that holds the packaging blank in place. Such processes can be practically combined with one another—in particular, by lowering the contact plate relative to the suction elements or suction punches that are stationary in the application head and extend through the contact plate equipped with corresponding recesses.

In this way, the packaging blank temporarily held in the application head can be spaced apart from the suction elements or suction punches and detached. The mentioned contact plate can be formed to be movable relative to the application head—in particular, by linear guides. In this way, with the application head held in its position, it can be lowered relative to this and can thereby press the packaging blank down onto the article grouping in terms of time and/or process technology immediately before the primary fixing element are produced.

In the further course of the production of the packaging units and in the further downward movement of the contact plate, the packaging blank is connected or latched to the articles of the article grouping with the formation of the primary fixing element, e.g., by forming latching connections between the openings or apertures in the packaging blank and the upper rim or neck sections of the articles, i.e., for example, with offset regions of their flanged rims.

In addition, the method according to the invention for producing the packaging units can provide that the main surface of the packaging blank, which is placed on the upper side of the article grouping and in particular latched or otherwise fixed there, be reshaped, folded, or notched in a region between bordering articles or between adjacent rows of articles, wherein adjacent primary fixing element together with the articles held therein are brought closer to one another—in particular, until the adjacent articles are in touching contact.

Thus, in a variant of the method, it can be provided that, during the production of the primary fixing element, but in particular only thereafter, the packaging blank be handled and deformed in such a way that it is pressed in at least a little between adjacent articles of the article grouping or between adjacent rows of articles of the article grouping, which can be particularly practical for articles within the article grouping that, due to their shaping, provide only little material between adjacent articles, because the diameter of the upper article rim is not or only insignificantly reduced relative to the diameter of the adjoining cylindrical shell region.

If the article grouping provided for the packaging units to be produced is formed, for example, by the slim cans or sleek cans mentioned above, the special shaping of such beverage cans, which are cylindrically shaped almost continuously and with a constant diameter from the lower base region to the upper lid region, means that virtually no residual material of the flat packaging blank is available between the immediately adjacent articles or cans of the grouping when the primary fixing element are produced. In order to compensate for this, the method provides for a sufficient distance between adjacent articles or adjacent rows of articles, at least for the production of the primary fixing element, which are formed by placing and latching the articles or beverage cans in apertures provided for this purpose in the flat packaging blank, which distance is eliminated in subsequent process phases by the pushing together of the articles or rows of articles.

When adjacent rows of articles, which are initially spaced apart from one another, are referred to in this connection, this can mean in particular two, three, or four articles or cans arranged in a row, which stand next to each other in pairs and thus form a grouping of four, six, or eight articles in total. However, the articles in such rows, which are initially spaced apart slightly apart in pairs, are preferably in touching contact with one another within the row, which can be accepted with regard to the available flat material of the packaging blank, since the mechanical holding together of the packaging units to be produced in this way can be ensured not only by the primary fixing element, but also by the secondary fixing element to be explained in detail below.

After lowering the contact plate together with the packaging blank resting against it on the lower side onto the upper side of the article grouping and after latching the articles to the packaging blank, which was defined above as producing the primary fixing element, the articles or rows of articles of the respective grouping, which are at least slightly spaced apart from one another in such process phase, can be subjected to a further handling step, which, among other things, provides for the articles or rows of articles of the grouping to be brought together until they are in touching contact, such that the usual rectangular arrangement of the grouping is produced, which also corresponds to the arrangement within the packaging units to be completed later.

Thus, in a further optional method step, the method according to the invention can provide that a region of the main surface of the packaging blank located between the spaced-apart articles or rows of articles resting on the upper sides of the articles be notched in a V-shape or otherwise and pressed into the space between the articles or rows of articles, which may be supported by folded or bent edges previously introduced into the packaging blank. In the case of a rectangular packaging blank, a central strip, which is to be notched in a V-shape or other shaping in this way, divides the main surface into two equal halves, which are connected by such central strip.

Each of such two halves of the main surface of the packaging blank covers one article if the article grouping to be processed comprises only two articles. In the case of article groupings with, for example, four or six articles, each of the two halves of the main surface of the packaging blank thus covers a row of two or three articles.

The V-shaped section of the packaging blank formed in this way and the pressing of the formed region between the articles or rows of articles can be carried out in particular by a knife-like or blade-shaped shaping element, arranged in a fixed position in the application head and located above the level of the contact plate when the contact plate is lowered and is thus concealed by the latter, such that it cannot become effective when the packaging blank is pressed onto the upper side of the article grouping and when the first fixing element are formed at the same time.

By lifting the contact plate after the primary fixing element have been produced and with the suction elements or suction punches preferably deactivated, the knife-like or blade-shaped shaping element extends through a corresponding recess in the contact plate and thus projects downwards out of the contact plate, as a result of which it can press the packaging blank down in a V-shape between the articles or rows of articles when the contact plate is raised and the application head is lowered further at the same time, wherein the V-shaped region of the packaging blank is pressed in between the adjacent articles or adjacent rows of articles.

Since the previously spaced-apart articles or rows of articles are drawn together, suitable guides are practical, to allow this bringing together to take place in a controlled manner. In principle, creating the V-shaped region and lowering it between the articles or rows of articles is sufficient to bring them closer together and provide that they be pulled or pushed towards one another.

The lowering movement of the application head with the pressing of the knife-like or blade-shaped shaping element onto the main surface on the upper side of the packaging blank can also be used to fold the side surfaces of the packaging blank located at the rim of the main surface of the packaging blank downwards by approximately 90 degrees in each instance and place them against the side surfaces of the article grouping. Such folding movements can be carried out, for example, by lateral folding elements arranged in a fixed position in the application head if the application head is lowered further towards the upper side of the article grouping.

The folding elements arranged on the application head on both sides of the contact plate and at a distance from it can be formed by either rigid or movable tools, which are preferably located in a position in the application head where they can meet the regions of the flat packaging blank defined by creased or folded edges and thus delimited from the main surface, in order to apply them to the opposite side surfaces of the article grouping. In a simplest embodiment variant, the folding elements are formed by perpendicularly downward-projecting and, for example, strip-shaped sections that are anchored to a carrier plate or a carrier element of the application head, such that their unchangeable relative positions are fixed with respect to the suction elements and with respect to the contact plate that can be raised and lowered in the application head.

A ramp-like bevel on the folding elements can, for example, support the previously spaced-apart articles or rows of articles being pushed together when the knife-like or blade-shaped shaping element is activated.

In a later method step, and possibly after further handling and/or treatment steps, with which further measures can be taken to complete the packaging units, the entire application head is lifted upwards from the article grouping, in order to leave it for the next processing, handling, and/or application steps. Such steps can include, in particular, the further processing of the secondary fixing element by folding the strapping sections, bonding overlapping and superimposed sections, etc.

One advantageous variant of the method provides that the previously-folded side surfaces and the extended strip sections formed as a result be folded over by suitable handling devices and reshaped into strapping sections, wherein overlapping end regions of these strip sections are fixed to one another and/or to the shell surfaces of the articles.

However, it should be emphasized at this point that fixing and/or bonding the strip sections to the shell surfaces of the articles is merely an option that can be implemented as desired in practice. Due to the fixing of the packaging blank to the articles with the formation of the primary fixing element, the holding together of the bundle structure may already be sufficient, such that an adhesive fixing of the strip sections to the underlying shell surfaces of the articles is not necessary.

However, if the articles are not only to be surrounded by the strapping sections in sections, but also fixed there in their relative positions to one another, it can be practical to additionally fix the strip sections to the shell surfaces of the articles in conjunction with the fixing of their superimposed and thus overlapping sections to one another.

With regard to all previously-described variants of the method for the production or preparation of packaging units by reshaping and equipping grouped articles with packaging blanks, and preferably using an application head that performs at least some of the process steps mentioned above, it can be provided in a minimum configuration that the application head act upon precisely one article grouping in the manner described and equip it with the packaging blank and form and/or prepare it to produce the primary fixing element and at least to prepare the secondary fixing element.

However, optionally or preferably, the application head can also have two, three, or more handling regions configured in the same way for the simultaneous and largely synchronized treatment of two or more article groupings provided for this purpose. At least two, or optionally three, of such modularly-structured application units can be arranged next to one another within an application head, such that two or three similar groups of articles can be processed or handled in parallel in the manner described.

Optionally, four such modularly-structured application units can also be located in a grouped rectangular arrangement within an application head, such that four similar article groupings can be processed and/or handled in parallel processing in the manner described, wherein such article groupings are to be positioned and aligned in such a way that the application head lowered onto them with the four application units or application modules positioned in a rectangular arrangement can apply the four, simultaneously-grasped packaging blanks to the article groupings provided for this purpose and can also carry out all the other process steps described.

Thus, when, in the present connection, reference is made to an application head for handling and processing at least one article grouping or several article groupings, this can mean an application head with the aforementioned minimum configuration that is capable of handling or processing only a single article grouping. However, the application head can also allow parallel and synchronous handling and processing of several article groupings and can be equipped with a corresponding number of application units or application modules. In this case, the corresponding suction elements, movable contact plates, and other tool elements of the application head can practically also be controlled synchronously, wherein the contact plates that can be raised and lowered in parallel movements are typically equipped with separate motorized drive units, while a central supply of negative pressure for the common supply of the controllable suction elements is a practical option, because the suction elements can in each instance be easily coupled to a common supply line via hose lines.

If, from the point of view of the person skilled in the art, practically combinable with one another, some or all of the aforementioned variations or embodiment variants of the method according to the invention and/or of the application head according to the invention can also be selectively combined with one another, in order to at least partially achieve the objective(s) formulated above and/or to achieve the desired effect of the invention.

Further variants of the method, which are explained below, can provide for the use of at least one strapping head to form the secondary fixing element. For example, it has already been described above with reference to numerous variants of the method, some of which can be combined with one another, that the flat packaging blanks are taken from a stockpile or from a supply point and, in particular, are applied with their respective main surfaces to the upper sides of article groupings provided for this purpose using an application head. In the manner described, it is possible to provide mechanical holding together between the articles and a connection between the articles and primary fixing element of the respective packaging blank, and thus form the primary fixing element, whereby the positions of the articles relative to one another in the respective article grouping can be fixed.

As also explained several times, foldable sections of the packaging blank adjacent to the longitudinal sides of the main surface of the packaging blank and projecting beyond an upper side of the article grouping are then folded over, and the foldable sections are applied against opposite side surfaces of the article grouping, with the preparation of secondary fixing element interacting with the shell surfaces of the articles. Such secondary fixing element are formed by strapping sections that enclose defined regions of the shell surfaces of the articles and fix the alignments of the articles to one another.

According to one embodiment variant of the method according to the invention, the strapping sections are produced and formed using a strapping head. The strapping sections in each instance comprise overlapping regions of the foldable sections, which are pressed against one another and against the article grouping by elastically-deformable molded parts of the strapping head and connected to one another in an adhesive manner.

The method can also provide that the strapping sections, which form the secondary fixing element of the packaging units, be in each instance formed by handling elements, which can be controlled and fed towards one another, of the strapping head, in each instance with molded parts arranged thereon.

Thus, in a variant of the method according to the invention, it can also be provided that the foldable sections of the packaging blank of each of the article groupings equipped with the secondary fixing element be pressed at least temporarily against the shell surfaces of the respective articles by the molded parts surrounding the packaging unit from several sides and be reshaped there into the strapping sections.

In order to produce the strapping sections, it can be provided in the method that the strapping head be lowered onto an article grouping equipped with a prepared packaging blank and produce the strapping sections by feed movements of the handling elements and the action of the molded parts arranged thereon in each instance.

Optionally, several synchronously-controlled strapping heads can act simultaneously upon adjacent article groupings, in order to produce the strapping sections in the desired manner. The spatial allocation term used here for the article groupings located next to one another refers to an arrangement with respect to a transport direction of the article groupings.

If the strapping heads used are designed or matched with one another in terms of control technology and coupled with one another in such a way that several directly-adjacent article groupings can be processed simultaneously, whether next to one another (with respect to the transport direction) or one behind the other (with respect to the transport direction), it is also conceivable to at the same time process several article groupings that are located one behind the other with respect to the transport direction or are conveyed successively. Thus, if synchronous handling and matched control of the strapping heads is the aim, this generally concerns multi-lane processing and conveying of article groupings conveyed next to one another, which are accessed by strapping heads arranged next to one another that can work in correspondingly synchronous movement control.

In the various embodiment variants of the method according to the invention described here, a packaging blank may have been placed on the upper side of the article groupings to be converted into packaging units before the sections provided for this purpose were converted into the secondary fixing element. In particular, it can be provided that the main surfaces of the packaging blanks in each instance cover the upper sides of the articles forming the article grouping, while the side surfaces adjoining the opposite longitudinal sides of the main surface on both sides and set off there by bent edges, together with the extensions continuing on their respective narrow sides to form strip sections, can already be folded down laterally in the direction of the side surfaces of the article groupings, but have not yet been fully applied to the side surfaces of the article groupings. This complete lateral application of the side surfaces and the strip sections then takes place in subsequent process steps and preferably using a strapping head according to the invention, as already explained above in detail and in different embodiment variants.

To form the secondary fixing element, in each instance formed by strapping sections, several successively-conveyed article groupings, for example, on the upper sides of which packaging blanks have been placed, can reach the respective manipulation regions of strapping heads suspended above the conveyed article groupings. While the packaging blanks can be placed on the upper sides of the article groupings by forming the primary fixing element by application heads that are not specified in detail here, the secondary fixing element can be formed and completed by the strapping heads.

The strapping heads can in each instance be arranged in regions above a conveyor level for the article groupings conveyed one behind the other in the transport direction with the primary fixing element placed on the upper side and preferably with previously produced or formed primary fixing element, such that in each instance they can access the article groupings from above.

In doing so, a plurality or a multiplicity of strapping heads can optionally be guided endlessly in a circulating movement in a direction of circulation, such that each of the many strapping heads can in each instance accompany exactly one article grouping over a limited section of the respective transport section and can act upon such article grouping to form the secondary fixing element.

For example, it can be provided that a defined number of strapping heads be suspended at lateral distances from one another on a cross member circulating in the direction of circulation, wherein several cross members, in each instance with several strapping heads suspended thereon, are moved successively in the direction of circulation parallel to the transport direction of the article groupings at distances from one another that correspond to the distances between the article groupings conveyed successively.

Of course, the direction of circulation runs transversely to the longitudinal extension direction of the respective cross members. The cross members can be guided in suitable rail systems and circulate endlessly there, such that the strapping heads can be guided at suitable distances above the conveyor level for the article groupings, at least over the limited region of the respective transport section mentioned, in order to bring the strapping heads into engagement with the article groupings in each instance.

Suitable handling elements can be used, for example, to form the first fixing element mentioned, which are intended to latch the packaging blank to the upper regions of the article grouping. Such handling elements can be formed, for example, by correspondingly-equipped application heads with suitable devices for holding and/or receiving packaging blanks, for applying the packaging blanks to the article groupings, and possibly for suitably folding the packaging blanks in folding regions prepared for this purpose.

Furthermore, such first handling elements can preferably have devices suitable for this purpose for folding the side surfaces to both sides of the main surface of the packaging blank, as a result of which the article groupings are prepared for placing the side surfaces folded over in this way completely on the shell sides of the article groupings and for reshaping the strip sections into strapping sections, as a result of which the secondary fixing element can be formed.

In order to achieve this, the strapping head can in particular have handling elements that can be fed towards one another and that serve to apply the foldable side surfaces of the packaging blank that are adjacent to the longitudinal sides of the main surface of the packaging blank and project laterally beyond the upper side of the article grouping, and to prepare and form the secondary fixing element interacting with the shell surfaces of the articles. As already explained several times above, such secondary fixing element are formed by strapping sections, which are formed from the overlapping strip sections, extending the side surfaces and joined together and connected to one another by suitable adhesion points such as, for example, bondings—preferably with the application of a defined pretensioning.

The handling elements of the strapping head, which engage the two longitudinal sides of the article grouping at the level of the folded-over side surfaces in contact with the shell surfaces of the articles, and which can be fed towards one another, can be shaped in such a way that their inner sides, which are in contact with the side surfaces and strip sections of the packaging blank, are in contact with the shell surfaces of the articles and can be pressed on there, wherein elastically-deformable molded parts can be provided for pressing on and establishing adhesive connections between the respective overlapping strip sections to form the strapping sections. To ensure that the strip sections adhere to one another after they have been joined together, as a result of which the strapping sections produced remain permanently connected, suitable adhesion points are preferably to be applied to at least one of the respective overlapping strip sections.

Here as well, it should be understood that some or all of the variations or embodiment variants of the method according to the invention mentioned above can optionally be combined with one another in order to at least partially achieve the objective(s) formulated above, and/or in order to achieve the desired effect of the invention, provided that such variations or embodiment variants can be practically combined with one another from the point of view of the person skilled in the art.

Furthermore, at least some of the above objectives can be achieved with a packaging unit which comprises at least two substantially similar articles that are held together by at least one packaging blank, wherein such packaging blank is applied with a main surface to first end faces of the grouped articles, forming a connection between the articles and primary fixing element of the packaging blank, as a result of which positions of the articles relative to one another are fixed by the primary fixing element.

In addition, the packaging blank used for the packaging unit according to the invention has, on at least one longitudinal side of the main surface, an adjacent side surface that is folded over and placed against the respective shell surfaces of the articles, forming secondary fixing element interacting with the shell surfaces of the articles.

The packaging blank also has strapping sections, which form the secondary fixing element. Such strapping sections in each instance enclose defined regions of the shell surfaces of the articles, thereby securing the articles in a substantially parallel alignment to one another.

In the packaging unit according to the invention, two side surfaces adjacent to opposite longitudinal sides of the main surface of the packaging blank can preferably be folded over to form secondary fixing element interacting with the shell surfaces of the articles. In principle, it can be sufficient if only one side surface is present, which is folded over and placed or stretched around the articles as strapping to form the secondary fixing element. However, a symmetrical structure with two folded-over side surfaces and strapping sections formed from each of them can provide a more stable holding together for the articles, such that this embodiment variant will be preferable in practice.

One embodiment variant of the packaging unit can in particular provide that the strapping sections of the secondary fixing element be in each instance formed by strip sections of the packaging blank, which extend the side surfaces in each instance in directions along the longitudinal extension directions of the side surfaces. Such strip sections can be placed or stretched around the shell surfaces of the articles and connected to one another, as a result of which the strapping sections that hold the articles firmly together in the bundle assembly are formed.

It can also be provided that the main surface of the packaging blank be reshaped, folded, or notched in a region between bordering articles. In this way—particularly in the case of articles with continuous or almost completely cylindrical shell surfaces—it can be achieved that adjacent primary fixing element, together with the articles held therein, are brought closer to one another—in particular, forming a touching contact between the respective adjacent articles.

If, from the point of view of the person skilled in the art, practically combinable with one another, some or all of the aforementioned variations or embodiment variants of the packaging unit according to the invention can also be selectively combined with one another, in order to at least partially achieve the objective(s) formulated above and/or to achieve the desired effect of the invention.

The present invention, whether it concerns the packaging units, the method for their production, or the packaging device, provides an improved way of handling those articles, beverage containers, or cans that are difficult to combine into bundles using conventional cardboard clips or packaging blanks, since their interlockings at the openings receiving the upper can rims generally require a relatively large can diameter with tapered upper rims, because a certain difference in diameter between the can rim and the can shell surface is required in order to be able to use the interlocking.

In contrast, the present invention offers an effective way of handling those articles, containers, or cans that have so-called slim formats, smaller diameters, or generally almost continuous cylindrical shell surfaces, without major differences in diameter along their longitudinal axes. Such cans can, for example, have differences in diameter of less than one millimeter and can still be easily processed and combined into packaging units.

It should be expressly emphasized at this point that all aspects and embodiment variants that have been explained in conjunction with the packaging device according to the invention can equally relate to, or form, partial aspects of the method according to the invention for producing packaging units. Therefore, if the description or the claim definitions pertaining to the packaging device according to the invention make mention of certain aspects and/or correlations and/or effects, this applies equally to the method according to the invention.

The same applies vice versa, such that all aspects and embodiment variants that have been explained in conjunction with the method for producing packaging units according to the invention can also relate to, or be, partial aspects of the packaging device according to the invention. Therefore, if the description or the claim definitions pertaining to the method according to the invention make mention of certain aspects and/or correlations and/or effects, this applies equally to the packaging device according to the invention.

Furthermore, it should be expressly mentioned that all aspects and embodiment variants explained in conjunction with the packaging device or method according to the invention may equally also relate to, or form, partial aspects of the packaging units according to the invention. Therefore, if at any point in the description or in the claim definitions for the packaging device according to the invention or for the method according to the invention reference is made to certain aspects and/or relationships and/or effects, this applies equally to the packaging units according to the invention. The same applies vice versa, such that all aspects and embodiment variants that have been explained in conjunction with the packaging units according to the invention can also relate to, or be, partial aspects of the packaging device according to the invention or of the method according to the invention for producing the packaging units. Therefore, if at any point in the description or in the claim definitions relating to the packaging units according to the invention reference is made to certain aspects and/or relationships and/or effects, this applies equally to the packaging device according to the invention or to the method according to the invention for producing the packaging units.

The following statements summarize again some aspects of the invention already explained above in various embodiment variants, making some aspects concrete, but should not be seen in contradiction to the statements already made, but, rather, in summary, in case of doubt, possibly as more specific embodiment variants and/or modifications. It should be noted at this point that instead of the term, "packaging units," used here, it is also possible to speak of bundles. The term, "packaging unit," used here is intended to designate the completed unit, which can be handled as a complete unit, may also be stackable, and/or can be purchased and used by the end customer at retail, consisting of at least two articles and the packaging materials that mechanically combine them.

The packaging units explained here and to be considered as part of the invention normally comprise an even number of articles. For example, the packaging units can comprise two, four, six, eight, or more articles of the same type, which are held together by a flat packaging blank in a rectangular arrangement. Such packaging blanks are initially placed or applied to the article grouping with a main surface covering the first or upper end faces or lid sides of the articles grouped, for example, in a 2×2 or 3×2 rectangular arrangement.

When the packaging blank is placed on the upper side of a prepared group of articles, i.e., on the upper end faces of the grouped articles, and possibly when it is already applied, connections are simultaneously formed between the articles and the primary fixing element of the packaging blank. In addition, the primary fixing element fix the positions of the articles relative to one another, since the dimensions of the main surface of the packaging blank and the positions of the fixing element are matched to the dimensions of the articles and the article grouping consisting of several articles.

After the packaging blank has been placed on the upper side of the article grouping, the side surfaces can be folded over to both longitudinal sides of the article grouping and placed against the shell surfaces of the articles, but without following the curved contours of the usually cylindrically-shaped shell surfaces.

The side surfaces in each instance form a continuation of the main surface of the packaging blank and are located on both longitudinal sides of the main surface. In principle, the packaging blank could also be equipped with only one such foldable side surface, which would also work for the production of the packaging units according to the invention.

However, in the following description passages, the variant with a largely symmetrical structure and side surfaces arranged on both sides of the main surface will be primarily discussed. When at this point a symmetrical structure and side surfaces arranged on both sides of the main surface are spoken of, this term, "symmetry," used here includes other options for designing the side surfaces with the same or different designs and, in particular, with strip sections of the same or different lengths.

Together with strip sections that continue to both narrow sides of the side surfaces, the two side surfaces adjacent to the main surface of the packaging blank form the secondary fixing element that interact with the shell surfaces of the articles when they are placed against them.

By fixing overlapping end regions of the strip sections to one another and/or by fixing them to the shell surfaces of the articles, the secondary fixing element are formed by strapping sections. That is, the strapping sections in each instance enclose defined regions of the shell surfaces of the articles, and specifically on both opposite narrow sides of the article grouping. However, this only applies if it is not a 1×2 grouping, because there the strapping sections surround the longitudinal sides, while the sides are folded down over the narrow sides.

As will be explained in more detail below and in particular in conjunction with the description of different embodiment variants of the packaging units according to the invention and their production, the strip sections, which extend the side surfaces towards both narrow sides on both opposite narrow sides of the side surfaces of the packaging blank to be folded over, can certainly be designed differently.

In addition to the variant already mentioned above, but not described in more detail here, with only one side surface arranged on one side of the main surface of the packaging blank, the strip sections of which must be correspondingly longer, in order to be able to enclose the entire group of articles, some further embodiment variants of the packaging blank will be explained at this point.

For example, the strip sections that are attached on both sides to the narrow sides of the shell surfaces that are to be folded towards the shell surfaces of the articles and that extend these in both directions parallel to their longitudinal extension directions can either all be of the same length.

In a further variant, the strip sections on one side surface can be shorter, while the two strip sections on the other side surface must be correspondingly longer, so that the overlapping strip sections on both narrow sides of the article grouping can be connected to form the strapping sections that are to form the secondary fixing element.

Finally, in a third variant of the packaging blank, the two strip sections of each of the two side surfaces can be of different lengths. In this case, the strip sections of different lengths on both narrow sides of the article grouping overlap eccentrically to the corresponding narrow side, but are long enough overall to be connected to form the strapping sections that are to form the secondary fixing element.

The articles, which are fixed and held in position by the strapping sections, can only be swiveled or displaced minimally when the packaging unit is completed in this way, such that the secondary fixing element thus fix the articles within the packaging unit in a substantially parallel alignment of their longitudinal central axes to one another. The strapping sections of the secondary fixing element are formed by the strip sections of the packaging blank, which extend the side surfaces to both narrow sides in directions along the longitudinal extension directions of the side surfaces.

The articles can be beverage cans in particular. The beverage cans combined by the packaging units according to the invention are in particular so-called slim cans or sleek cans made from a suitable metal sheet, and in particular from a suitable aluminum alloy. Such beverage cans are hollow-cylindrical in shape and closed on all sides. They also in each instance have a flat or slightly concave, curved circular base region on their lower end faces and a mostly flat, circular upper lid region on the opposite end face. This upper lid region forms the aforementioned upper end face of the articles formed by the beverage cans. The flat or slightly concave, curved base region on the lower end face can typically be connected in one piece with the cylindrical shell surface, which can usually be achieved by a deep-drawing process in the case of tin cans.

What is also referred to in the present connection as the upper end of the respective article is the upper lid region of the respective beverage can. The lid itself can, for example, be connected to the upper rim of the cylindrical shell of the beverage can by crimping, such that the can is closed on all sides. A tear-off lid or tear-off closure with a tear-off tab or the like may be incorporated into the lid, wherein scoring lines can be present as predetermined breaking points in the metal or aluminum sheet, which enable the tear-off closure to be opened to remove the liquid in the beverage can.

With the so-called slim cans or sleek cans, the cylinder diameter in the region of the cylindrical shell surface and the outer circular diameters of the base region and the lid region of the beverage cans are substantially the same or nearly the same, wherein the base region and/or the lid region can be slightly retracted or tapered relative to the cylindrical shell surface. Such a can shape with an almost uniformly cylindrical outer contour from the base to the lid is a characteristic feature of such so-called slim cans or sleek cans, whereas conventional (standard) cans normally have significantly smaller diameters in the base and lid regions than in their cylindrical shell regions. Therefore, when cans or beverage cans are referred to in the present context, this can in principle and in all cases mentioned mean such slim cans or sleek cans.

So-called upper gripping cardboard packages, which are known for combining standard cans and which have a number of openings for the standard cans to pass through, thus simultaneously define the positions of the cans within packaging units formed in this way. The gripping cardboard packages are normally pressed onto a set of standard cans from above, such that the lid region of the standard cans passes through an assigned opening. Often, the gripping cardboard package is anchored below the lid region of the standard cans, and in particular in a region with a reduced cross-section or in a constricted region just below the flanged rim with which the lid is placed on the upper rim region of the cylindrical shell region. Within a packaging unit produced in this way, the cans are arranged closely together—normally with their shell surfaces in touching contact.

However, the use of such gripping cardboard packages for so-called slim cans or sleek cans, as can be realized here based upon beverage cans, is hardly practical. Since, with such cans, there is little or no difference between the diameter in the lid region and the diameter in the cylindrical shell region, there is a lack of material between the openings of the gripping cardboard, such that the regions between the openings of adjacent cans can easily tear out, as a result of which the gripping cardboard lacks the necessary stability.

For this reason, the articles or beverage cans of the article grouping serving here as preparation for the packaging units to be produced are spaced apart from one another along at least one of the main horizontal axes of the article grouping. That is, a defined horizontal distance between the adjacent articles or beverage cans (here: slim or sleek can) in a direction parallel to the second main axis of the article grouping is practical or necessary.

The two main axes of the article grouping are to be understood as follows: the first main axis runs parallel to the two rows in each instance of two, three, or more articles or beverage cans aligned one behind the other, while the second main axis orthogonal thereto runs transversely to such rows of two or three (or rows of four, etc.).

Both main axes are normally aligned horizontally, since the article grouping is usually equipped and/or conveyed with the packaging blank in a defined transport direction with the respective base regions of the beverage cans upright on suitable transport devices such as, for example, horizontal conveying devices. Therefore, the first main axis runs parallel to or in the direction of the transport direction, such that the second main axis is oriented transversely to the transport direction.

This means that the horizontal distance between the rows of cans is also parallel to the second main axis. In order to be able to ensure the desired reliable fixing of the articles or beverage cans within the packaging blank prepared and in particular pre-punched for this purpose—although in the slim or sleek cans explained here and mostly used, which form the beverage cans, sufficient space does not exist between the upper lid regions of the adjacent beverage cans—it is necessary in the initial phase of configuring the article grouping to create the defined distance between the two rows of beverage cans parallel to the first main axis.

Such arrangement with rows of beverage cans spaced apart by the horizontal distance makes it possible to press a folding region of the packaging blank between the upper lid regions of the pairs of beverage cans initially spaced apart by the distance, as a result of which such beverage cans are simultaneously brought closer together in pairs until their shell surfaces are in line contact.

Purely as a precaution, it should be noted at this point that the described arrangement of the beverage cans with rows of beverage cans spaced apart by a horizontal distance is not the only variant of bundle formation. If such article transport is not desired, it can also be practical to use correspondingly pre-formed packaging blanks that can be placed directly on article groupings in which the articles in adjacent rows are already in line contact. With such a variant, it can also be practical to press the correspondingly pre-formed folding region of the packaging blank between the upper lid regions of the pairs of beverage cans that are not spaced apart, without the beverage cans having to be brought closer together.

The folding region is located in the main surface of the packaging blank and divides it into two rectangular halves, which are located on either side of a vertical separating plane, which is located between the pairs of beverage cans spaced apart by the horizontal distance. The first main axis lies within such vertical separating plane, while the second main axis cuts perpendicularly through the vertical separating plane.

The folding region serves to form the primary fixing element with which the articles or beverage cans are held in the composite of the packaging unit as soon as the packaging blank has been reshaped, pressed in, and folded in sections in the manner described here, and the secondary fixing element have been brought into position in the intended manner and connected to one another.

After the packaging blank has been placed with its main surface on the upper end faces of the articles or beverage cans placed in the article grouping in a rectangular arrangement, which are still spaced apart in pairs, the side surfaces of the packaging blank which project laterally beyond the opposite longitudinal sides of the article grouping are folded down laterally, such that they rest against the respective shell surfaces of the beverage cans. The side surfaces of the packaging blank are in this case folded by approximately 90°.

In the present connection, the extensions of the two side surfaces, which project significantly beyond the length of the main surface of the packaging blank in the direction of both narrow sides of the main surface, shall also be referred to as strip sections or extended strip sections, since they have a specific function to fulfill in conjunction with the production and formation of the secondary fixing elements.

The strip sections are not normally attached to the side surfaces, but are an integral component of the side surfaces, wherein the strip sections as well as all other components and functional elements of the packaging blank may be produced from a cardboard sheet or similar flat packaging material in a single or possibly multi-stage punching process.

After the side surfaces have been folded over, wherein pre-folded and/or perforated or otherwise predetermined bent edges can be practically used on the longitudinal edges of the main surface of the packaging blank, the packaging blank is further processed in two phases in order to achieve the final state of the packaging unit. This two-phase further processing involves pressing in the main surface of the packaging blank over the entire length of the folding region running through the middle of the main surface, which, on the one hand, moves the two spaced-apart rows (for example, rows of two or three) of beverage cans together and reduces the spacing to nearly zero, but which, on the other, also causes segments of the upper rims of the beverage cans at their upper lid regions to dip and/or snap into prepared slot-like recesses within the main surface.

For this purpose, the folding region can, for example, be pressed downwards between the beverage cans in a V-shape within the separating plane between the rows of containers and with a bent edge parallel to the first main axis in the form shown, wherein prepared bent edges, perforations, or the like can provide a defined fold at the transition edges to the main surface, which in each instance adjoin each of the slot-like recesses on either side.

The flanks of the V-shaped folding region, which are pressed downwards between the rows of containers on both sides of the halves of the main surface divided in the middle by the folding region, can enclose an opening angle between them, which in practical orders of magnitude can be between approximately 80 and approximately 150 degrees. However, such values are not to be understood as restrictive, since the opening angle of the V-shaped folding region can be based upon the deformability of the flat material used for the packaging blank, upon the upper rim contour of the articles or beverage cans, upon the shape of the can, or upon other boundary conditions, depending upon the practicality. However, other contours of the deformed folding region are also conceivable, which deformed folding region does not necessarily have to be reshaped into a V-shape, but can, for example, also have a chamfer-like base with a defined curvature radius or a rectangular cross-sectional contour.

On opposite sides, the recesses can in each instance cover circular segments of the rims on the upper end faces of the beverage cans with segment angles of approximately 40° . . . 60° (optionally, also slightly more or less). In addition, the respective transitions from the main surface to the side surfaces can optionally be bent twice by 45° in each instance, which as a whole results in the aforementioned bend angle of 90°. In this way, roof-shaped transitions are created in each instance, in which the recesses are located with which the beverage cans can be latched in each instance.

After the primary fixing element have been activated in this way, and the respective distances between the beverage cans have been eliminated, such that the respective contact lines between the previously spaced-apart beverage cans in the two longitudinal rows are precisely on the aforementioned separating plane, the secondary fixing element can be activated. The primary fixing element are realized by the beverage cans held relatively firmly in the packaging blank, as a result of which the relative positions of the beverage cans to one another are largely fixed. Since the beverage cans are fixed by their respective precise positioning within the recesses, at least at their upper rim sections on their lid regions relative to the packaging blank and relative to the other beverage cans or articles in the article grouping, they can hardly deviate there.

However, since the packaging blanks made of cardboard material normally used for the purpose described generally do not have a high degree of bending stiffness, initially only the positions of the beverage cans to one another are defined. However, this does not necessarily apply to their alignments with respect to the respective longitudinal central axes of the beverage cans, since these can be tilted relative to one another due to the flexibility of the packaging blank, wherein the lower regions, i.e., the base regions of the beverage cans, can diverge.

In order to reliably prevent such undefined tilting of the beverage cans in the composite of the article grouping equipped with the packaging blank, the invention provides secondary fixing element that, like the primary fixing element, can be formed equally by the shaping and supplementary functional elements of the packaging blank as integral components thereof.

The side surfaces of the packaging blank, which are placed laterally against the shell surfaces of the beverage cans on the longitudinal sides of the arrangement or article grouping, form collar sections, as it were, which are held there when the secondary fixing element are used as intended, and may even be slightly pretensioned. The secondary fixing element are activated by folding over the strip sections around the shell surfaces of the beverage cans located on the opposite narrow sides of the article grouping and by fixing the at least slightly overlapping strip sections to one another—for example, by bonding.

The bonding can be achieved, for example, by preparing adhesive surfaces on the strip sections. Optionally, a sufficient amount of cold glue or hot glue can be applied to one of the strip sections or to both overlapping regions of the superimposed strip sections, which can provide a firm mechanical connection between the strip sections.

In this way, strapping sections, which hold the bundle or packaging unit together and fix the positions and also the alignments of the beverage cans to one another in the bundle unit, are formed from the strip sections, which are adhesively connected to one another.

The typical width of such strapping sections formed from the strip sections depends upon the requirements—in particular, with regard to the desired stability of the bundle or the packaging unit. A very thin and flexible packaging blank made of thick paper or thin cardboard will tend to require a collar section that is pulled down further, and slightly wider strapping sections in order to be able to ensure the desired mechanical stability of the packaging unit. On the other hand, a sufficiently stable and mechanically resistant cardboard as packaging blank will allow the width of the strapping sections to be fixed at a value of approximately one quarter or less of the height of the cylindrical shell surfaces of the beverage cans held together in this way.

To produce the packaging units according to the invention, different tool variants can be used to apply a packaging blank. A first variant of such a handling tool has a base plate acting as a carrier component, which corresponds to the size of the packaging blank, but in particular to the dimensions of the main surface of the packaging blank. The base plate should have at least the dimensions of the main surface, but can optionally also project beyond it on one side or on several sides or locations.

Folding tools, which can optionally be formed by collar-like stripping tools, rigidly anchored to the base plate, with beveled lower longitudinal edges, are located on each of the two longitudinal sides of the handling tool. The lower longitudinal edges, which are in each instance beveled towards the outer side of the base plate, are therefore spaced further apart from one another than the flanks, located above them and closer to the base plate, of the stripping tools.

The flanks parallel to one another of the stripping tools are at an internal distance from one another that corresponds approximately to the width of two beverage cans standing next to one another, such that they can provide that the side surfaces be folded over and pressed down when the handling tool is placed in the (normally perpendicular) feed direction if the base plate is lowered onto and/or placed on the packaging blank. The downwardly-diverging lower longitudinal edges of the flanks of the stripping tools, which extend in this way, also provide that the side surfaces be gently folded over and precisely guided when the base plate approaches the main surface of the packaging blank or when the base plate is placed.

A blade-like folding punch can also project or be moved out from the lower side of the base plate, which provides that the folding region be pressed into the main surface of the packaging blank as soon as the base plate is either placed on the packaging blank or is located at a defined vertical distance above the packaging blank. The folding punch, which preferably corresponds to the dimensions and in particular the length of the folding region extending from narrow side to opposite narrow side of the main surface of the packaging blank, presses the packaging blank in the provided region/folding region between the rows of beverage cans, which are initially still spaced apart by the horizontal distance, thereby activates the primary fixing element (together with the folding of the side surfaces), and reduces the horizontal distance to a value of zero or nearly zero, such that the beverage cans all touch one another linearly at their shell surfaces.

Alternatively, the blade-like folding punch can be anchored rigidly and immovably in the base plate of the handling tool. Also conceivable is a lifting movement of the folding punch transverse to the lower-side surface of the base plate, which can thus be moved downwards out of the base plate by a defined stroke in the stroke direction by an adjusting lever, depending upon the embodiment variant, in order to be able to press the folding region deeper between the adjacent rows of cans.

However, if the folding punch cannot or shall not perform any relative movements in the stroke direction relative to the base plate, the adjusting lever can practically serve to guide the entire handling tool.

Further embodiment variants of the handling tool are conceivable and practical. For example, the folding tools can also be formed by pivot brackets hinged on both sides to the base plate and pivotably mounted there, which in a downwardly-pivoted state can fold the side surfaces downwards by a folding angle of approximately 90° relative to the main surface of the packaging blank and apply them against the shell surfaces of the articles or beverage cans.

The two parallel pivot axes, about which the two pivot brackets can in each instance swivel, lie slightly above a plane that is defined by the packaging blank placed on the upper end faces 16 of the articles of the article grouping. In addition, the pivot axes run parallel to the bent edges between the main surface and the side surfaces, and thus also run parallel to the first main axis mentioned above.

The base plate acts as a guide and bearing for the folding punch in all variants of the handling tool. Normally, the base plate remains at a defined vertical distance from the main surface and is not placed on it, as a result of which frictional effects and other unfavorable effects can be avoided when the packaging blank is pressed onto the upper end faces of the beverage cans, when they are latched into the slot-like recesses, and when the side surfaces are folded down. The vertical distance thus provides that the packaging blank be able to slide on the upper end faces of the beverage cans in the article grouping during all reshaping processes and be able to perform relative movements that can occur in conjunction with the reshaping processes described here.

This also applies to the activation of the blade-like folding punch, which passes through a corresponding recess in the base plate and, by actuating the adjusting lever, presses on the folding region in a stroke direction aligned perpendicularly to the surfaces of the base plate and the main surface and presses it between the two adjacent rows of cans. As a result, the mutually-facing segments of the upper lid regions of the beverage cans are simultaneously pressed into the corresponding slot-like recesses on both longitudinal sides of the folding region. Such latching processes form part of the primary fixing element already mentioned several times.

In principle, it would be possible to combine the downwardly-pressing, blade-like folding punch, which pulls the rows of cans together when the folding region is pressed between the two adjacent rows of cans and reduces or eliminates the horizontal distance between them, with the pivot movements of the pivot brackets, in such a way that, after the two side surfaces of the packaging blank have been folded down, such pivot brackets are moved towards the longitudinal sides of the article grouping far enough that they can also contribute to reducing or eliminating the distance between the adjacent rows of cans.

Optionally, however, a small gap can be created between the pivot brackets and the side surfaces applied to the shell surfaces of the beverage cans, which in this way already form the collar section of the packaging blank, if the adjacent rows of cans are drawn together after and by pressing in the blade-like folding punch, and the horizontal distance between them is eliminated.

Furthermore, different variants of transport modules can be used in the production of the packaging units, which can, for example, in each instance comprise a base plate and tray-like receptacles for cylindrical articles such as, for example, beverage cans. Such a transport module can be conveyed on a defined transport route by the elements that are preferably flat on their lower side and have suitable driver recesses, projections, or the like, during which the article grouping located on it can be equipped with the packaging blanks and reworked into packaging units or bundles.

Alternatively, the transport modules, which can also be referred to as shuttles or transport shuttles, can be supported in a manner floating on the transport path, and in each instance centered and aligned by the handling tools.

The tray-like receptacles of the transport modules can be connected to one another in a suitable manner, such that the lower regions, close to the base, of the shell surfaces of the beverage cans are received therein in a positive-locking manner, wherein in each instance the respective beverage cans of the left and right rows (in relation to the transport direction TR or to the first main axis) are in contact with one another with their shell surfaces in line contact.

In contrast, the left and right rows are initially separated from one another by the vertical separating plane, which runs through the middle of the transport module in the longitudinal direction and contains the first main axis, and by the horizontal distance. Suitable construction means can be used to allow relative movement of the two rows to one another—preferably against resilient restoring forces. However, other variants of such ability to displace the article positions in the transport module are also possible—for example, by activation by suitable adjusting levers.

With a further variant of a transport module, in which an article grouping with a total of four, six, or eight articles or beverage cans is conveyed in two separate rows, such rows can be held and guided in transport aisles. A separating bar located in the middle between the rows separates the two transport aisles, while outer limiting bars define the width of each of the two transport aisles.

The distances between the separating bar and the outer limiting bars on both longitudinal sides of the transport module define the width of the transport aisles and are based upon the outer diameters of the articles or beverage cans to be handled and conveyed. In addition, the width of the middle separating bar defines the horizontal distance between the two rows.

To produce the packaging units with the two adjacent rows of beverage cans, wherein the horizontal distance is eliminated, the beverage cans must be brought together such that there can no longer be a separating bar; the two, previously separate transport aisles are brought together to form a common transport lane.

Optionally, the handling tool can also have centering pins, which can be fastened to the narrow sides of the base plate on front and rear extensions, for example, and which project perpendicularly from the lower side of the base plate, such that they point vertically downwards in the direction of the transport module when the handling tool is used as intended. The centering pins are in each instance positioned on the extensions of the narrow sides of the base plate in such a way that they do not touch or collide with the main surface of the packaging blank to be arranged between them, i.e., they are at a distance from one another that is greater than the length of the main surface between the centering pins.

When the handling tool is lowered onto the transport module in order to apply the packaging blank to the article grouping inserted there, the centering pins can engage in corresponding receiving holes, such that the transport module can be positioned and centered precisely relative to the handling tool. Optionally, one of the receiving holes or both receiving holes can in each instance be formed by an elongated hole, which can prevent undesired jamming or tilting of the centering pins in the receiving holes if the handling tool is lowered or pulled off upwards again.

The handling tool can also optionally include folding tools that can be displaced parallel to the longitudinal central axes and the shell surfaces of the beverage cans in the article grouping, which can thus be lowered in synchronization with the feed directions during their intended use perpendicular to the surface or main surface of the packaging blank. In this way, the folding tools provide that the side surfaces be able to be folded downwards and placed on the shell surfaces of the beverage cans.

In addition, negative pressure grippers or suction grippers can optionally be provided, with which the packaging blank can be grasped, positioned, and held in the handling tool, in order to be able to place it precisely at the desired position on the upper side of the article grouping. By switching off the suction pressure on the suction grippers, the main surface of the packaging blank can be detached and separated from the base plate of the handling tool as required, in order to subsequently carry out the provided (and above-described) forming and manipulation steps to form the bundle or packaging unit by lowering the handling tool 56.

Even if in the present connection reference is made to article groupings of distances between adjacent rows of beverage cans to be equipped with a packaging blank, this is not the only variant of bundle formation. If such article transport is not desired, pre-formed packaging blanks can also be used, which can be placed directly on article groupings in which the articles in adjacent rows are already in line contact. In such a variant, it can also be practical to press the correspondingly pre-formed folding region of the packaging blank between the upper lid regions of the pairs of beverage cans that are not spaced apart, without the beverage cans having to be brought closer together. In such a variant, the articles in the grouping can already be in their final position, which they also occupy in the completed packaging unit.

In an optional but practical configuration variant of the pivoting folding tools of the handling tool, the strip sections, which form extensions of the side surfaces on their narrow sides, can be folded over immediately when the side surfaces are applied against the shell surfaces of the beverage cans, as a result of which the secondary fixing element can be prepared. For this purpose, additional molded parts can be attached to the pivot brackets, for example. Such optional molded parts are in each instance practically located on the lateral rims of the pivot brackets, such that they partially enclose the shell surfaces of the corner-side beverage cans when they are fed to the article grouping, such that they already apply the strip sections to the narrow sides of the article grouping during the application and folding over of the side surfaces.

By additional fastening and/or application tools, the overlapping regions of the strip sections can be fixed to one another—for example, by bonding after applying a sufficient volume of adhesive. This can, for example, be a cold glue, a hot glue, or a self-adhesive surface on one of the strip sections or another fixing aid.

An additional stabilizing option can be to bond the strip sections not only to one another, but also to the shell surfaces of the articles—for example, using the same adhesive agent that is also used to bond the overlapping regions of the strip sections. However, it should be emphasized that such bonding of the strip sections to the shell surfaces of the articles is merely an additional option that can be implemented or dispensed with in practice. Such an additional option with the formation of the secondary fixing element can make the bundle even more stable if required.

For the formation of the secondary fixing element, different folding tools can be used together with associated control elements for movement control, e.g., for movement control of several folding fingers, which can in particular replace molded parts such as those mentioned above.

A transverse beam running in a plane above the strip sections to be folded over, which form the strapping sections and thus the secondary fixing element when bonded together or fixed to one another in the final state, can be guided laterally in a circumferentially-guided endless traction device such as, for example, a circulating chain or a belt. The endless traction device can, for example, be guided by two spaced-apart guide wheels, at least one of which is motor-driven. Several pairs of folding fingers can be held and mounted on the transverse beam, which project downwards into a movement plane of the packaging units and can contact the packaging units if they are moved along or against the transport direction of the packaging units by the transverse beam.

Furthermore, the folding fingers can be fed in pairs towards one another or away from one another, i.e., they can be movable transversely to the transverse beam over defined adjustment paths in each instance, while the transverse beam is moved along or against the transport direction of the packaging units by the endless traction device in its defined plane of movement. Such transverse movement of the folding fingers is preferably controlled by guide slots, each of which comprises straight and parallel sections, in which the folding fingers are spaced closer together, and other straight and parallel sections in which the folding fingers are spaced further apart. Such sections running parallel in pairs of the guide slots are in each instance connected by inclined sections, in which the guide slots move symmetrically away from one another or symmetrically towards one another. The folding movements required for folding over the strip sections of the packaging blanks can be generated with the circulation of the transverse beam and the folding fingers guided thereby in the correspondingly-contoured guide slots.

With the production of the packaging units according to the invention, which are formed from several articles such as beverage cans in particular, these can initially be transferred from a mass flow into a multi-row transport flow in a dividing module. Further transport of the articles or beverage cans can be aisle-guided in particular. Preferably, grouping also takes place in such aisle guide, such that a grouping module can be assigned to the aisle guide.

In a downstream application module, the packaging blanks can then be applied in the manner described above, which means that the primary fixing element are produced by placing the packaging blank on and latching or otherwise connecting them to the articles or beverage cans.

In a separate further step, the band sections can be connected to one another and reshaped into strapping sections, which means producing the secondary fixing element by folding over, pretensioning, and fixing the overlapping strip sections and forming them into the strapping sections. In particular, such forming can take place in what is known here as a strapping module, which can be equipped with a forming tool or another tool or handling combination, for example.

BRIEF DESCRIPTION OF THE FIGURES

Exemplary embodiments of the invention and their advantages are explained in more detail below with reference to the accompanying figures. The proportions of the individual elements relative to one another in the figures do not always correspond to the actual proportions, since some forms are simplified, while other forms are shown enlarged in relation to other elements for better illustration.

FIGS. 1A through 1F show schematic views of various interacting individual components that can be reworked and reshaped into packaging units.

FIGS. 2A through 2E show the formation of packaging units by a handling tool based upon successive process steps.

FIG. 10A shows a perspectival and schematic view of two article groupings, on the upper side of which a packaging blank is placed in each instance.

FIG. 10B shows a perspectival and schematic view of several article groupings equipped with packaging blanks, on the upper side of which strapping heads access in each instance.

FIGS. 15A through 15C show schematic top views of various embodiment variants of a packaging blank as it can be used for the production of packaging units.

DETAILED DESCRIPTION OF THE INVENTION

Figure 1A:
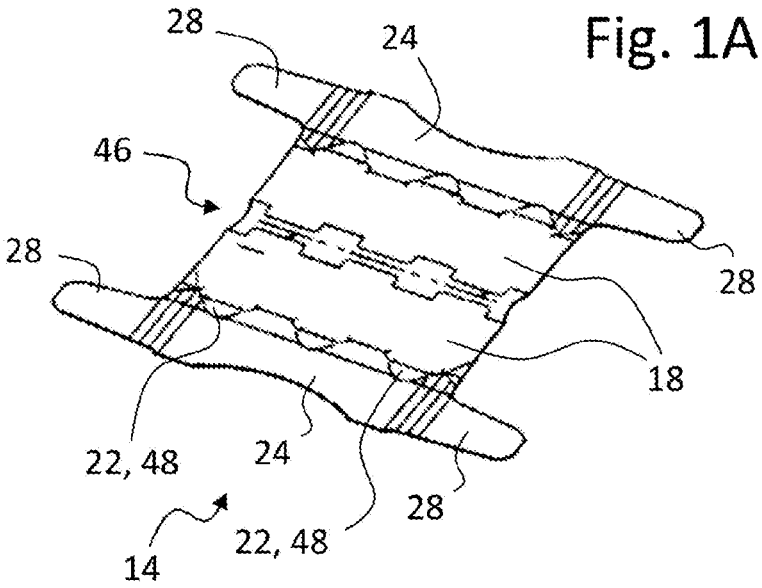

FIGS. 1A through 16B generally use the same reference numerals for identical or identically-acting elements of the invention. Furthermore, for the sake of clarity, reference numerals are only shown in the individual figures if they are necessary or practical for the description of the respective figure. The embodiments shown merely represent examples of how the application or strapping head according to the invention, the packaging device according to the invention, or the method according to the invention for producing packaging units can be designed, and do not constitute a definitive limitation.

Figure 1B:
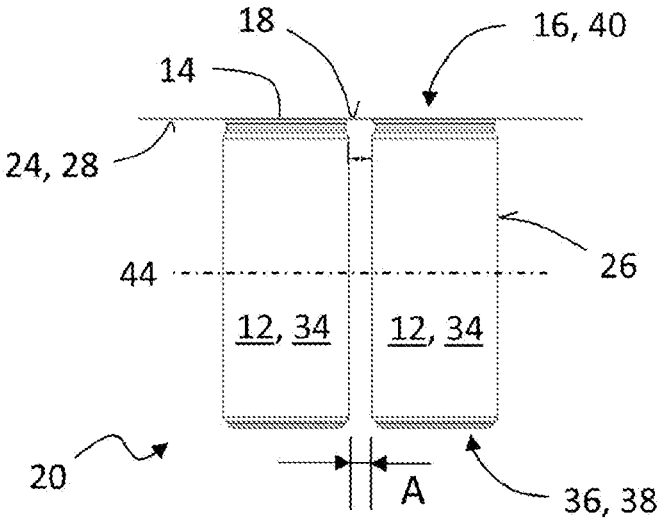

Based upon the perspectival and schematic views of FIGS. 1A and 1C through 1F and the schematic side view of FIG. 1B, some important guidelines and principles for the production of packaging units 10 by joining together several articles 12 and by mechanical combination by a packaging blank 14 are to be initially clarified.

It should be expressly emphasized that FIGS. 1A through 1F show the individual components of such a packaging unit 10 to be joined together and treated in the manner described below, as they can be produced in particular with the aid of the method according to the invention and with the preferred use of a handling tool 56, an application head 130, and/or a strapping head 180 according to the invention and/or with the intended use of a packaging machine according to the invention. In this respect, FIGS. 1A through 1F initially illustrate only a single packaging unit 10 and its components, without going into more detail about the design of an exemplary embodiment variant of the handling tool 56 (cf. in this regard FIGS. 2A through 2E), the application head 130 (cf. in this regard FIGS. 8A through 8E), the strapping head 180 (cf. in this regard FIGS. 10B through 13B), and/or the packaging machine (cf. FIGS. 14A through 14C).

If packaging units 10 are mentioned in this connection and in connection with the entire description, the equally common term, "bundle," can optionally be used instead. The term, "packaging unit" 10, used here is intended to designate the completed unit, which can be handled as a complete unit, may also be stackable, and/or can be purchased and used by the end customer at retail, consisting of at least two articles and the packaging materials that mechanically combine them.

In the exemplary embodiment shown, the packaging units 10 assembled and fabricated by the production process described below comprise a total of six similar articles 12, which are held together in a rectangular arrangement by a flat packaging blank 14. However, such a rectangular arrangement is not to be understood restrictively, such that the packaging units 10 could also comprise four, eight, or ten similar articles 12, which can be held together in such a rectangular arrangement by a correspondingly-shaped and correspondingly-dimensioned packaging blank 14.

With the method for producing the packaging units 10, the packaging blank 14 prepared for this purpose and formed into the shape shown, e.g., by a punching method (cf. FIG. 1A), is initially placed and/or applied to the article grouping 20 with a main surface 18 covering the first or upper end faces 16 or lid sides of the articles 12 grouped in a 3×2 rectangular arrangement (cf. FIGS. 1B and 1C). The term, "main surface" 18, used here refers to the rectangular section of the flat packaging blank 14, which covers the upper end faces 16 of the articles 12 assembled as the article grouping 20 in the 3×2 rectangular arrangement.

In conjunction with the placing of and by applying the packaging blank 14 to the upper side of the article grouping 20, i.e., to the upper end faces 16 of the grouped articles 12, connections are also formed between the articles 12 and the primary fixing element 22 of the packaging blank 14, referred to here as such. The primary fixing element 22 hold the packaging blank 14 on the articles 12.

In addition, the primary fixing element 22, which will be explained in more detail below, fix the positions of the articles 12 relative to one another, since the dimensions of the main surface 18 of the packaging blank 14 and the positions of the primary fixing element 22 are matched to the dimensions and diameters of the articles 12 and of the article grouping 20 consisting of several articles 12.

After the packaging blank 14 has been placed on the upper side of the article grouping 20 (FIG. 1C) and in conjunction with the formation of the primary fixing element 22, the side surfaces 24 of the packaging blank 14, which are located on both longitudinal sides of the article grouping 20, are folded over according to FIG. 1D and placed against shell surfaces 26 of the articles 12, but without following the curved contours of the shell surfaces 26.

The side surfaces 24 arranged in strips on the two longitudinal sides of the main surface 18 form a continuation of the main surface 18 of the packaging blank 14. Together with strip sections 28 continuing to both narrow sides of the side surfaces 26, the two side surfaces 24 adjacent to the main surface 18 of the packaging blank 14 form secondary fixing element 30, which interact with the shell surfaces 26 of the articles 12 when they are placed against them.

As FIGS. 1A and 1C clearly show, the side surfaces 24 are in each instance significantly longer than the main surface 18 due to the strip sections 28 extending them on both sides. The total length of the side surfaces 24 together with such strip sections 28 extending them to both narrow sides can be approximately twice the length of the longitudinal side of the main surface 18 or slightly less.

By fixing overlapping end regions of the strip sections 28 to one another and/or by fixing them to the shell surfaces 26 of the articles 12, the secondary fixing element 30 are formed by strapping sections 32, as is recognizable in the schematic perspectival view of FIGS. 1E and 1*n* the perspectival detail view of FIG. 1F. There, the strapping sections 32 each surround defined regions of the shell surfaces 26 of the articles 12, and specifically on both opposite narrow sides of the article grouping 20.

The articles 12, which are fixed and held in position by the strapping sections 32, can only be swiveled or displaced minimally when the packaging unit 10 is completed in this way (cf. FIG. 1E), such that the secondary fixing element 30 fix the articles 12 within the packaging unit 10 in a substantially parallel alignment of their longitudinal central axes to one another.

As FIGS. 1A, 1C, and 1D clearly show, the strapping sections 32 of the secondary fixing element 30 (cf. FIGS. 1E and 1F) are formed by the strip sections 28 of the packaging blank 14, which extend the side surfaces 24 to both narrow sides in directions along the longitudinal extension directions of the side surfaces 24.

The folding over of the side surfaces 24 and the application of the strip sections 28 by suitable handling devices, and the reshaping into the strapping sections 32, in which overlapping end regions are fixed to one another and/or to the shell surfaces 26 of the articles 12, will be more precisely explained and illustrated using the following FIG. 2A ff. based upon various exemplary embodiments.

As already becomes clear when looking at FIGS. 1A through 1E, the articles 12 can in particular be beverage cans 34, which is why the articles 12 thus identified here are also identified throughout by the reference numeral 34 in the present connection. The beverage cans 34 used here are in particular so-called slim cans or sleek cans made from a suitable metal sheet, and in particular from a suitable aluminum alloy. Optionally, however, the cans or beverage cans 34 can also be made of plastic or of a composite material, and in particular of a multilayer composite material.

The beverage cans 34, whose typical contours are shown in the schematic side view of FIG. 1B, are hollow-cylindrical in shape and closed on all sides. They also each have a flat or slightly concave, curved circular base region 36 on their lower end faces 38 and a mostly flat, circular upper lid region 40 on the opposite end face. This upper lid region 40 forms the aforementioned upper end face 16 of the articles 12 formed by the beverage cans 34.

The flat or concave, slightly curved base region 36 on the lower end face can typically be connected in one piece to the cylindrical shell surface 26, which can usually be realized by a deep-drawing process in the case of tin cans.

What in the present context is also referred to as the upper end face 16 of the article 12 is, in the example of the beverage cans 34, their respective upper lid region 40. The lid itself can, for example, be connected to the upper rim of the cylindrical shell of the beverage cans 34 by crimping, such that a can 34 closed on all sides is formed. A smaller tear-off lid or tear-off closure with a tear-off tab or the like may be incorporated within the lid surface, wherein scoring lines can be present as predetermined breaking points in the metal or aluminum sheet, which enable the tear-off closure to be opened to remove the liquid in the beverage can 34. However, such optional tear-off lid and the tear-off tab that may be fastened to it are not shown here, since such parts are not closely related to the formation of the packaging units 10.

As FIG. 1B also clearly shows, the cylinder diameter in the region of the cylindrical shell surface 26 and the outer circular diameters of the base region 36 and of the lid region 40 of the beverage cans 34 shown are substantially the same or nearly the same, wherein the base region 36 and/or the lid region 40 can be slightly retracted or tapered relative to the cylindrical shell surface 26.

Such a can shape with an almost uniformly cylindrical outer contour of largely constant cylinder diameter from the base 36 to the lid 40 is a characteristic feature of such so-called slim cans or sleek cans, whereas conventional (standard) cans normally have significantly smaller diameters in the base and lid regions than in their cylindrical shell regions.

Therefore, when cans 34 or beverage cans 34 are referred to in the present connection, this can in principle and in all cases mentioned mean such slim cans or sleek cans.

Here so designated upper gripping cardboard packages, which are known for combining standard cans and which have a number of openings for the standard cans to pass through, thus simultaneously define the positions of the cans within packaging units formed in this way. The gripping cardboard packages are normally pressed onto a set of standard cans from above, such that the lid region of the standard cans passes through an assigned opening.

Often, the gripping cardboard package is anchored below the lid region of the standard cans, and in particular in a region with a reduced cross-section or in a constricted region just below the flanged rim with which the lid is placed on the upper rim region of the cylindrical shell region. Within a packaging unit produced in this way, the cans are arranged closely together, and normally with their shell surfaces in touching contact.

However, the use of such well-known or conventionally-designed gripping cardboard packages for so-called slim cans or sleek cans, as can be realized here based upon the beverage cans 34, is hardly practical. Since the diameter in the lid region 40 and the diameter in the cylindrical shell region 26 of such cans 34 hardly differ or do not differ at all, there is a lack of sufficient material between the openings of the gripping cardboard, such that the regions between the openings of adjacent cans 34 can easily tear out, as a result of which the gripping cardboards lack or lose the necessary stability.

For this reason, the articles 12 or beverage cans 34 of the article grouping 20 are spaced apart at least temporarily and for the purpose of attaching the packaging blank 14 and forming the primary fixing element 22 in one of the main horizontal axes of the article grouping 20. FIG. 1B illustrates such defined horizontal distance A between the respective adjacent articles 12 or beverage cans 34 (here: slim or sleek can) in a direction parallel to the second main axis 44 of the article grouping 20 (cf. FIG. 1C). The two rows of three articles 12 located next to one another, which together form the article grouping 20, are thus spaced apart by such horizontal distance A.

The two horizontally-aligned or horizontally-running main axes 42 and 44 of the article grouping 20 are illustrated in FIG. 1C and are in each instance illustrated by dash-dotted lines. Thus, in the embodiment variant of the 3×2 rectangular arrangement of the grouped articles 12 or beverage cans 34 shown there, a first main axis 42 runs parallel to the two rows, in each instance with three articles 12 or beverage cans 34 aligned one behind the other or standing one behind the other, while the second main axis 44, which is aligned orthogonally thereto, runs transversely to such rows of three.

Both main axes 42 and 44 are normally aligned horizontally, since the article grouping 20 is normally conveyed with the respective base regions 36 of the beverage cans 34 upright on suitable transport devices, such as, for example, on horizontal conveying device devices suitable for this purpose, in a defined transport direction TR, where they are also equipped with the packaging blank 14. Therefore, the first main axis 42 runs parallel to or in the direction of the transport direction TR (in FIG. 1C from top left to bottom right), such that the second main axis 44 is oriented transversely to the transport direction TR.

Thus, the horizontal distance A is also plotted parallel to the second main axis 44, as illustrated in FIG. 1B. In order to be able to ensure the desired reliable fixing of the articles 12 or beverage cans 34 within the packaging blank 14 prepared and in particular pre-punched for this purpose using the primary fixing element 22—although in the slim or sleek cans shown here, which form the beverage cans 34, sufficient space does not exist between the upper lid regions 40 of the adjacent beverage cans 34—it is necessary in the initial phase of equipping the article grouping 20 to create the defined horizontal distance A between the two rows of three beverage cans 34 parallel to the first main axis 42.

In the schematic side view of FIG. 1B, such horizontal distance A is shown between two adjacent beverage cans 34, which represent each of the pairings of articles 12 or beverage cans 34 transverse to the first major axis 42 recognizable in FIGS. 1C and 1D.

Such arrangement with rows of beverage cans 34 spaced apart by the horizontal distance A makes it possible to press a folding region 46 of the packaging blank 14 between the upper lid regions 40 of the pairs of beverage cans 34 initially spaced apart by the distance A, as a result of which, at the same time, such beverage cans 34 or such rows of three beverage cans 34 conveyed one behind the other in the transport direction TR are in each instance brought closer in pairs until their shell surfaces 26 in each instance contact one another in line contact.

The folding region 46 is located in the main surface 18 of the packaging blank 14 and divides it into two rectangular halves (cf. FIGS. 1A and 1B), which are located on both sides of a vertical separating plane (not separately marked here), which is located between the pairs of beverage cans 34 spaced apart by the horizontal distance A. The first main axis 42 lies within such vertical separating plane, while the second main axis 44 cuts perpendicularly through the vertical separating plane.

The folding region 46, which divides the main surface 18 in the middle in a direction parallel to the first main axis 42, serves to form the primary fixing element 22 with which the articles 12 or beverage cans 34 are held in the composite of the packaging unit 10 as soon as the packaging blank 14 has been reshaped, pressed into the folding region 46, and folded in sections in the manner described here, and the secondary fixing element 30 have been brought into position in the intended manner and connected to one another.

After the packaging blank 14 has been placed (cf. FIG. 1A) with its main surface 18 on the upper end faces 16 of the articles 12 or beverage cans 34 (cf. FIG. 1C) placed in the article grouping 20 in a rectangular arrangement, but which are still spaced apart in pairs by the horizontal distance A according to FIG. 1B, the side surfaces 24, projecting laterally beyond the opposite longitudinal sides of the article grouping 20, of the packaging blank 14 are folded down laterally, such that they rest against the respective shell surfaces 26 of the beverage cans 34 (cf. FIG. 1D). The side surfaces 24 of the packaging blank 14 are in this case folded by approximately 90°.

In the present connection, the extensions of the two side surfaces 24, which extensions project significantly beyond the length of the main surface 18 of the packaging blank 14 in the direction of both narrow sides of the main surface 18, are also referred to as strip sections 28 or as extended strip sections 28, since they have a specific function to fulfill in conjunction with the production and the formation of the secondary fixing elements 30, as is illustrated with reference to FIGS. 1E and 1F.

The strip sections 28 are not normally separated from the side surfaces 24 and added there subsequently, but are an integral component of the side surfaces 24, wherein the strip sections 28, along with other components and functional elements of the packaging blank 14, can practically be produced from a cardboard sheet or similar flat packaging material in a single or possibly also in a multi-stage punching process, which has advantages in terms of production and fabrication technology and provides an easy-to-process aid with which loose articles 12 can be connected and combined to form a packaging unit 10 in the manner described here.

After the side surfaces 24 according to FIG. 1D have been folded over, wherein pre-folded and/or perforated or otherwise predetermined bent edges can be practically used on the longitudinal edges of the main surface 18 of the packaging blank 14, the packaging blank can be further processed in two or more phases in order to achieve the final state of the packaging unit 10 according to FIG. 1E (and according to the detail view of FIG. 1F).

After the packaging blank 14 has been placed on the upper side of the article grouping 20, such two-phase or multi-phase further processing comprises pressing in the main surface 18 of the packaging blank 14 over the entire length of the folding region 46 running in the middle through the main surface 18, which, on the one hand, causes the two spaced-apart rows of three with articles 12 or beverage cans 34 to move together and the distance A to be reduced to nearly a value of zero, but which, on the other, also causes segments of the upper rims of the beverage cans 34 at their upper lid regions 40 to dip and/or snap into prepared slot-like recesses 48 within the main surface 18 (cf. FIG. 1F).

In principle, the primary fixing element 22 can also be produced and formed in other ways, e.g., by apertures in the main surface 18 of the packaging blank 14, which correspond to the diameters of the beverage cans 34 in their upper lid region 40, such that the articles 12 or beverage cans 34 can be pressed in and latched there upon placement of the packaging blank 14.

For this purpose, the folding region 46 can, for example, be pressed downwards between the beverage cans 34 in a V-shape within the separating plane between the rows of containers and with a bent edge parallel to the first main axis 42 in the form shown, wherein prepared bent edges, perforations, or the like can provide a defined fold at the transition edges to the main surface 18, which in each instance adjoin each of the slot-like recesses 48 on either side.

The flanks of the V-shaped deformed folding region 46, which point on both sides to the halves of the main surface 18 divided in the middle by the folding region 46, which is pressed down between the rows of containers, can enclose an opening angle $\alpha$ between them, which can lie in reasonable orders of magnitude between approximately 80 and nearly 180 degrees. In the exemplary embodiment shown in FIGS. 1E and 1F, this opening angle is a is at a value of approximately 120°.

However, such value of the opening angle $\alpha$ is not to be understood as restrictive, since the opening angle $\alpha$ of the V-shaped folding region 46 can be based upon the deformability of the flat material used for the packaging blank 14, upon the upper rim contour of the articles 12 or beverage cans 34, upon the shape of the can, or upon other boundary conditions, depending upon the practicality. However, other contours of the deformed folding region 46 are also conceivable, which deformed folding region does not necessarily have to be reshaped into a V-shape, but can, for example, also have a chamfer-like base with a defined curvature radius or a rectangular cross-sectional contour.

It is also conceivable that the folding region 46 could be bent over sharply by nearly 180 degrees, resulting in material sections being placed against one another, which in this case can be pressed in slightly deeper between the bordering rows of three articles 12 or beverage cans 34. Such a penetration of the material sections of the folding region 45 placed against one another by up to a few centimeters can be a practical option in the fabrication of the packaging units 10.

On opposite sides, the recesses 48 can in each instance cover circular segments of the rims on the upper end faces 16 of the beverage cans 34 with segment angles of approximately 40° . . . 60° (optionally, also slightly more or less). As can be seen in FIGS. 1E and 1F, the respective transitions from the main surface 18 to the side surfaces 24 can also optionally be bent twice by 45° in each instance, which as a whole results in the aforementioned bend angle of 90°. In this way, roof-shaped transitions 50 are created in each instance, in which the recesses 48 are located, with which the beverage cans 34 can be latched in each instance.

After the primary fixing element 22 have been activated in this way, and the respective distances A between the beverage cans 34 have been eliminated, such that the respective contact lines between the previously spaced-apart beverage cans 34 in the two longitudinal rows are precisely on the aforementioned separating plane, the secondary fixing element 30 can be activated.

The primary fixing element 22 are realized by the beverage cans 34 held relatively firmly in the packaging blank 14, as a result of which the relative positions of the beverage cans 34 with respect to one another are largely fixed. Since the beverage cans 34 are fixed by their respective precise positioning within the recesses 48, at least at their upper rim sections on their lid regions 40 relative to the packaging blank 14 and relative to the other beverage cans 34 or articles 12 in the article grouping 20, they can hardly deviate there.

However, since the packaging blanks 14 made of thin cardboard material normally used for the purpose described do not generally have a high bending stiffness, initially, only the positions of the beverage cans 34 to one another are defined. However, this does not necessarily apply to their alignments with respect to the respective longitudinal central axes of the articles 12 or beverage cans 34, since these can generally still be tilted relative to one another due to the flexibility of the packaging blank 14, wherein the lower regions, i.e., the base regions 36 of the beverage cans 34, can diverge.

In order to reliably prevent such undefined tilting of the beverage cans 34 within the composite of the article grouping 20 equipped with the packaging blank 14, the invention provides secondary fixing element 30 that, like the primary fixing element 22, can be formed equally by the shaping and supplementary functional elements of the packaging blank 14 as integral components thereof.

The side surfaces 24 of the packaging blank 14, which are applied laterally against the shell surfaces 26 of the beverage cans 34 on both outer longitudinal sides of the arrangement or article grouping 20, form collar sections 52, as it were, which are held there when the secondary fixing element 30 are used as intended, and may even be slightly pretensioned. The secondary fixing element 30 are activated by folding over the strip sections 28 around the shell surfaces 26 of the articles 12 or beverage cans 34 located on the opposite narrow sides of the article grouping 20 and by fixing the at least slightly overlapping strip sections 28 to one another—for example, by a bonding 54.

The bonding 54 indicated only schematically in FIGS. 1E and 1F by an interrupted line in the overlapping region of the strip sections 28 can be produced, for example, by prepared adhesive surfaces on the strip sections 28. Optionally, a sufficient amount of cold glue or hot glue or other adhesive agent can be applied to one of the strip sections 28 or to both of the overlapping regions of the superimposed strip sections 28, which can provide a firm mechanical connection between the strip sections 28.

However, the overlapping strip sections 28 can also be connected to one another in other ways—for example, by stapling, by a punched joint, or the like.

In this way, the strapping sections 32, which hold the bundle or packaging unit 10 together and fix the positions and also the alignments of the beverage cans 34 to one another in the bundle unit, are formed from the strip sections 28, which are adhesively connected to one another.

The typical width of such strapping sections 32 formed from the strip sections 28 depends upon the requirements—in particular, with regard to the desired stability of the bundle or packaging unit 10. A very thin and flexible packaging blank 14 made of thick paper or thin cardboard will tend to require a collar section 52 that is pulled down further and slightly wider strapping sections 32 in order to be able to provide the desired mechanical stability of the packaging unit 10.

On the other hand, a sufficiently stable and mechanically resistant cardboard as packaging blank 14 will allow the width of the strapping sections 32 to be fixed at a value of approximately one quarter or less of the height of the cylindrical shell surfaces 26 of the beverage cans 34 held together in this way, as shown with the variant illustrated in FIGS. 1A through 1F. There, the width of the strapping sections 32 is even less than one fifth of the respective height of the cylindrical shell surfaces 26 of the beverage cans 34.

Figure 15C:
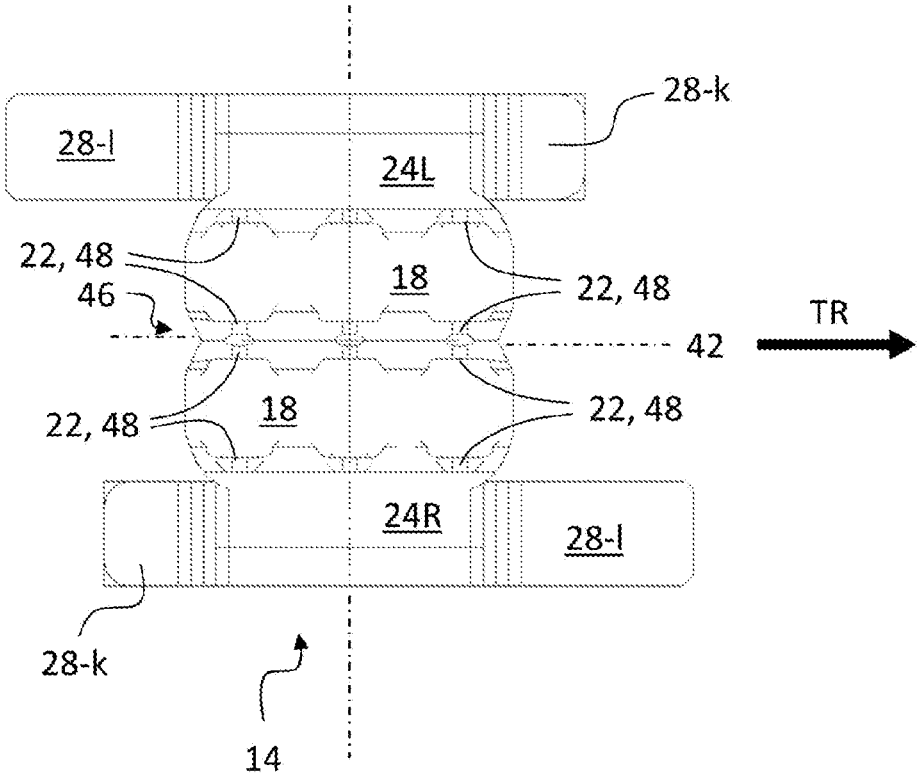

The strip sections 28 of the variant of the packaging blank 14 according to FIG. 1A and FIG. 1C are in each instance of the same length, such that the packaging blank 14 is also designed to be mirror-symmetrical with respect to both the first main axis 42 and the second main axis 44. In principle, in alternative embodiment variants, the strip sections 28 can be designed in length configurations that differ from one another. FIGS. 15B and 15C, for example, show alternative embodiment variants in which the strip sections 28 can be designed in different length configurations.

Figure 2C:
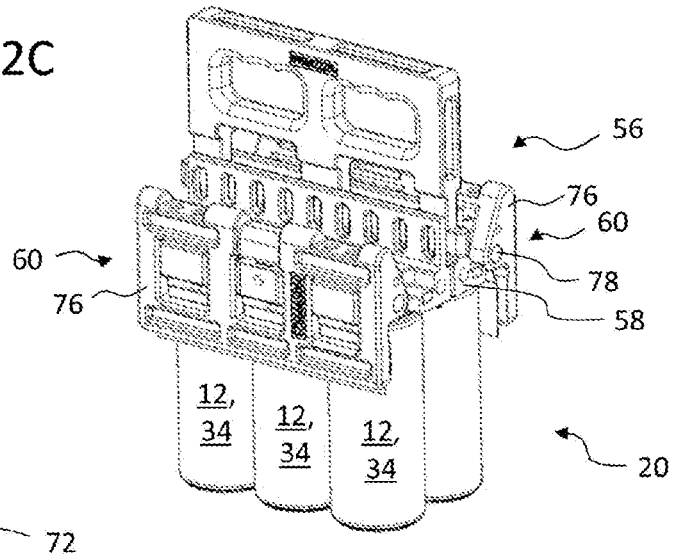
Figure 2D:
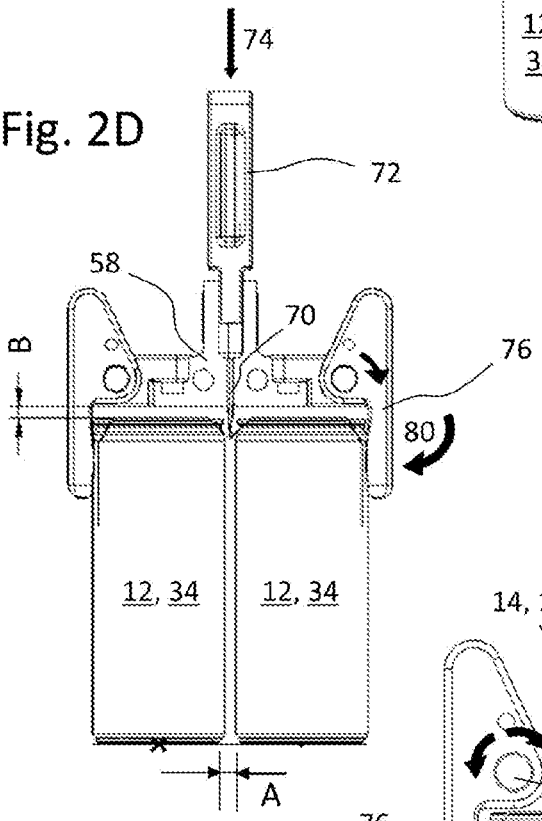
Figure 2E:
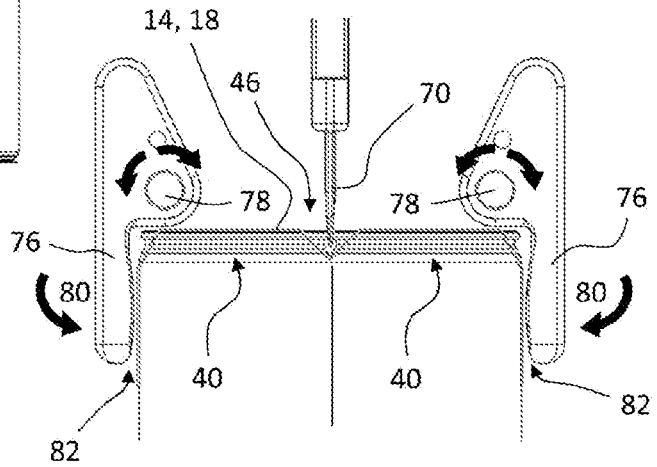

The schematic and perspectival views of FIGS. 2A through 2C and the two schematic side views of FIGS. 2D and 2E illustrate the use of different tool variants for applying a packaging blank 14, as previously explained with reference to FIGS. 1A through 1F, to an article arrangement 20, which in turn is formed by a total of six beverage cans 34 in a 2×3 rectangular arrangement.

However, purely as a precaution, it should be noted at this point that FIGS. 2A through 2E essentially only show the steps of placing a packaging blank 14 with its main surface 18 on the upper end faces 16 of the cylindrical articles 12 formed by beverage cans 34, folding over the side surfaces 24 of the packaging blank 14, and pressing in the folding region 46 running in the middle through the upper main surface 18 of the packaging blank 14, and thus the formation of the primary fixing element 22 (cf. in this regard FIGS. 1A through 1D).

Not shown, however, is the handling and formation of the secondary fixing element 30, formed here by the strip sections 28 to be connected to one another as strapping sections 32 (cf. FIGS. 1E and 1F). Such formation of the secondary fixing element 30, which are formed here as an example by the strapping sections 32, will be explained in more detail below with reference to FIGS. 10A through 13B, wherein a strapping head 180 that can be used for this purpose will also be described in its structure, in its design details, and in its mode of operation.

Thus, FIG. 2A illustrates a schematic perspectival view from below at an angle of the article arrangement 20 with the total of six beverage cans 34 arranged in a rectangular configuration, above which the pre-punched and still unfolded packaging blank 14 is located, which is, however, still spaced apart from the upper end faces 16 of the beverage cans 34. Above the packaging blank 14 and at a distance therefrom is a first embodiment variant of a handling tool 56, which has a base plate 58 acting as a carrier component, which corresponds to the size of the packaging blank 14, but in particular to the dimensions of the main surface 18 of the packaging blank 14. The base plate 58 should have at least the dimensions of the main surface 18, but can optionally also project beyond it on one side or on several sides or locations.

Folding tools 60, which here are formed by collar-like stripping tools 62, rigidly anchored to the base plate 58, with beveled lower longitudinal edges 64, are located on each of the two longitudinal sides of the variant of the handling tool 56 shown in FIG. 2A. The lower longitudinal edges 64, which are in each instance beveled towards the outer side of the base plate 58, are therefore spaced further apart from one another than the flanks 66, arranged above them, and closer to the base plate 58, of the stripping tools 62.

The flanks 66, which are oriented parallel to one another, of the stripping tools 62 are at an internal distance from one another that corresponds approximately to the combined width of two adjacent beverage cans 34 next to one another, such that they can provide that the side surfaces 24 be folded over and pressed against one another when the handling tool 56 is placed in the feed direction 68 when the base plate 58 is lowered onto and/or placed on the upper side of the packaging blank 14. The downwardly-diverging lower longitudinal edges 64 of the flanks 66 of the stripping tools 62, which extend in this way, also provide that the side surfaces 24 be gently folded over and precisely guided when the base plate 58 approaches the main surface 18 of the packaging blank 14 or when the base plate 58 is placed.

A blade-like folding punch 70 also projects from the lower side of the base plate 58, which provides that the folding region 46 be pressed into the main surface 18 of the packaging blank 14 as soon as the base plate 58 is either placed on the packaging blank 14 or is located at a defined vertical distance B (cf. in this regard FIG. 2D) above the packaging blank 14.

The folding punch 70, which preferably corresponds to the dimensions and in particular the length of the folding region 46 extending from narrow side to opposite narrow side of the main surface 18 of the packaging blank 14, presses the packaging blank 14 in the provided region—this is the folding region 46—between the rows of three beverage cans 34, which are initially still spaced apart by the horizontal distance A, and thereby activates the primary fixing element 22 (together with the folding of the side surfaces 24) and reduces the horizontal distance A to a value of zero or nearly zero, such that the beverage cans 34 all touch one another linearly at their shell surfaces 26.

Optionally, the blade-like folding punch 70 can be rigidly and immovably anchored in the base plate 58 of the handling tool 56, as this is indicated by FIG. 2A. Also conceivable is a lifting movement of the folding punch 70 transverse to the lower-side surface of the base plate 58, which can thus be moved downwards out of the base plate 58 by a defined stroke in the stroke direction 74 by an adjusting lever 72, depending upon the embodiment variant, in order to be able to press in the folding region 46 deeper between the adjacent rows of cans.

However, if the folding punch 70 cannot perform any relative movements in the stroke direction 74 relative to the base plate 58, the adjusting lever 72 serves to guide the entire handling tool 56.

FIGS. 2B and 2C show the same article grouping 20, consisting of six articles 12 in the form of beverage cans 34, which can be processed with a second embodiment variant of a handling tool 56 and provided with a packaging blank 14. While such second embodiment variant of the complete handling tool 56 is shown in FIG. 2C together with the article arrangement 20, but without the packaging blank 14, FIG. 2B shows the packaging blank 14 placed on the article arrangement 20 with the side surfaces 24 already folded over and a part of the folding tools 60 folding over or folding around such side surfaces 24, but without the other components of the handling tool 56.

Here, the folding tools 60 are formed by pivot brackets 76 hinged on both sides to the base plate 58 (cf. FIG. 2C) and pivotably mounted there, which, according to FIG. 2B, in a downwardly-pivoted state, can fold the side surfaces 24 downwards by a folding angle of approximately 90° relative to the main surface 18 of the packaging blank 14 and apply them against the shell surfaces 26 of the articles 12 or beverage cans 34.

The two parallel pivot axes 78, about which the two pivot brackets 76 can in each instance swivel, lie slightly above a plane that is defined by the packaging blank 14 placed on the upper end faces 16 of the articles 12 of the article grouping 20. In addition, the pivot axes 78 run parallel to the bent edges between the main surface 18 and the side surfaces 26, and thus also run parallel to the first main axis 42 (cf. in this regard FIG. 1C).

The possible pivot movements 80, which the two pivot brackets 76 can perform in each instance, in order to place the side surfaces 26 around and against the shell surfaces 26 of the articles 12 or beverage cans 34, are indicated by corresponding directional arrows in the schematic side view of FIG. 2D and in the lateral detail view of FIG. 2E.

Whereas, in the perspectival and schematic view of FIG. 2B, almost all components of the second embodiment variant of the handling tool 56 have been omitted, such that there only the two symmetrically-constructed pivot brackets 76 arranged symmetrically to the main surface 18, to the vertical separating plane mentioned above, and to the folding region 46 (not shown in FIG. 2B) are shown as substantial components of the folding tool 60, the perspectival and schematic view of FIG. 2C shows the complete handling tool 56, which is placed on the article arrangement 20. However, for the sake of clarity, the packaging blank 14 is missing from the representation here.

FIG. 2C also shows the base plate 58, which is positioned above the main surface 18 of the packaging blank 14. The pivoting folding tools 60, which are shown in FIG. 2C in the same active operating state as in FIG. 2B, are mounted and held on each of the two opposite longitudinal sides of the base plate 58. In the operating state shown in FIG. 2C, the two side surfaces 24 of the packaging blank 14 are folded down by the pivot brackets 76 located there and in this way form the collar section 52 for the formation of the secondary fixing element 30 or prepare such secondary fixing element 30 (cf. FIGS. 1E and 1F).

In the embodiment variant of the handling tool 56 shown in FIGS. 2B through 2E, the base plate 58 also functions as a guide and bearing for the folding punch 70, which is recognizable in FIGS. 2D and 2E. It is also clearly recognizable there that the base plate 58 remains at a defined vertical distance B from the main surface 18 and is not placed on it, as a result of which frictional effects and other unfavorable effects can be avoided when the packaging blank 14 is pressed onto the upper end faces 16 of the beverage cans 34, when they are latched into the slot-like recesses 48, and when the side surfaces 24 are folded down. The vertical distance B thus provides that the packaging blank 14 be able to slide on the upper end faces 16 of the beverage cans 34 in the article grouping 20 during all reshaping processes and be able to perform relative movements that can occur in conjunction with the reshaping processes described here.

This also applies to the activation of the blade-like folding punch 70, which passes through a corresponding recess in the base plate 58 and, by actuating the adjusting lever 72, presses on the folding region 46 in a stroke direction 74 aligned perpendicularly to the surfaces of the base plate 58 and the main surface 18 and presses it between the two adjacent rows of cans (cf. FIGS. 2D and 2E). As a result, the mutually-facing segments of the upper lid regions 40 of the beverage cans 34 are simultaneously pressed into the corresponding slot-like recesses 48 on both longitudinal sides of the folding region 46. Such latching processes form part of the primary fixing element 22 already mentioned several times.

In principle, it would be possible to combine the downwardly-pressing blade-like folding punch 70, which pulls the rows of cans together when the folding region 46 is pressed between the two adjacent rows of cans and reduces or eliminates the horizontal distance A between them, with the pivot movements 80 of the pivot brackets 76 shown in FIGS. 2D and 2E, in such a way that, after the two side surfaces 24 of the packaging blank 14 have been folded down, such pivot brackets 76 are moved towards the longitudinal sides of the article grouping 20 far enough that they can also contribute to reducing or eliminating the distance A between the adjacent rows of cans.

However, as can be seen in FIG. 2E, such option is not intended with the embodiment variant of the handling tool 56 shown and the reshaping processes carried out with it. Rather, a small gap 82 is formed between the pivot brackets 76 and the side surfaces 24 applied to the shell surfaces 26 of the beverage cans 34, which in this way already form the collar section 52 of the packaging blank 14, if the adjacent rows of cans are drawn together after and by the pressing in of the blade-like folding punch 70, and the horizontal distance A between them is eliminated, which is illustrated by the detail view of FIG. 2E.

However, the previously spaced-apart rows of cans are not necessarily drawn together solely by the folding punch 70 lowering in the stroke direction 74; rather, this can also be supported or brought about by other measures, which will be explained in detail below.

Figure 3A:
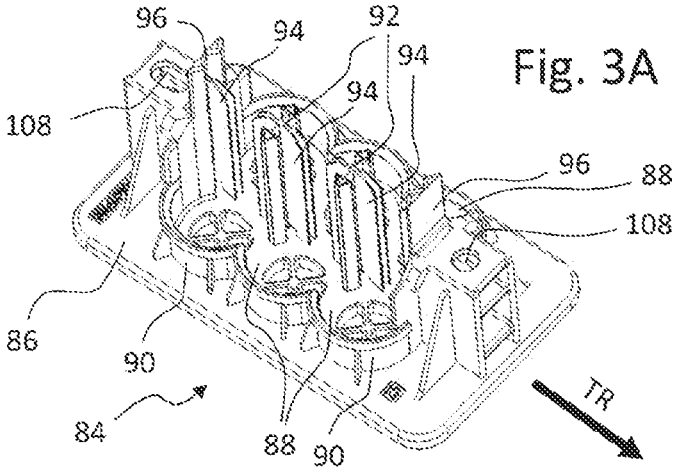
FIGS. 3A through 3C show schematic views of different variants of transport modules that can be used in the production of packaging units.
Figure 3B:
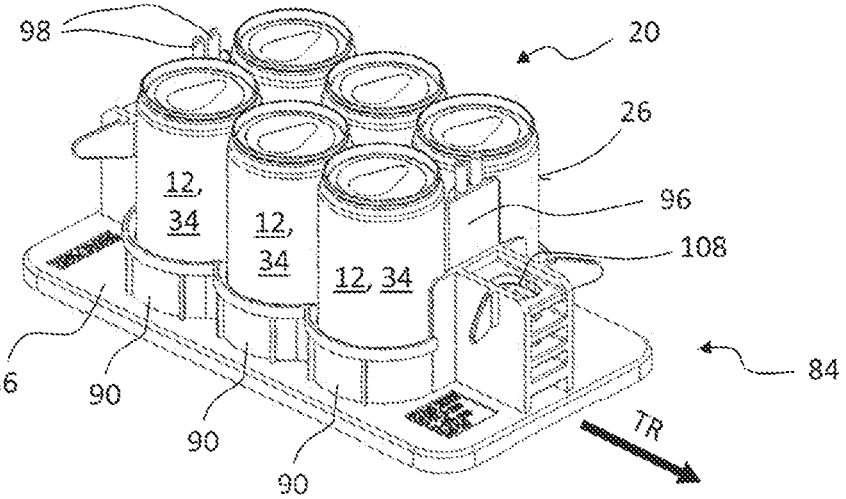
Figure 3C:
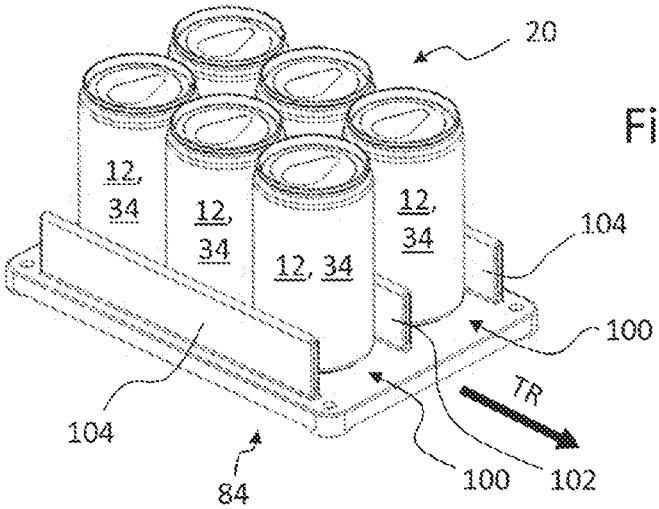

The schematic and perspectival views of FIGS. 3A, 3B, and 3C illustrate different possibilities for transporting the article groupings 20 prepared for reworking into packaging units 10 in the transport direction TR. FIGS. 3A and 3B show first and second variants of a transport module 84, which comprises a base plate 86 and tray-like receptacles 88 for cylindrical articles 12, such as, for example, beverage cans 34, placed thereon. FIG. 3A shows an empty, as yet unloaded, transport module 84, while FIG. 3B shows a very similar transport module 84, which is loaded with a total of six beverage cans 34 and is thus fully occupied.

FIG. 3C shows a further transport module 84, which, however, is constructed differently from the transport modules 84 shown in FIGS. 3A and 3B, and which is based upon a different functional principle.

The transport module 84 (according to FIG. 3A, FIG. 3B, or FIG. 3C) can be conveyed along a defined transport path (not shown here) in the transport direction TR by elements located on its lower side—preferably flat and equipped with suitable driver recesses, projections, or the like—while the article grouping 20 located on the respective transport module 84 can be equipped with a packaging blank 14 (cf. FIGS. 1A through 2E) and can be reworked into a packaging unit 10 (cf. FIGS. 1E and 1F) or a bundle.

Figure 4:
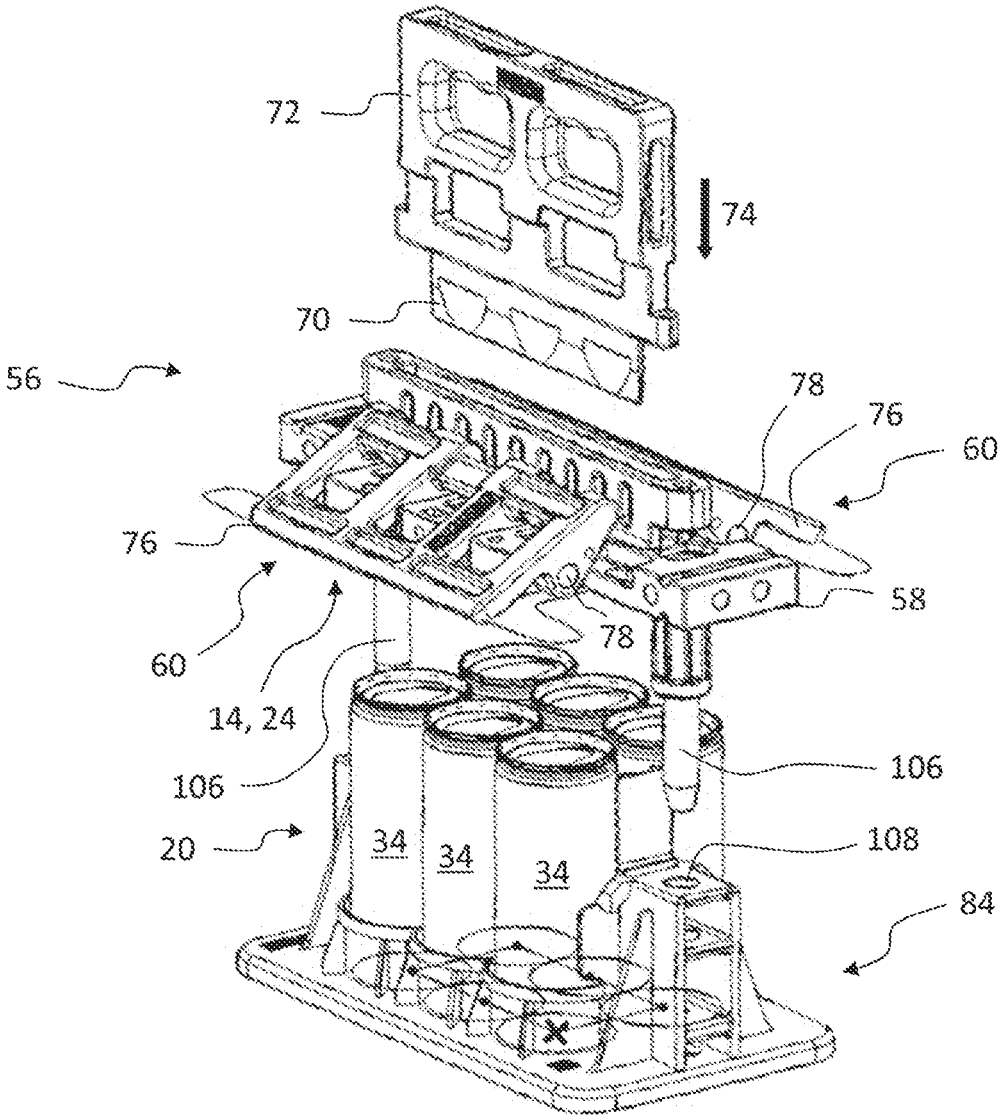
FIG. 4 shows the interaction of the transport modules with the handling tool to form packaging units.

Optionally, the transport modules 84, which can also be referred to as shuttles or transport shuttles, can be supported so as to float on the transport path and be in each instance centered and aligned by the handling tools 56 shown in FIGS. 2A through 2C (cf. in this regard FIG. 4 for further details).

The shell-like receptacles 88 of the transport modules 84 according to FIGS. 3A and 3B are connected to one another in such a way that only an outer, bar-like rim 90 is adapted to the contours of the beverage cans 34 to be received, wherein the rim 90 has the contour of several circular segments connected to one another at their ends with segment angles of approximately 100° for the two central rim segments to slightly more than 120° for the four corner-side rim segments. Such rim segments are connected to one another in such a way that the lower regions, close to the base, of the shell surfaces 26 of the beverage cans 34 are received therein in a positive-locking manner, wherein in each instance the three beverage cans 34 of the left and right rows (in relation to the transport direction TR or to the first main axis 42 according to FIG. 1C) are in contact with one another with their shell surfaces 26 in line contact.

In contrast, the left and right rows are initially separated from one another by the vertical separating plane (not shown), which runs in the middle of the transport module 84 in the longitudinal direction and contains the first main axis 42, and by the horizontal distance A.

FIG. 3A shows two separating bars 92, which are in each instance located in the middle between four adjacent beverage cans 34 in a square arrangement and which initially provide such horizontal distance A (cf. FIG. 1B) between the beverage cans 34 located on either side of the vertical separating plane in each instance, in that separating wings 94 suspended resiliently from the separating bars 92 anchored in a columnar manner to the base plate 86 press the beverage cans 34 against the outer bar-like rim 90 in each instance. On the front and rear narrow side (in relation to the transport direction TR) of the article grouping 20, there are additional limiting bars 96, which are also equipped with such resiliently-suspended separating wings 94, which press the beverage cans 34 resting against them towards the outer bar-like rim 90.

The vertically-extending and vertically-running spring connections on the column-like separating bars 92, and the separating wings 94, which, at the column-like limiting bars 96, yield elastically inwards in the direction of the separating plane, can yield inwards when the horizontal distance A is reduced by activating the folding punch 70, which presses the folding region 46 in the separating plane between the adjacent rows of three beverage cans 34 located in the transport module 84 (cf. FIGS. 2C through 2E), and are elastically deformed into the separating plane.

However, other variants of such ability to displace the article positions in the transport module 84 are also possible. Thus, the positions of the beverage cans can be changed when reducing the horizontal distance A by activating the folding punch 70, which presses the folding region 46 in the separating plane between the adjacent rows of three beverage cans 34 located in the transport module 84, and optionally also by activatable adjusting levers 98, which are schematically indicated in FIG. 3B. The adjusting levers 98 can, for example, be located on the upper end faces of the front and rear limiting bars 96 and, by pressing into the limiting bar 96, trigger or release a displacement of the article positions transverse to the transport direction TR or transverse to the first main axis 42.

In a further variant of a transport module 84 according to FIG. 3C, in which an article grouping 20 with a total of six articles 12 or beverage cans 34 is transported in two separate rows of three, such rows of three are held and guided in transport aisles 100. A separating bar 102 located in the middle between the rows of three separates the two transport aisles 100, while outer limiting bars 104 define the width of each of the two transport aisles 100.

The distances between the separating bar 102 and the outer limiting bars 104 on both longitudinal sides of the transport module 84 define the width of the transport aisles 100 and are based upon the outer diameters of the articles 12 or beverage cans 34 to be handled and transported. In addition, the width of the middle separating bar 102 defines the horizontal distance A between the two rows of three.

To produce the packaging units 10 with the two adjacent rows of three beverage cans 34, wherein the horizontal distance A is eliminated, the beverage cans 34 must be brought together, such that there can no longer be a separating bar 102; the two, previously separate transport aisles 100 are brought together to form a common transport lane, which will be illustrated in more detail below with reference to FIGS. 14B and 14C.

The schematic perspectival representation of FIG. 4 illustrates the interaction of some of the components and individual elements already explained above, viz., the transport module 84 according to FIG. 3A with a total of six receiving regions and beverage cans 34 inserted therein in each instance, and the handling tool 56 according to FIG. 2C, which is located at a distance above the article grouping 20 located in the transport module 84, with the folding tools 60 pivoted apart and the packaging blank 14 adhering to the lower side of the base plate 58 and not yet deformed.

In the representation in FIG. 4, the adjusting lever 72 with the folding punch 70 attached to the lower side is pulled upwards out of its guide in the base plate 58. For the proper functioning of the handling tool 56, it would have to be inserted there in the vertical direction in order to be able to be moved downwards in the stroke direction 74 when reshaping the packaging blank 14.

The pivot brackets 76, which are pivoted apart laterally and which are mounted in the pivot axes 78 on both longitudinal sides of the base plate 58, are in a raised position, which does not yet deform or press down the side surfaces 24 of the packaging blank 14.

Furthermore, FIG. 4 shows two centering pins 106, which are fastened to front and rear extensions on the narrow sides of the base plate 58 and which project perpendicularly from the lower side of the base plate 58, such that they point vertically downwards in the direction of the transport module 84 when the handling tool 56 is used as intended. The centering pins 106 are in each instance positioned on the extensions of the narrow sides of the base plate 58 in such a way that they do not touch or collide with the main surface 18 of the packaging blank 14 to be arranged between them, i.e., they are at a distance from one another that is greater than the length of the main surface 18 between the centering pins 106.

When the handling tool 56 is lowered onto the transport module 84 in order to apply the packaging blank 14 to the article grouping 20 inserted there, the centering pins 106 can engage in corresponding receiving holes 108, such that the transport module 84 can be positioned and centered precisely relative to the handling tool 56. FIG. 3A shows that one of the receiving holes 108 can be formed by an elongated hole, which can prevent undesired jamming or tilting of the centering pins 106 in the receiving holes 108 if the handling tool 56 is pulled off upwards again.

As can be seen in FIGS. 3A and 3B, the two receiving holes 108 are in each instance located in sockets that are arranged close to the narrow sides of the base plate 86. On the inner sides, pointing away from the narrow sides, of such two sockets, there are limiting bars 96, which provide for the beverage cans 34 resting there to be guided.

Figure 5A:
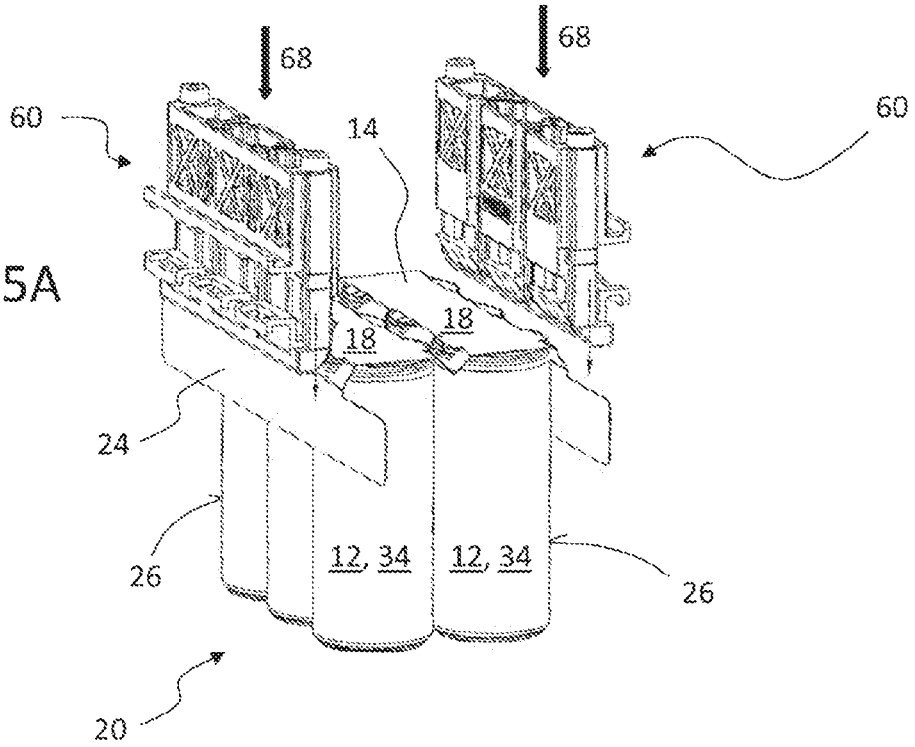
FIGS. 5A and 5B show different variants of a handling tool.
Figure 5B:
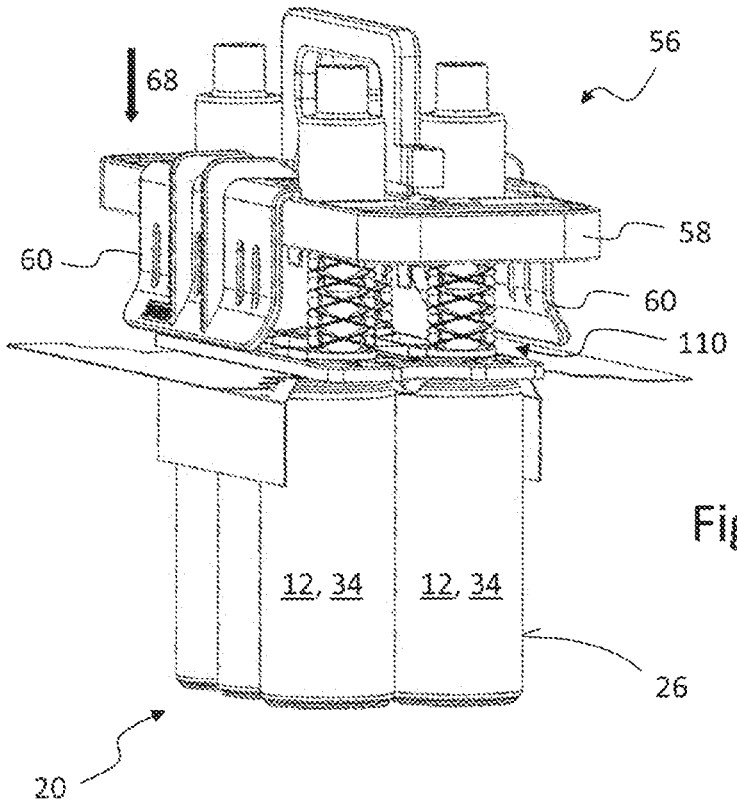

The schematic perspectival views of FIGS. 5A and 5B show further embodiment variants of folding tools 60 (FIG. 5A) and of a handling tool 56.

For example, FIG. 5A shows folding tools 60 that can be displaced parallel to the longitudinal central axes and the shell surfaces 26 of the beverage cans 34 in the article grouping 20, and which can thus be lowered in synchronization with the feed directions 68, during their intended use, perpendicularly to the surface or main surface 18 of the packaging blank 14. In this way, the folding tools 60 provide that the side surfaces 24 can be folded downwards in the manner shown and placed on the shell surfaces 26 of the beverage cans 34.

The handling tool 56 shown in FIG. 5B corresponds with regard to its folding tools 60 rigidly anchored to the base plate 58 to the embodiment variant already shown in FIG. 2A and explained in detail above.

In contrast, FIG. 5B shows additional components, viz., negative pressure grippers or suction grippers 110, with which the packaging blank 14 can be grasped, positioned, and held in the handling tool 56, in order to be able to place it precisely at the desired position on the upper side of the article grouping 20. By switching off the suction pressure at the suction grippers 110, the main surface 18 of the packaging blank 14 can be detached and separated from the base plate 58 of the handling tool 56 as required, in order to subsequently, by lowering the handling tool 56, carry out the provided (and above-described) forming and manipulation steps to form the bundle or packaging unit 10.

Figure 6:
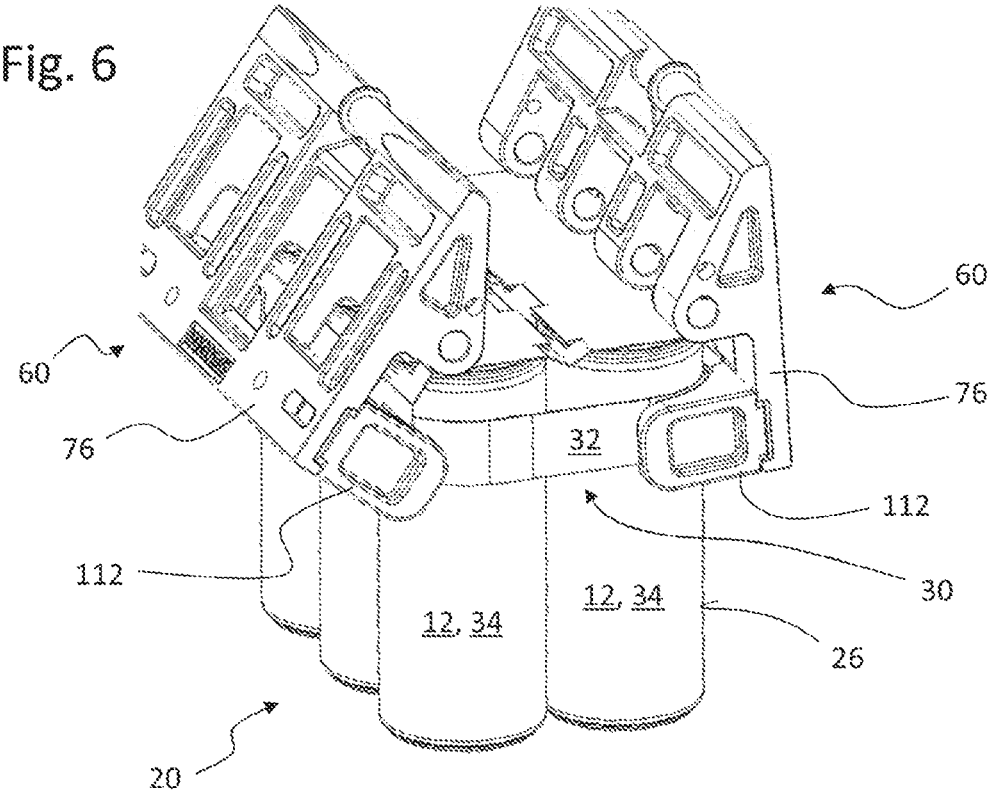
FIG. 6 shows further components of the handling tool in an alternative design.

The schematic perspectival representation of FIG. 6 shows an optional but practical configuration variant of the pivoting folding tools 60 according to FIGS. 2B through 2E and FIG. 4. In order to be able to fold the strip sections 28, which in each instance form extensions of the side surfaces 24 on their narrow sides, immediately when the side surfaces 24 are applied against the shell surfaces 26 of the beverage cans 34 and in this way to prepare the secondary fixing element 30, additional molded parts 112 are attached to the pivot brackets 76 in each instance.

The molded parts 112 are in each instance located at the lateral rims of the pivot brackets, such that they partially enclose the shell surfaces 20 of the corner-side beverage cans 34 when they are fed to the article grouping 20, such that they already apply the strip sections 28 to the narrow sides of the article grouping 20 during the application and folding over of the side surfaces 24.

By additional fastening and/or application tools not shown here, the overlapping regions of the strip sections 28 can be fixed to one another—for example, by bonding after applying a sufficient volume of adhesive. This can, for example, be a cold glue, a hot glue, or a self-adhesive surface on one of the strip sections 28, or another fixing aid.

Figure 7:
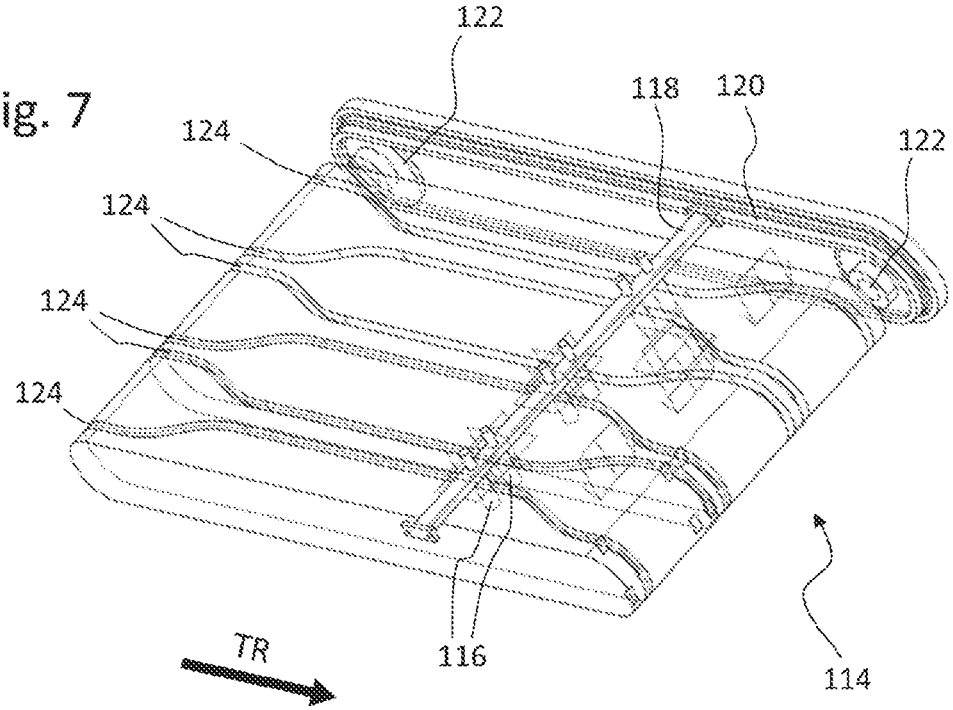
FIG. 7 shows a configuration for controlling folding devices that can be used in the formation of the packaging units.

The schematic perspectival view of FIG. 7 shows a conceivable embodiment variant of a folding tool 114 together with its control elements for controlling the movement of several folding fingers 116, which can in particular replace molded parts 112 such as those shown in FIG. 6.

A transverse beam 118 running in a plane above the strip sections 28 to be folded over, which form the strapping sections 32 and thus the secondary fixing element 30 when bonded together or fixed to one another in the final state, is guided laterally in a circumferentially-guided endless traction device 120 such as, for example, a circumferential chain or a belt. The endless traction device 120 are guided by two part guide wheels 122, at least one of which is motor-driven.

A total of three pairs of folding fingers 116 are held and mounted on the transverse beam 118, which project downwards into a movement plane of the packaging units 10 and can contact the packaging units 10 if they are moved along or against the transport direction TR of the packaging units 10 by the transverse beam 118.

Furthermore, the folding fingers 116 can be fed in pairs towards one another or moved away from one another, i.e., they can be moved transversely to the transverse beam 118 over defined adjustment paths in each instance, while the transverse beam is moved along or against the transport direction TR of the packaging units 10 by the endless traction device 120 in its defined plane of movement. Such transverse movement of the folding fingers 116 is controlled by guide slots 124, each of which comprises straight and parallel sections, in which the folding fingers 116 are spaced closer together, and other straight and parallel sections in which the folding fingers 116 are spaced further apart.

Such sections of the guide slots 124, which run parallel to one another in pairs in each instance, are in each instance connected by inclined sections, in which the guide slots 124 move symmetrically away from one another or symmetrically towards one another. The folding movements required for folding over the strip sections 28 of the packaging blanks 14 can be generated with the circulation of the transverse beam 118 and the folding fingers 116 guided thereby in the correspondingly-contoured guide slots 124.

The schematic perspectival views of FIGS. 8A through 8D illustrate an embodiment variant of a handling tool 56, which is characterized here by an application head 130 with a total of four integrated application units 132 for simultaneous and in particular synchronous handling of four article groupings 20, wherein each of the application units 132 is provided for equipping in each instance one of the article groupings 20 shown as examples in FIGS. 1A through 1F with a flat packaging blank 14.

Figure 8A:
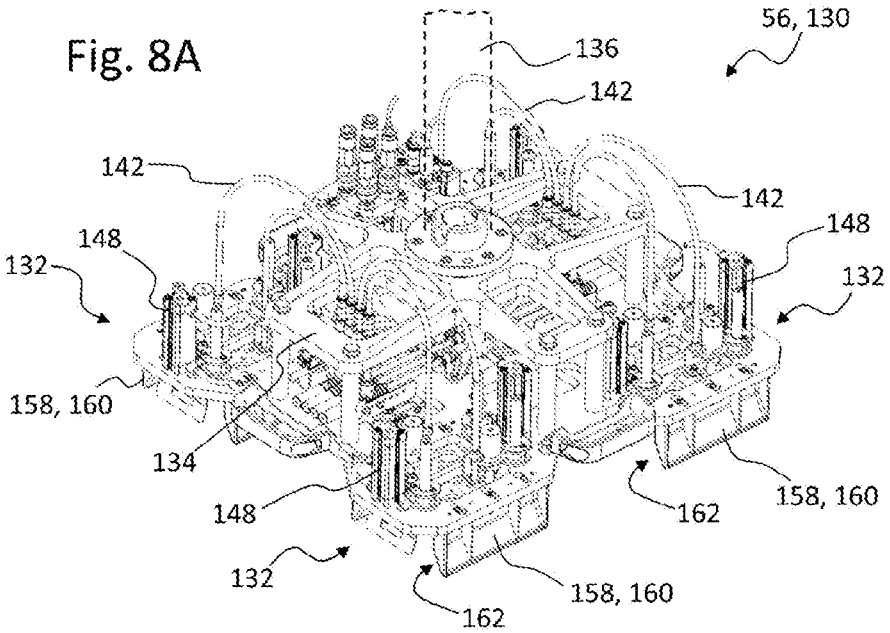
FIGS. 8A through 8D show different views of an embodiment variant of an application head according to the invention, which is equipped with four application units for equipping a total of four article groupings with packaging blanks.

As illustrated in particular in FIG. 8A with its perspectival view of the application head 130 from above at an angle, the total of four application units 132 are anchored to a carrier frame 134, which is rotatably suspended from a movable arm section 136. Such arm section 136, of which only a vertical part is indicated by interrupted lines in FIG. 8A, can in particular enable the application head 130 to move within a defined movement space, which is not shown in detail here. Thus, the vertical part of the arm section 136 indicated in FIG. 8A can be part of a cantilever arm that is movable within the movement space and that may have joints that enable the arm section 136 to be raised and lowered together with the application head 130 suspended therefrom.

The application head 130 equipped with the four application units 132 can be moved with the aid of the movable cantilever arm or possibly by a gantry suspension (not shown here) or another type of suspension within its movement space between a stockpile or a supply point (not shown here) for the packaging blanks 14 that are flat and normally still unfolded, but provided with the required punch-outs and apertures, and a supply point or a conveyor section with the article groupings 20 held ready there.

The four application units 132 anchored in defined positions and at defined distances from one another in a rectangular arrangement on the carrier frame 134 of the application head 130 require a corresponding arrangement of the four article groupings 20 held ready at the same defined distances from one another and in the same defined alignments, such that the four application units 132 can in each instance be positioned precisely above the suitably-aligned article groupings 20.

On the arm section 136, which can be raised and lowered, the application head 130 with its four application units 132 and together with the packaging blanks 14 respectively received there and held therein can be lowered after being positioned above the article groupings 20 or in a flowing movement after bringing together the article groupings 20 held ready in suitable positions and alignments.

As illustrated in particular by the perspectival detail view of FIG. 8D, which shows one of the application units 132 from below at an angle without a packaging blank 14 held there, the packaging blanks 14 can be received from the stockpile stack or from a therefor suitable and equipped supply point and temporarily held in the respective application unit 132 with the aid of suitable suction elements 138, several of which are located in the application head 130 and which can in each instance be subjected to negative pressure in order to receive the flat packaging blanks 14.

FIGS. 8A through 8D in each instance show two such suction elements 138 formed by suction punches 140 in each of the four application units 132, such that there are a total of eight such suction elements 138 or suction punches 140 in the application head 130. The suction elements 138 or suction punches 140 in each instance have negative pressure lines 142 for, in particular, controllable and/or disconnectable supply with negative pressure, which can be supplied to the negative pressure lines 142 via a central supply line in the arm section 136, which is not shown in more detail here.

Optionally, the suction elements 138 or suction punches 140, each equipped with separate negative pressure lines 142, can be controlled together or individually. To receive and hold the packaging blanks 14 on the lower side in the application head 130, the negative pressure on the suction elements 138 or suction punches 140 can preferably be activated and deactivated for dispensing the packaging blanks 14.

Thus, if the packaging blanks 14 are to be placed on the article groupings 20 after positioning over the article groupings 20 and/or after synchronization with the article groupings 20 conveyed or further conveyed on a horizontal conveying device, for example, and after the application head 130 has been lowered, and are to be pressed on and latched there, forming the primary fixing element 22 (cf. FIGS. 1A through 1F), it is practical and necessary to deactivate the negative pressure applied to the suction elements 138 or suction punches 140, as a result of which the packaging blanks 14 held in each instance by two suction elements 138 or suction punches 140 can be released, and their previously temporarily maintained fixing in the application head 130 can be eliminated.

As can be seen in particular in FIGS. 8C and 8D with their views from below at an angle onto the application units 132, the two suction elements 138 or suction punches 140 of each application unit 132 are located diagonally offset to one another and at practical distances from one another in order to be able to receive a flat packaging blank 14 from a stack with only two such suction elements 138 or suction punches 140 and hold it reliably until it is placed on the article grouping 20 provided for this purpose.

The release of the packaging blanks 14 and their respective latching onto the upper sides of the article groupings 20 provided for this purpose is supported by further components in the application head 130 or in its application units 132. Thus, in the embodiment variant of the application head 130 shown, the formation of the primary fixing element 22 is supported by flat contact plates 144 arranged movably in the application units 132, which can in each instance be lowered perpendicularly to the surface of the packaging blanks 14 resting against them and thus generally in a vertical direction relative to the application units 132, while, at the same time, the negative pressure of the suction elements 138 or suction punches 140 that holds the packaging blank 14 in place in the respective application unit 132 is deactivated.

As can be seen from FIGS. 8A through 8D, the contact plates 144 are dimensioned approximately according to the size and extent of the main surfaces 18 of the packaging blanks 14.

Since the contact plates 144 in each instance have matching circular recesses 146 at the positions of the suction elements 138 or suction punches 140 anchored in a fixed position in the respective application unit 132 (cf. FIGS. 8C and 8D), each of the contact plates 144 together with the packaging blank 14 (cf. FIG. 8B) can be lowered onto the upper side of the respective article grouping 20 and preferably pressed on there (cf. the perspectival side view of FIG. 8B), while the suction elements 138 or suction punches 140 reaching through the corresponding recesses 146 of the contact plate 144 are without negative pressure, such that the packaging blank 14 can be detached from there largely without resistance.

The contact plates 144, which are movable within a defined linear path, can be moved between their end positions, i.e., raised or lowered—in particular, by suitable linear guides and/or linear motors 148—relative to the respective application unit 132 of the application head 130. As illustrated in each of FIGS. 8A through 8D, each of the contact plates 144 that can be raised and lowered can be suspended from two pneumatically-actuatable linear motors 148, wherein the associated linear motors 148 are in each instance located on opposite narrow sides of each contact plate 144. The linear motors 148 can optionally also be formed by electric motors or by otherwise actuatable linear sliders or similar actuators.

Figure 8B:
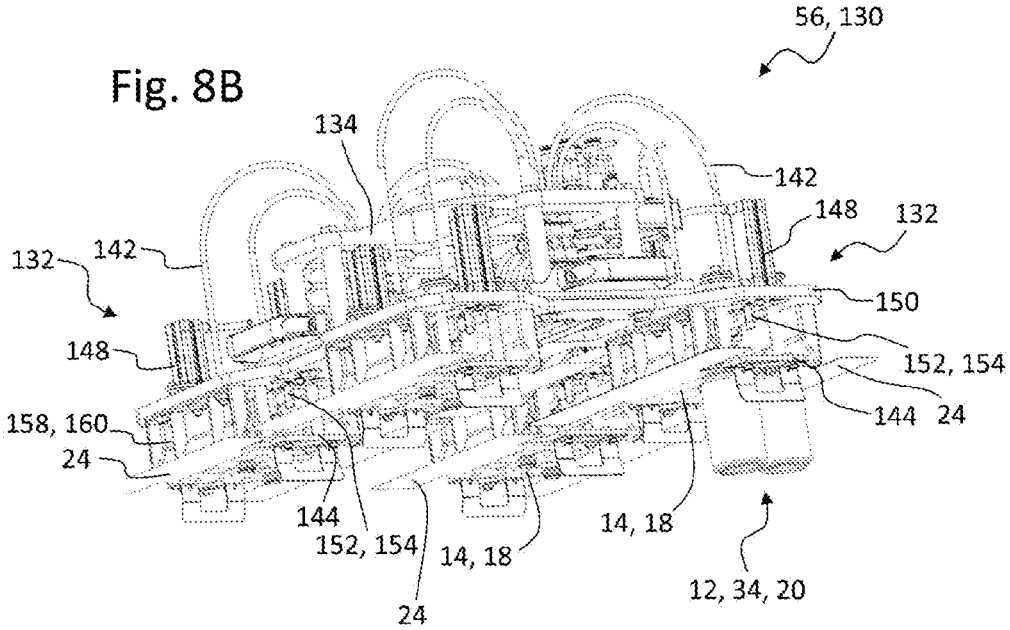

The schematic perspectival view of FIG. 8B shows the process phase of placing the still unfolded packaging blanks 14 on the upper side of the article grouping 20. The negative pressure at the suction elements 138 or suction punches 140 is deactivated, and the contact plate 144 is lowered completely relative to the lower frame section 150 by the linear motors 148 anchored to a lower frame section 150. Such lower frame section 150 forms a supporting element that receives the components of the total of four application units 132 and is firmly anchored to such upper carrier frame 134 in a position spaced apart from the upper carrier frame 134.

As previously explained with reference to FIGS. 1A through 1F, during the further course of the production of the packaging units 10 and by moving the contact plate 144 to its lower stop, the packaging blank 14 is connected or latched to the articles 12 of the article grouping 20, forming the primary fixing element 22. In this context, the main surface 18 of the packaging blank 14, which is placed on the upper side of the article grouping 20 and in particular latched or otherwise fixed there, is deformed in its folding region 46 and pressed in between the adjacent rows of articles, wherein adjacent primary fixing element 22 together with the articles 12 held therein are brought closer to one another—in particular, until the adjacent articles 12 are in touching contact.

FIG. 8B does not show the horizontal distance A previously explained with reference to FIG. 1B, even if this distance A is preferably present between the adjacent rows of articles or cans shown, since such a distance is helpful for forming the folding region 46 by the shaping device arranged in the respective application unit 132 and for forming the packaging blank 14 in the desired and intended manner. This issue is particularly relevant for the slim or sleek cans shown here, which are to be processed into packaging units 10.

After the preferably simultaneous lowering of the total of four contact plates 144 together with the packaging blanks 14 resting on the lower side thereof onto the upper sides of the respective article groupings 20, and after the latching of the articles 12 or cans 34 with the respective associated packaging blank 14, which was defined above as the production of the primary fixing element 22, the articles 12 or rows of articles of the respective grouping 20, which are preferably at least slightly spaced apart from one another in such process phase (distance A; cf. FIG. 1B), can be subjected to the further handling step described below, which provides for the V-shaped reshaping of the folding region 46 in the main surface 18 of the packaging blank 14, as already explained above, along with the bringing together of the rows of articles of the grouping 20 up to their touching contact, such that the usual rectangular arrangement of the grouping 20 is produced, which also corresponds to the arrangement within the packaging units 10 to be completed later.

In the embodiment variant of the handling tool 56 or of the application head 130 shown here, the V-shaped section of the packaging blank 14 already explained above and its pressing in between the previously spaced-apart rows of articles takes place by knife-like or blade-shaped shaping elements 152, arranged in a fixed position in the respective application units 132 of the application head 130, which elements are also to be referred to here according to their function as folding blades 154. When the contact plate 144 is lowered, each of such folding blades 154 lies above the level of the contact plate 144 and is thus concealed by the latter, such that each of the folding blades 154 cannot become effective when the packaging blank 14 is pressed onto the upper side of the article grouping 20 and when the first fixing element 22 are formed at the same time.

FIG. 8B shows such process phase with the shaping elements 152 or folding blades 154, anchored in the lower frame section 150 and projecting perpendicularly downwards, which are clearly spaced apart from the lowered contact plates 144 in each instance.

The process phase immediately following the placement of the packaging blank 14 on the article grouping 20 provides for the lifting of the contact plates 144 after the primary fixing element 22 have been produced and with the suction elements 138 or suction punches 140 practically still deactivated, but this is not illustrated in this form in FIGS. 8A through 8D for application units 132 acting upon the article groupings 20.

Figure 8C:
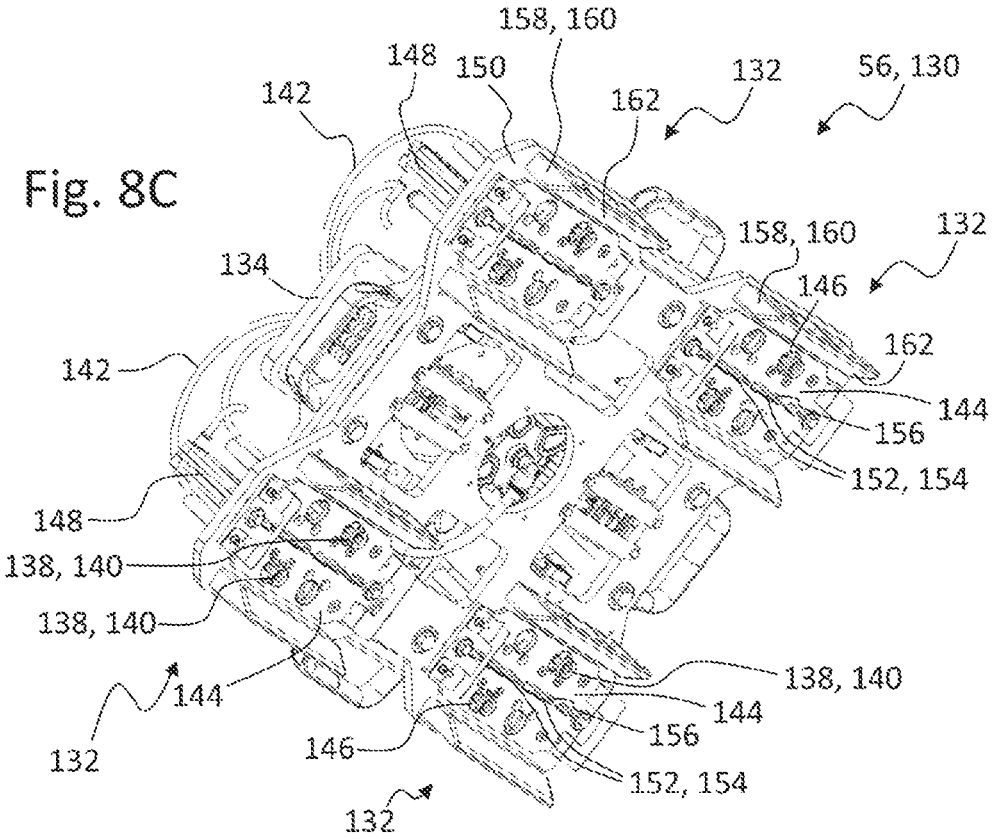
Figure 8D:
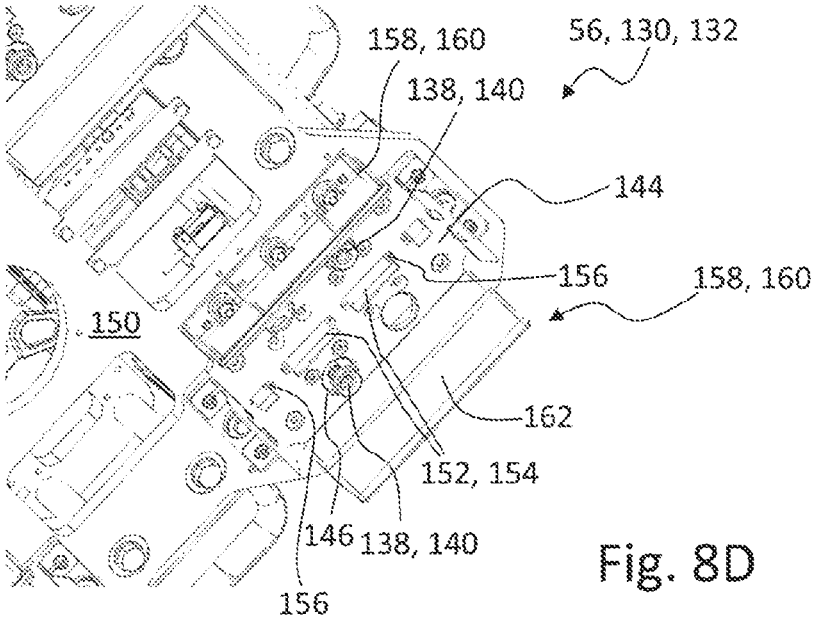

As is recognizable in the perspectival view of FIG. 8C and in the perspectival detail view of FIG. 8D, the knife-like or blade-shaped shaping element 152 formed by the folding blade 154 extends through corresponding slot-like recesses 156 of the contact plate 144 when the contact plate 144 is raised against the lower frame section 150, such that it projects downwards out of the contact plate 144 when the contact plate 144 is raised and can become effective in the desired manner.

With the contact plates 144 raised against the lower frame section 150, the application head 130 can thus be lowered further until the folding blades 154 reach the packaging blanks 14 and press them down in a V-shape between the rows of articles in the respective folding regions 46 in the manner described, wherein the V-shaped deformed folding region 46 of the respective packaging blanks 14 is pressed in between the adjacent rows of articles.

Since the previously spaced-apart articles or rows of articles are drawn together, suitable guides are practical, to allow this bringing together to take place in a controlled manner. In principle, pressing in the V-shaped folding region 46 of the packaging blank 14 and lowering it between the articles 12 or rows of articles is sufficient to bring them closer together and provide that they be pulled or pushed towards one another.

The lowering movement of the entire application head 130 and the resulting synchronous feed movement of the four application units 132, in each instance with contact plates 144 raised to their upper stop against the lower frame section 150, enable the knife-like or blade-shaped shaping elements 152 or folding blades 154 exposed thereby to be pressed into the upper-side main surfaces 18 of the packaging blanks 14 along the respective folding regions 46 located there.

Such lowering movement of the application head 130 is also used to fold the side surfaces 24, which are set off on both longitudinal sides of the main surface 18 of the packaging blank 14 by creases, downwards at folding angles of approximately 90° in each instance, and to place them against the respective shell surfaces 26 of the article grouping 20. In the embodiment variant shown, such folding movements are carried out by lateral folding elements 158 that are fixedly or rigidly anchored in the application head 130 and that become effective and can engage with the packaging blank 14 as soon as the application head 130 is lowered in the direction of the upper side of the article groupings 20.

The folding elements 158 arranged on the lower frame section 150 of the respective application units 132 of the application head 130 on both longitudinal sides of each height-adjustable contact plate 144 and at small distances therefrom are formed by rigid tools or folding tools 160 in the exemplary embodiment shown, which are located in positions of the respective application units 132, where they can meet the side surfaces 24 of the flat packaging blank 14, which are defined by bending or folding edges and delimited in this way from the main surface 18, in order to be able to apply these to the opposite shell surfaces 26 of the article grouping 20. Thus, the folding elements 158 are formed by folding tools 160 that are anchored to the lower frame section 150 and project perpendicularly downwards from the lower side thereof and are designed in the form of strips that, due to their anchoring in the respective application unit 132, are fixed in their unchangeable relative positions with respect to the suction elements 138 and with respect to the contact plates 144 that can be raised and lowered in the application units 132.

A ramp-like bevel 162 on the folding tools 160 can assist in pushing together the previously spaced-apart articles 12 or rows of articles if the knife-like or blade-shaped shaping element 152 is activated. This is the case when the application head 130 is lowered, such that the lower end faces of the folding tools 160 are initially placed on the side faces 24 of the packaging blank 14. As soon as the folding process progresses by further lowering the application head 130, the side surfaces 24 of the packaging blank 18, which are bent downwards by the folding tools 160, slide along the ramp-like bevels 162 on the inner sides, facing the side surfaces 24, of the folding tools 160, until they are completely folded downwards and placed against the shell surfaces 26 of the respective article grouping 20.

On the other hand, the vertical surfaces of the lateral folding elements 158 adjoining the ramp-like bevels 162 at the top have a practical spacing, which corresponds approximately to the width of the two rows of articles of the article grouping 20 pushed together, wherein the previously-existing spacing A between the rows of articles (cf. FIG. 1B) is eliminated.

In a later method step, after the application head 130 has been lifted from the article groupings 20 provided with the packaging blanks 14, these can preferably be subjected to further handling and/or treatment steps, with which further measures can be taken to complete the packaging units 10. Such steps can, in particular, be the further processing of the secondary fixing element 30 by folding the strapping sections 32 and the bonding of overlapping and superimposed strip sections 28 (cf. in this regard FIGS. 1E and 1F and FIG. 10A ff. explained below).

Figure 8E:
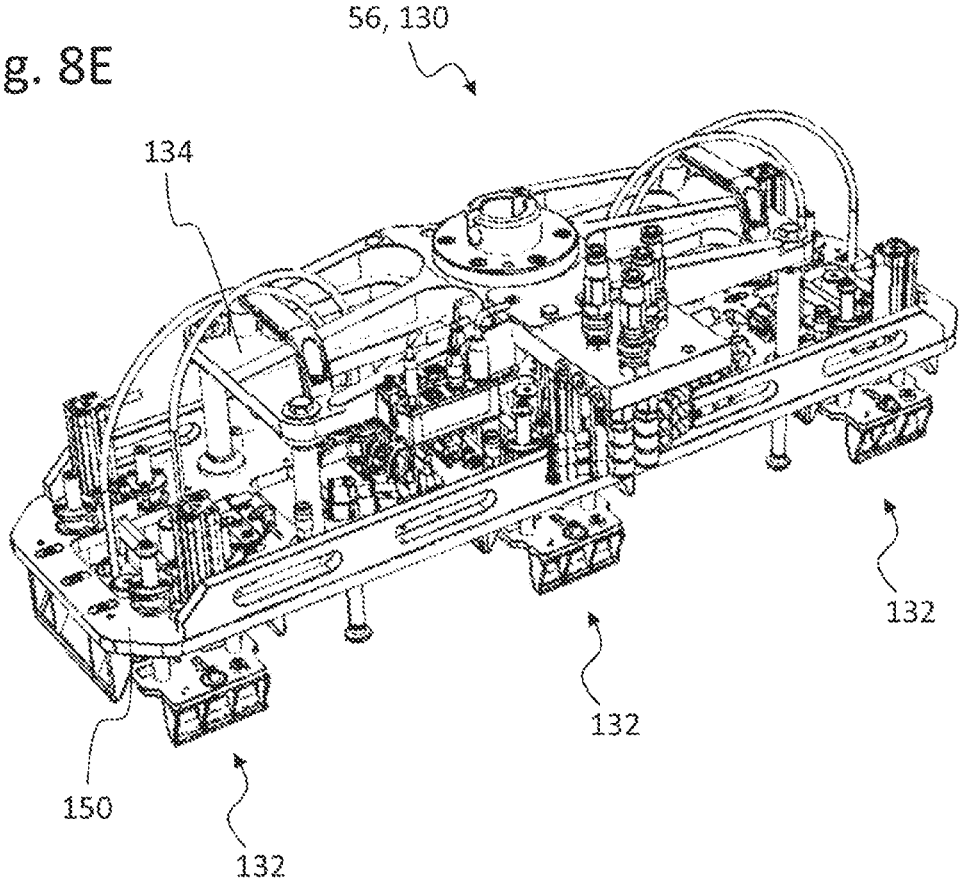
FIG. 8E shows a perspectival view of a further embodiment variant of the application head according to the invention, which is equipped with three application units for equipping a total of three article groupings with packaging blanks.

The perspectival view of FIG. 8E shows a further embodiment variant of the application head 130 according to the invention, which is equipped here with three application units 132 arranged next to one another and spaced apart from one another for equipping a total of three article groupings 20 with packaging blanks 14.

The carrier frame 134, which is rotatably held on a vertical arm section 136 (cf. in this regard FIG. 8A), along with the frame section 150 anchored on the lower side of the carrier frame 134 for receiving the three application units 132, is modified relative to the previously-shown variant (FIGS. 8A through 8D), such that the three application units 132 are arranged in a row next to one another. The remaining structure and the mode of operation of the application units 132 preferably do not differ from the previously-explained variant with the four application units 132 grouped in a rectangular arrangement in the application head 130.

Such an application head 130, as shown in FIG. 8E, is suitable for processing three article groupings 20 conveyed next to one another or for simultaneously processing three article groupings 20 conveyed one behind the other.

Figure 9:
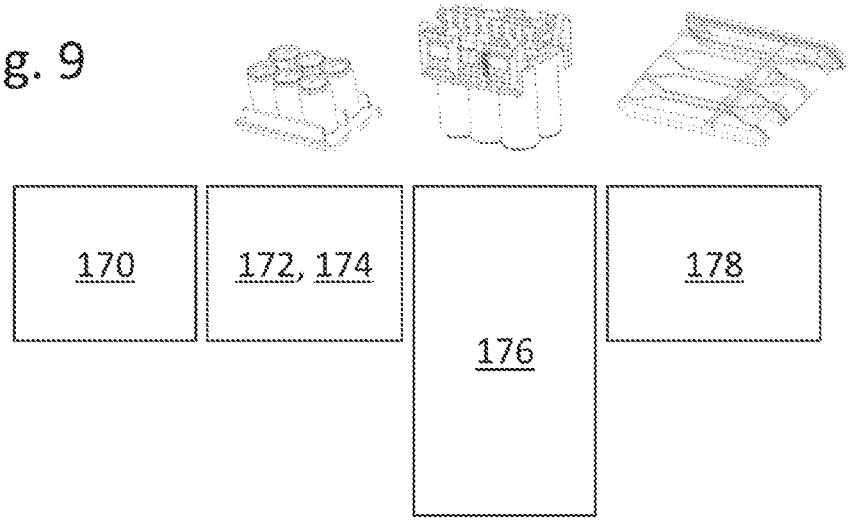
FIG. 9 shows a schematic block diagram to illustrate the method steps involved in the formation of the packaging units.

The schematic flowchart in FIG. 9 is intended to illustrate successive method steps in the production of packaging units 10, which are formed from several articles 12 such as, in particular, beverage cans 34. These are initially transferred in a dividing module 170 from a mass flow into a multi-row transport flow, as shown in some further detail in FIGS. 14A through 14C. The further transport of the articles or beverage cans 34 can in particular be aisle-guided, which is to be indicated here in general by an aisle guide 172. Preferably, grouping also takes place in such aisle guide 172, such that a grouping module 174 can also be assigned to the aisle guide 172.

Within the grouping module 174, provision can be made in particular for the formation of the 3×2 rectangular arrangement of the article groupings 20 according to the previously-shown exemplary embodiment (cf. FIGS. 1A through 1F) and for the spacing and arrangement of four such article groupings 20 corresponding to the dimensions and positioning of the application units 132 in the application head 130 (cf. FIGS. 8A through 8D).

In a subsequent application module 176, the packaging blanks 14 are applied in the manner described above, which means that the primary fixing element 22 are produced by placing the packaging blank 14 and latching or otherwise connecting them to the articles 12 or beverage cans 34 of the respective article grouping 20.

In a separate further step, the band sections can be connected to one another and reshaped into strapping sections 32, which means producing the secondary fixing element 30 by folding over, pretensioning, and fixing the overlapping strip sections 28 and forming them into the strapping sections 32 (cf. FIG. 1E and FIG. 1F). Such reshaping can take place in particular in a strapping module 178, as it is referred to here, which can be equipped, for example, with a folding tool 114 according to FIG. 7, with a folding element 158 or folding tool 160 (cf. FIGS. 8A through 8E), or with another tool or handling combination.

FIG. 10A shows a perspectival and schematic view from above at an angle of two, successively-conveyed article groupings 20, on the upper side of which a packaging blank 14 has been placed in each instance, as already shown in a detailed representation in FIG. 1C. The main surfaces 18 of the packaging blanks 14 thus in each instance cover the upper sides of the articles 12 or cans 34 forming the article grouping 20, while the side surfaces 24 adjoining the opposite longitudinal sides of the main surface 18 on both sides and set off there by bent edges, together with the extensions continuing on their respective narrow sides to form strip sections 28, are already folded down laterally in the direction of the side surfaces of the article groupings 20, but have not yet been completely applied to the side surfaces of the article groupings 20.

Such complete lateral application of the side surfaces 24 and the strip sections 28 is to take place only in subsequent process steps using a further embodiment variant of a handling tool 56 according to the invention, which is formed here by a strapping head 180. Such strapping head 180 essentially serves to produce the secondary fixing element 30, formed by the overlapping regions connected to one another of the strip sections 28, which are reshaped into the strapping sections 32 using and by supporting use of the strapping heads 180. Such handling steps are explained below with reference to the following FIGS. 10B through 13B.

In a modification to the representation according to FIGS. 1C and 1D, the strip sections 28 adjoining the narrow sides of the side faces 24 are in each instance shorter on one of the side faces 24 and longer on the other, while this is reversed in the case of the packaging blank 14 of a subsequent or adjacent article grouping 20. The packaging blank 14, which has been placed on the article grouping 20 located on the left in FIG. 10A, has a partially folded-down side surface 24 in the foreground with two shorter strip sections 28-*k* on its opposite narrow sides, while the opposite side surface 24, which is located in the background, has two longer strip sections 28-*l* on its opposite narrow sides.

In contrast, the packaging blank 14, which has been placed on the article grouping 20 located on the right in FIG. 10A, has a partially folded-down side surface 24 in the foreground with two longer strip sections 28-*l* on its opposite narrow sides, while the opposite side surface 24 of this packaging blank 14, which is located in the background, has two shorter strip sections 28-*k* on its opposite narrow sides. In this way, shorter strip sections 28-*k* are aligned with longer strip sections 28-*l* when article groupings 20 are transported in succession, such that they do not collide or touch one another when article groupings 20 are transported in close succession.

FIG. 10B, in a perspectival and schematic view from below at an angle of four, successively-conveyed article groupings 20, on the upper side of which a packaging blank 14 has been placed in each instance, shows how the article groupings 20 conveyed one behind the other and at a distance from one another in the transport direction TR successively reach the manipulation region of the strapping heads 180 suspended above the conveyed article groupings 20. While the packaging blanks 14 can be placed on the upper sides of the article groupings 20, forming the primary fixing element 22 (cf. FIGS. 1C through 1F), by handling tools 56 or application heads 130 (cf. in this regard FIGS. 8A through 8E), which are not shown here in greater detail, the secondary fixing element 30, as described above and illustrated with reference to FIGS. 1E and 1F, can be formed and completed by the strapping heads 180 schematically indicated in FIG. 10B.

The strapping heads 180 are in each instance arranged in regions above a conveying level for the article groupings 20 conveyed one behind the other in the conveying direction TR with the primary fixing element 22, which are in each instance placed on the upper side and preferably already produced or formed, such that they can in each instance access the article groupings 20 from above. Such access to the two article groupings 20 conveyed in front is schematically indicated in FIG. 10B, wherein a strapping head 180 has already been completely placed on the right article grouping 20, i.e., on the article grouping 20 conveyed in front in the transport direction TR, while a further strapping head 180 has not yet completely grasped the article grouping 20 adjoining it and enclosed it on the upper side; rather, in the representation of FIG. 10B, it is in the process of being placed there and grasping the article grouping 20.

Even if this is not yet recognizable by FIG. 10B, a plurality of the strapping heads 180 can be guided endlessly in a circulating movement in a direction of circulation UR (cf. in this regard FIG. 12), such that each of the many strapping heads 180 can in each instance accompany exactly one article grouping 20 over a limited section of the respective transport section 230 (cf. in this regard FIGS. 14A through 14C) and can act upon such article grouping 20 in such a way as to form the secondary fixing element 30, as will be described below.

In the exemplary embodiment shown in FIG. 10B, three strapping heads 180 are in each instance suspended at lateral distances from one another on a cross member 182 circulating in the direction of circulation UR, wherein several cross members 182, in each instance with three strapping heads 180 suspended thereon at distances from one another that correspond in each instance to the distances between the article groupings 20 conveyed one behind the other, are moved successively in the direction of circulation UR parallel to the transport direction TR. Of course, the direction of circulation UR runs transversely to the longitudinal extension direction of the cross members 182.

Of the three parallel rows of article groupings 20 conveyed next to one another by the three parallel strapping heads 180 on each of the cross members 182 in each instance, FIG. 10B shows, for the sake of clarity, only a section of a row with four article groupings 20 conveyed one behind the other.

Suspensions 184 with rollers 186 are located at both end-face ends of the cross members 182, such that the suspensions 184 with the cross members 182 rigidly fastened thereto circulate endlessly in rail systems provided for this purpose, and the strapping heads 180 can be guided at suitable distances above the conveyor level for the article groupings 20, at least over the aforementioned limited section of the respective transport section 230, in order to bring the strapping heads 180 into engagement with the article groupings 20 in each instance.

Figure 12:
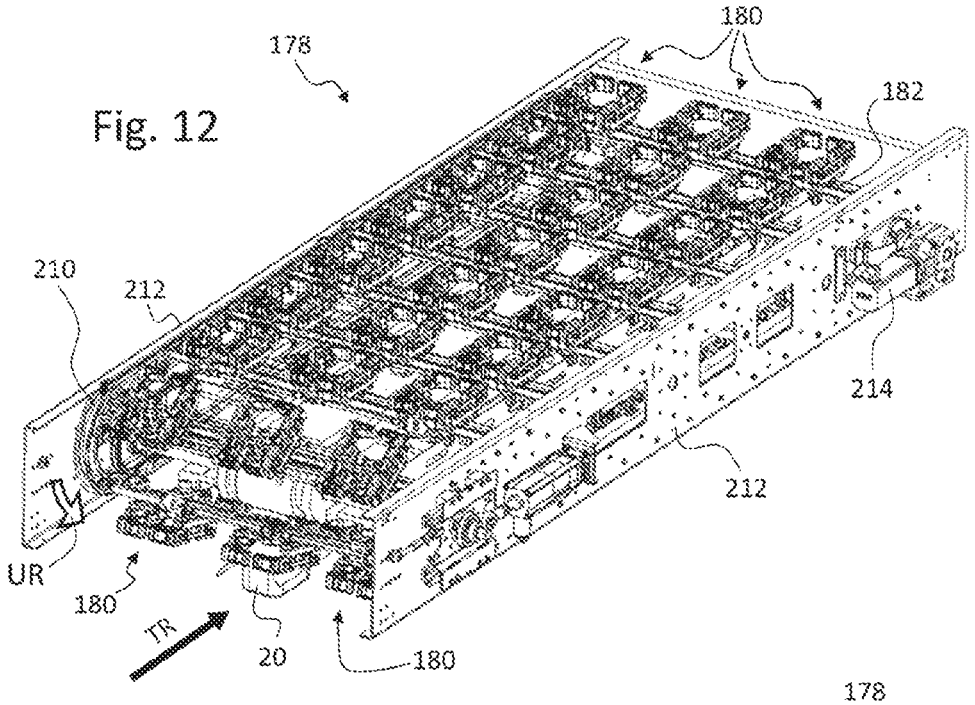
FIG. 12 shows an embodiment variant of a strapping module with several circumferentially-guided strapping heads in a schematic and perspectival representation.
Figure 13A:
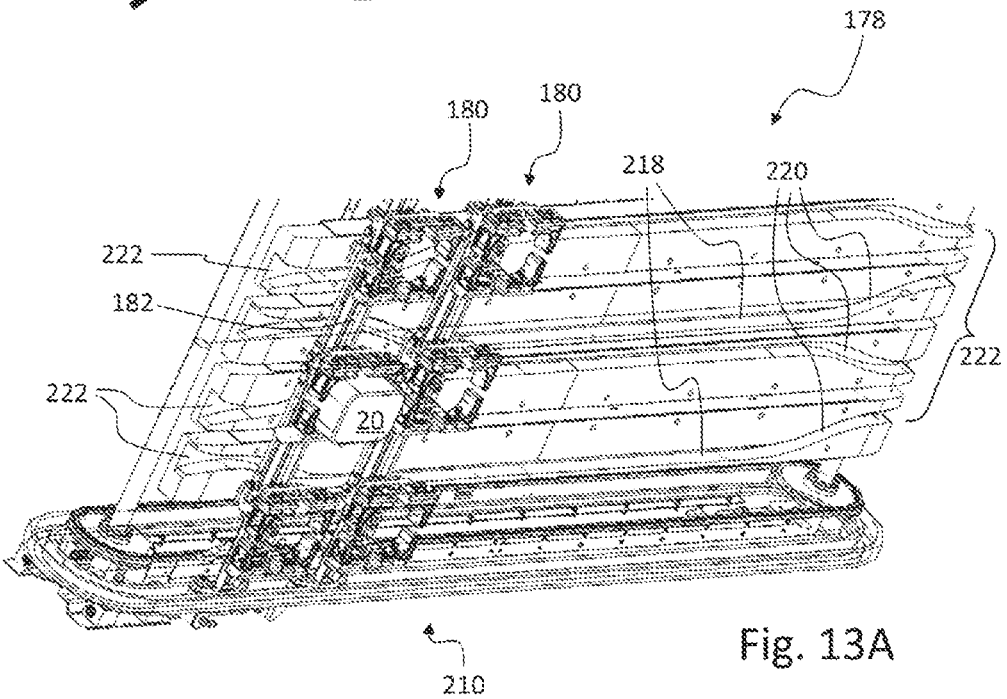
FIGS. 13A and 13B show schematic and perspectival views of configurations for controlling the strapping heads that can be used in the formation of the packaging units.
Figure 13B:
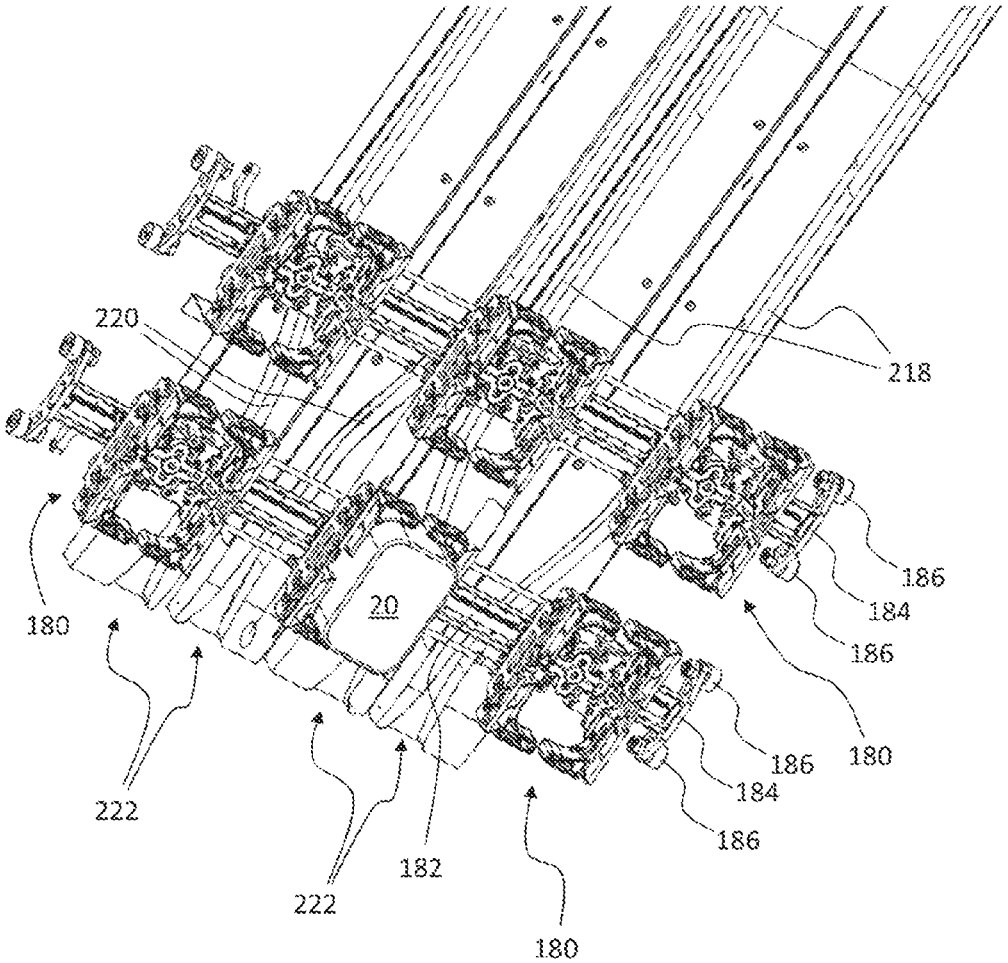

The aforementioned rail system for guiding the rollers 186 rotatably mounted in the suspensions 184 is not shown in FIG. 10B, but can be seen more clearly in FIGS. 12, 13A, and 13B. The alignment and course of the rail system and thus the movement of the endlessly circulating cross members 182 together with the strapping heads 180 suspended from them can also be clearly seen there.

Figure 10C:
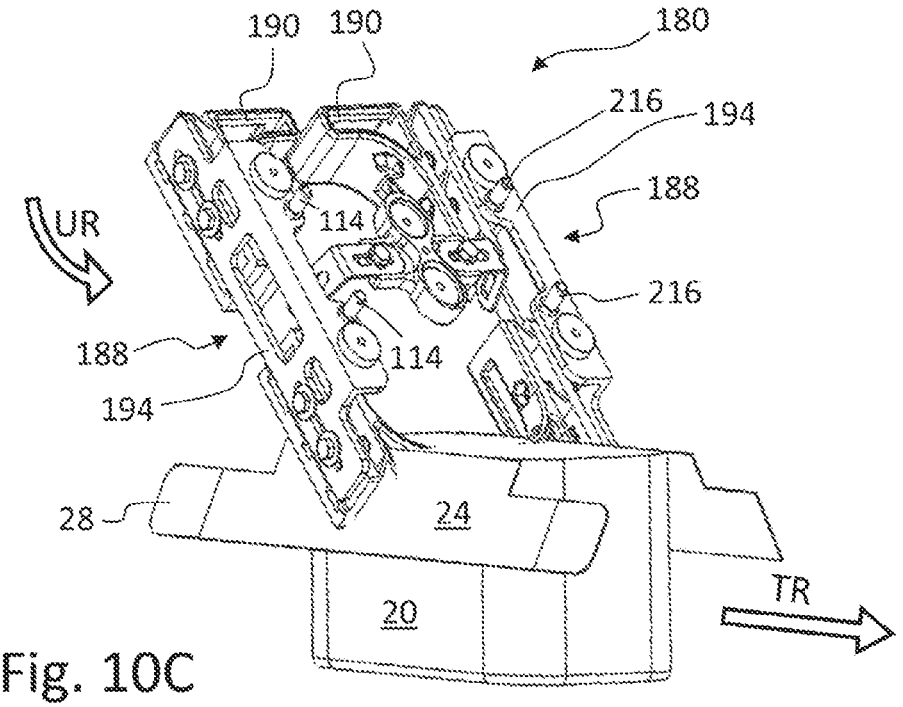
FIG. 10C shows a single article grouping with a packaging blank placed on it and a strapping head accessing it in a schematic and perspectival representation.

FIG. 10C shows the most important components of the strapping head 180 in a schematic and perspectival representation along with their interaction with an article grouping 20, which is equipped on the upper side with a packaging blank 14, the main surface 18 of which rests on the upper sides or upper end faces 16 of the articles 12 or beverage cans 34 forming the article grouping 20 and is latched there—preferably forming the primary fixing element 22. The side surfaces 24, which are attached to the opposite longitudinal sides of the main surface 18 of the packaging blank 14 and are set off there from the main surface 18 by bent edges, are already pivoted downwards by approximately 45° . . . 60° in each instance, but, in the representation of FIG. 10C, are not yet in contact with the respective shell surfaces 26 of the articles 12 or beverage cans 34 forming the article grouping 20.

In the representation of FIG. 10C, the strapping head 180 is in an angular position comparable to the still-inclined strapping head 180 according to FIG. 10B, which is located there shortly before being placed on the second article grouping 20 from the right, which corresponds to a position of the cross member 182 with the strapping head 180 held thereon at the exit of the deflection of the rail system guiding the cross member 182 (cf. FIGS. 12, 13A, and 13B). Since the rail system describes 180° deflections in each instance in front of and behind the section running straight and parallel to the transport direction TR, within which the strapping heads 180 are located precisely above the respective article groupings 20, the strapping heads 180 in the deflection sections dip obliquely and increasingly flatly from above onto the upper sides of the article groupings 20 and also lift off again at the other 180° deflection at an initially flat and then steeper angle.

The perspectival view of FIG. 10C illustrates the phase of the gradual lowering of the strapping head 180 shown onto the upper side of the article grouping 20 assigned to it, wherein the direction of circulation UR of the strapping head 180 in such section follows the outgoing deflection of the rail system (not shown here). The strapping head 180 is still inclined by approximately 45°, which means that a tangent to the direction of movement of the strapping head 180 corresponding to the direction of circulation UR forms this angle of approximately 45° with the transport direction TR.

To form the first fixing element 22 shown in FIGS. 1C through 1F, which effect the latching of the packaging blank 14 with upper regions of the article grouping 20, first handling elements designated as such, but not shown in the drawings, can be used here. Such first handling elements can be formed, for example, by correspondingly-equipped handling tools 56 (cf. in this regard FIGS. 2A through 6) or by correspondingly-equipped application heads 130 (cf. in this regard FIGS. 8A through 8E), in each instance with suitable devices for holding and/or receiving packaging blanks 14, for applying the packaging blanks 14 to the article groupings 20 and possibly for V-shaped folding of the packaging blank 14 in the folding region 46, which is provided in the main surface 18 of the packaging blank 14.

Furthermore, such first handling elements can preferably have devices suitable for this purpose for folding the side surfaces 24 to both sides of the main surface 18 of the packaging blank 14, as a result of which the article groupings 20 are prepared in the manner shown in FIGS. 10A, 10B, and 10C, in order to place the side surfaces 24 folded over in this way completely on the shell sides of the article groupings 20 and to reshape the strip sections 28 into strapping sections 32, as a result of which the secondary fixing element 30 can be formed.

According to a terminology and system selected in this way, the strapping head 180 shown comprises further or second handling elements 188 that can be fed towards one another and that serve to apply the foldable side surfaces 24 of the packaging blank 14 that are adjacent to the longitudinal sides of the main surface 18 of the packaging blank 14 and project laterally beyond the upper side of the article grouping 20, and to prepare and form the secondary fixing element 30 interacting with shell surfaces of the articles 12. As already illustrated in FIGS. 1E and 1F, such secondary fixing element 30 are formed by strapping sections 32, which are formed from the overlapping strip sections 28, extending the side surfaces 24 and joined together and connected to one another by suitable adhesion points such as, for example, bondings 54—preferably with the application of a defined pretensioning.

The handling elements 188, which engage the two longitudinal sides of the article grouping 20 at the level of the folded-over side surfaces 24 in contact with the shell surfaces 26 of the articles 12, and which can be fed towards one another, are shaped in such a way that their inner sides, which are in contact with the side surfaces 24 and strip sections 28, are in contact with the shell surfaces 26 of the articles 12 and can be pressed on there, wherein elastically-deformable molded parts 190 are provided for pressing on and establishing adhesive connections between the respective overlapping strip sections 28 to form the strapping sections 32. To ensure that the strip sections 28 adhere to one another after they have been joined together, as a result of which the strapping sections 32 produced remain permanently connected, suitable adhesion points or bondings 54 are to be applied to at least one of the respective overlapping strip sections 28 in each instance, as has already been explained above.

The design of the handling elements 188 along with the contours and the deformation behavior of the elastically-deformable molded parts 190 arranged there, the feed movements of the handling elements 188, and the mode of operation of the strapping head 180 during its interaction with an article grouping 20 are explained in detail below with reference to FIGS. 11A, 11B, 11C, and 11D.

Figure 11A:
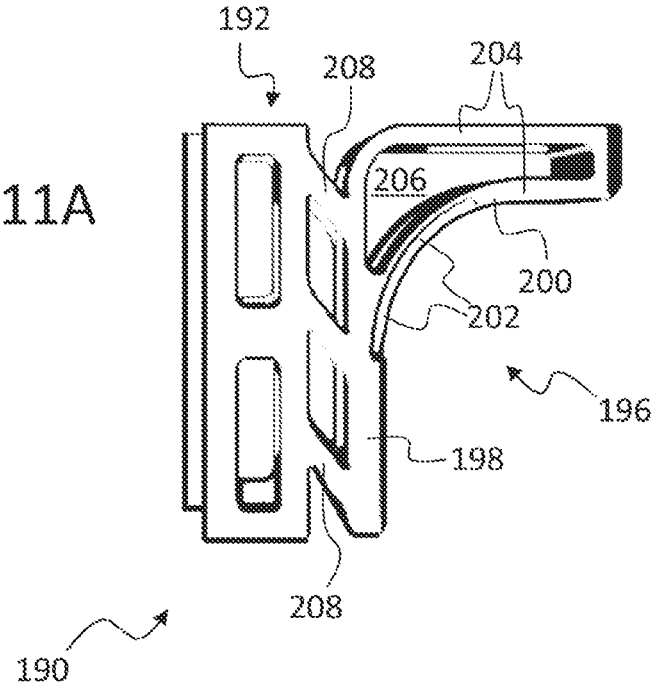
FIG. 11A shows a schematic top view of an embodiment variant of an elastic molded part, which can be a component of a handling tool of a strapping head equipped with it.

For example, FIG. 11A illustrates a top view of a possible design of one of the total of four elastically-deformable molded parts 190, with which each of the strapping heads 180 is equipped. The molded part 190 has a base section 192 with which it can be anchored in a holder 194 of the associated handling element 188. The perspectival view of FIG. 10C shows the two holders 194 of the handling element 188, which can be fed towards one another and in each of which two such molded parts 190 are anchored.

A tool section 196 is also connected to the base section 192, which tool section serves to act upon the article groupings 20 and to interact in such a way that the strapping sections 32 can be formed in the desired manner from the superimposed strip sections 28 of the side surfaces 24.

In the top view shown in FIG. 11A, the tool section 196 of the molded part 190 has an L-shaped contour with a rounded transition between the two legs 198 and 200 of the L-shaped tool section 196, wherein the rounded region, which is to be referred to below as the shaping region turned towards the strip sections 28 of the packaging blank 14 and the article grouping 20 covered thereby, as shaping element 202, or as elastic shaping element 202, corresponds practically to the contour of the article grouping 20 to be processed in its respective corner region. That is, the curvature radius of the shaping element 202 of the tool section 196 corresponds approximately to the outer diameter of one of the articles 12 or one of the beverage cans 34 from which the article grouping 20 is formed.

The body of the tool section 196 resembles a hollow body in sections, since at least the second leg 200 not turned towards the base section 192 is not made of solid material, but is formed by a box-shaped body 204 with open end faces, which, in conjunction with a practical material selection as an elastic plastic material, gives the entire tool section 196 of the molded part 190 a deformability transverse to the outer walls of the body 204. The outer walls of the body 204 forming the second leg 200 of the tool section 196 are preferably of a height sufficient to make the body 204 torsionally rigid and allow it to deform substantially only transversely to the outer walls. The thickness or strength of the strip-like outer walls is preferably significantly less than the height of the strips, which gives the body 204 the desired torsional rigidity.

As FIG. 11A clearly shows, the strip-like outer walls of the body 204 of the second leg 200 enclose an elongated cavity 206, which becomes slightly wider in the direction towards the first leg 198, while it becomes narrower in the direction towards the free end of the second leg 200. This free end of the second leg 200 is at the greatest distance of the tool section 196 from the base section 192.

The connection of the tool section 196 to the base section 192 is not formed by solid material, but by several connecting strips 208, which can preferably in each instance be of the same height as the body 204 of the tool section 196, but which are shaped as relatively thin-walled strips 208 relative to their height.

Figure 11B:
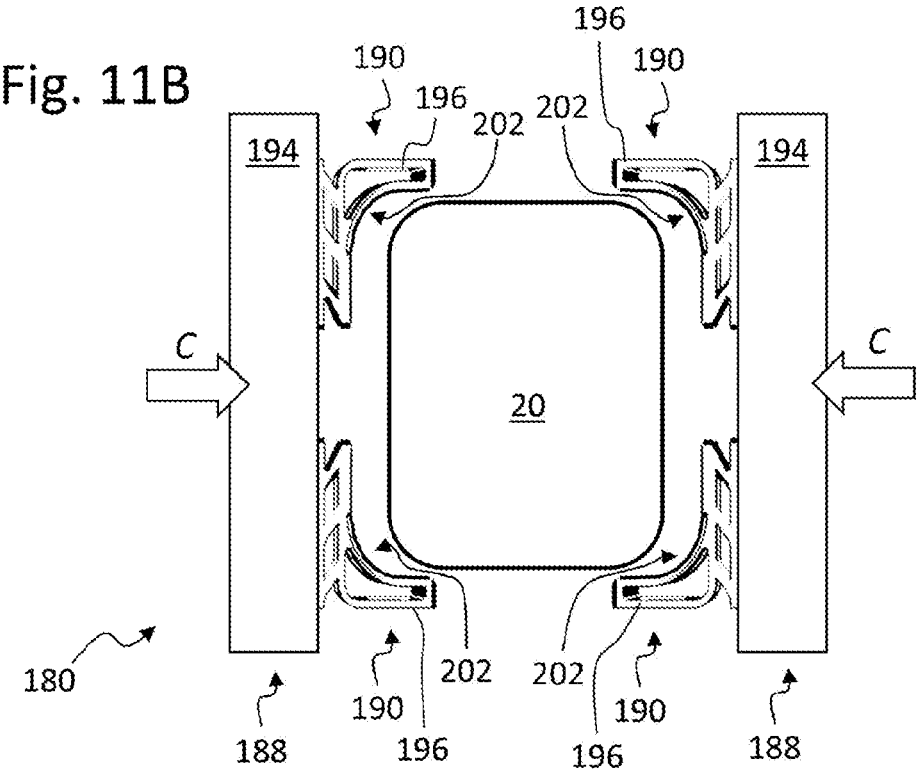
FIGS. 11B and 11C show schematic top views of the mode of handling and operation of a strapping head equipped with several molded parts according to FIG. 11A.
Figure 11C:
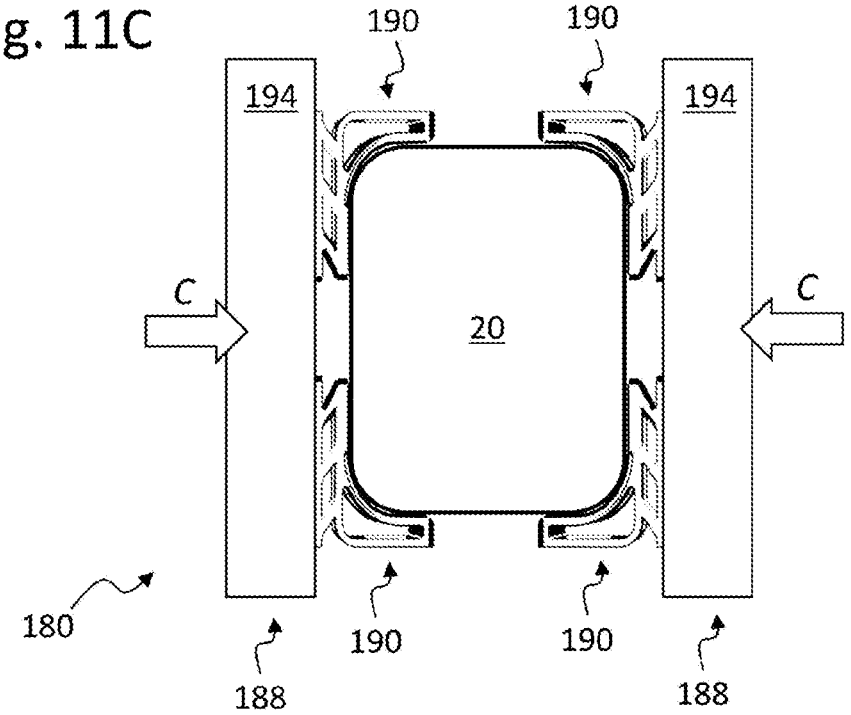

The alignment of the two, three, or four respective spaced-apart connecting strips 208 connecting the first leg 198 of the tool section 196 to the base section 192 provides a defined deformation behavior if the tool section 196 is pressed against the longitudinal side of the article assembly 20 in a direction perpendicular to the surface of the first leg 198 connected to the base section 192 (cf. in this regard FIGS. 11B and 11C).

As FIG. 11A also shows, three parallel and spaced-apart connecting strips 208 are arranged between the base section 192 and the first leg 198, each of which is in an inclined alignment of approximately 45° relative to the longitudinal extension directions of the base section 192 and the first leg 198, respectively.

The material selection of the preferably integrally-formed and produced molded part 190, which can be formed in particular by an elastically-deformable thermoplastic material or by a suitable elastomer material—possibly equipped with incorporated fiber reinforcement—provides the desired deformability when the strapping head 180 is used, if the two holders 194 of the second handling elements 188 with the molded parts 190 fastened therein are moved towards one another and in this way form the strapping sections 32.

Since, according to the perspectival view of FIG. 10C and the schematic plan views of FIGS. 11B and 11C, two such molded parts 190 are in each instance arranged with their respective base sections 192 in the two holders 194 of the handling elements 188, wherein the tool sections 196 of the molded parts 190 with their concavely-rounded shaping elements 202 point towards the corner regions of the respective article grouping 20 to be handled, and since the two holders 194 of the handling elements 188 can be fed towards one another in a feed direction C perpendicularly to the longitudinal extension directions of the holders 194 (cf. FIG. 11B), as a result of which their altogether four shaped parts 190 act upon the corner regions of the article grouping 20, the side surfaces 24 can be pressed against the longitudinal sides of the article grouping 20 and the strip sections 28 against the narrow sides of the article grouping 20 in such a way that the strapping sections 32 can thus be produced (cf. in this regard FIGS. 1E and 1F).

The pure feed movement in the feed direction C (FIG. 11B) of the two holders 194 of the handling elements 188, which are placed against the longitudinal sides of the article grouping 20, does not yet deform the molded parts 190; rather, they initially only rest with their shaping elements 202 against the article grouping 20 and against the already partially folded-down side surfaces 24 and the strip sections 28, as schematically indicated by FIG. 11C. An even further feed movement in the feed direction C, in which the molded parts 190 begin to deform structurally, is illustrated based upon only one such molded part 190 (FIG. 11D), wherein the deformation directions and the deformation behavior of the individual elements of the molded part 190 are illustrated.

By laterally pressing the two holders 194 of the handling elements 188 against the longitudinal sides of the article grouping 20, the molded parts 190 (cf. FIG. 11C), which initially rest against the article grouping 20 only with their rounded shaping elements 202, are in each instance deformed in themselves, as a result of which their second legs 200 of their respective mold sections 196, which are in contact with the narrow sides of the article grouping 20, are drawn towards the narrow sides of the article grouping 20 and pressed more strongly there, as a result of which, at the same time, the strip sections 28 pressed on in this way, which are provided in overlapping regions with the adhesion points 54 of hot glue, cold glue, or a self-adhesive substance, are also pressed on more strongly, which can provide at least slight pretensioning of the strapping sections 32 formed in this way after the handling elements 188 have been released.

Since the handling elements 188 preferably continue to be fed towards one another during a longer transport section (cf. in this regard FIG. 12 and FIGS. 13A and 13B) and thus the molded parts 190 also remain in their elastically-deformed, modified contour pressing against the side surfaces of the article groupings 20, the adhesion points 54 can harden and provide a permanent pretensioning of the secondary fixing points 30 formed by the strapping sections 32 (cf. FIGS. 1E and 1F).

Figure 11D:
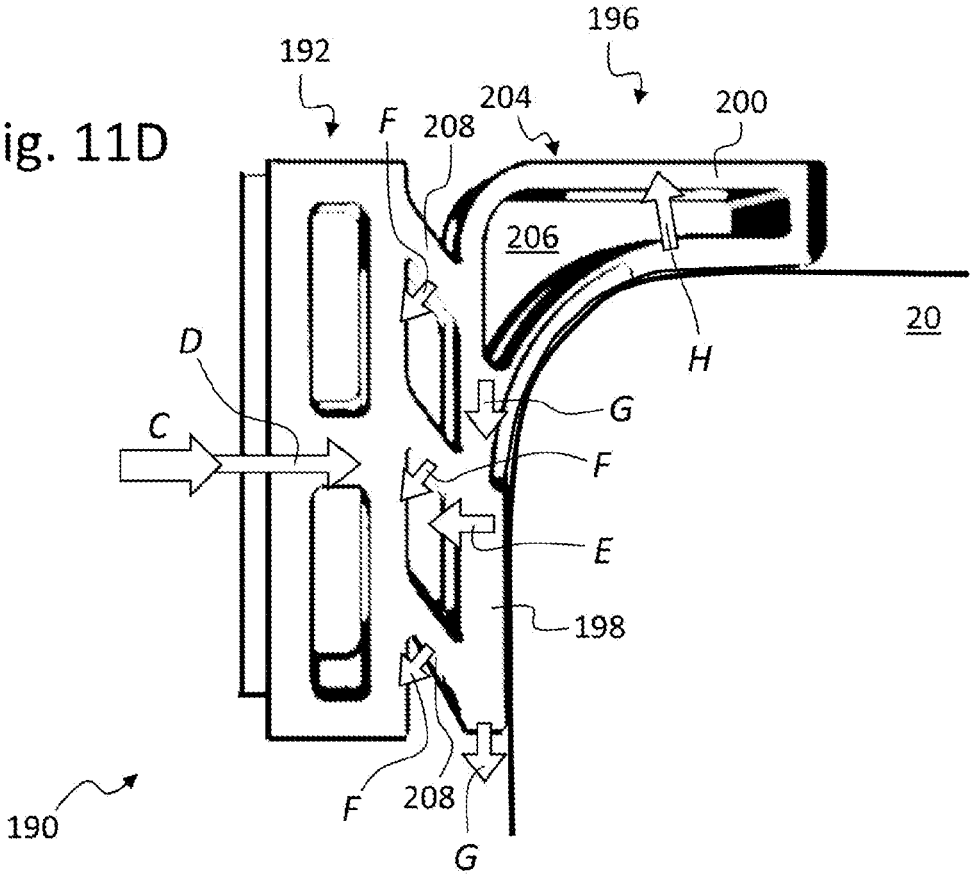
FIG. 11D shows the deformation behavior of a molded part according to FIG. 11A when used within a strapping head.

The detail view of FIG. 11D illustrates the structural deformations of the various regions of the molded part 190 if it has been pressed against the article grouping 20 in the feed direction C and if an additional actuating force D is also applied, which acts in the feed direction C. As a result, the first leg 198, which is connected to the base section 192 via the strip sections 208, is pressed back in the opposite direction to the actuating force D, since the side walls of the article grouping 20 hardly deviate or yield to the actuating force D, or do so only minimally. Such return or deviating movement of the first leg 198 in the opposite direction to the actuating force D towards the base section 192 is indicated by the arrow E in FIG. 11D.

Triggered by the deviating movement E, the strip sections 208 deform, such that the first leg 198 approaches the base section 192. The parallel pivot movements of the strip sections 208 in the direction of arrow F are also illustrated in FIG. 3D by arrows F pointing diagonally downwards from the strip sections 208 to the base section 192. Since such respective pivot movements F of the strip sections 208 simultaneously lead to a parallel displacement of the first leg 198 and thus of the entire tool section 196 transverse to the feed movement C or to the direction of the actuating force D, which is indicated by the arrows G attached to the first leg 198, which illustrate the direction of displacement G, the second leg 200 of the L-shaped tool section 196 is not only pulled more strongly towards the article grouping 20 at the same time, but its body 204 is also deformed.

Thus, the transverse displacement G of the first leg 198 and thus of the entire tool section 196 causes the second leg 200 to yield approximately in the opposite direction H to the transverse displacement G, which also leads to compression of the body 204 while reducing the width and volume of the cavity 206. The superimposed deviating and deformation movement of the second leg 200 and the body 204 is indicated by the arrow H. In particular, this deviating and deformation movement H of the second leg 200 and the body 204, which is maintained for a certain period of time, provides that the adhesive or bonding points 54 be pressed against the overlapping regions of the strip sections 28, such that a defined pretensioning can be imposed on the strapping sections 32 of the secondary fixing points 30 formed in this way.

For the practical interaction of the successively-arranged modules 170 through 178, reference is once again made to FIG. 9, which schematically shows the aisle guide 172 following the dividing module 170 and the grouping module 174 and application module 176, after which the strapping module 178 can ultimately follow.

A part of such a strapping module 178 is schematically illustrated by the perspectival representation of FIG. 12. Such strapping module 178 shown here has a larger number of endlessly circulating cross members 182 that, with their lateral suspensions 184 and rollers 186 mounted thereon (cf. FIG. 10B), can be guided on both sides in rail systems 210, in order to circulate there in the direction of circulation UR and interact with the article groupings 20 conveyed in the transport direction TR in the manner described, in order to reshape these into packaging units 10.

As already exemplified in FIG. 10B, with the embodiment variant shown in FIG. 12, three strapping heads 180 are also suspended at lateral distances from each of the cross members 182 guided one behind the other on the rail system 210 in the direction of circulation UR, wherein the several cross members 182, in each instance with three strapping heads 180 suspended therefrom, are moved successively in the direction of circulation UR at distances from one another that correspond in each instance to the distances between the article groupings 20 conveyed one behind the other. The direction of circulation UR runs parallel to the transport direction TR in the lower section of the rail system 210, in which the strapping heads 180 engage with the article groupings 20. The return movement of the cross members 182 with the respective strapping heads 180 suspended from them takes place in the upper section of the rail system 210 shown in FIG. 12.

The two circulating rails of the rail system 210 can, for example, be arranged and suspended in sheet metal holders 212, as is also shown in FIG. 12. The electric drive motors 214 can also be fastened there, which can provide for the drive of the cross members 182 in the direction of circulation UR along the rail system 210.

The schematic perspectival representations of FIGS. 13A and 13B illustrate the slot guides for controlling the feed movements C for the holders 194, which can be fed towards one another, of the second handling elements 188 with the molded parts 190 fastened thereto (cf. FIGS. 11B and 11C). The suspension of the holders 194, which can be fed towards and moved away from one another, in the strapping head 180 has already been illustrated in FIG. 10C, such that reference can also be made again to this representation in FIG. 10C in the following explanation.

Thus, two guide pins 216 are recognizable on the respective upper sides of the holders 194, which pins are spaced apart from one another and are aligned with one another in the longitudinal extension direction of the holder 194. Such guide pins 216 are preferably guided in guide slots 218, which are located above the article groupings 20 conveyed along the transport plane for the article groupings conveyed in the transport direction TR, such that the cross members 182 moving in the lower section of the rail guide 210 in the direction of circulation UR (in a direction coinciding with the transport direction TR) with the strapping heads 180 arranged thereon come into contact with the guide slots 218.

This means that the guide pins 216 move within the guide slots 218 and are guided there in a sliding manner. The control configuration shown in FIGS. 13A and 13B is assigned to the strapping module 178 (cf. FIG. 9) or is part of the strapping module 178. As can be seen in FIG. 10C, the holders 194 can be fed towards one another or moved away from one another, i.e., they can be moved over defined adjustment paths parallel to the longitudinal extension direction of the respective cross member 182, while they are in each instance moved in the rail system 210.

The guide pins 216 are controlled by the guide slots 218, which in each instance comprise straight and parallel sections, in which the guide pins 216 are spaced closer together, and other straight and parallel sections, in which the guide pins 216 are spaced further apart. Such parallel sections are connected by symmetrically converging or diverging curved sections 220, which provide the respective actuating movements of the holders 194.

The actuating movements required for folding over the strip sections 28 of the packaging blanks 14 and for forming the strapping sections 32 can be generated within the strapping heads 180 with the circulation of the cross members 182 and the guide pins 216 guided by them in the correspondingly-contoured guide slots 218.

The guide pins 216 dip into the mouth regions 222 at the respective ends of the guide slots 218 or run out of the guide slots 218 again.

Figure 14A:
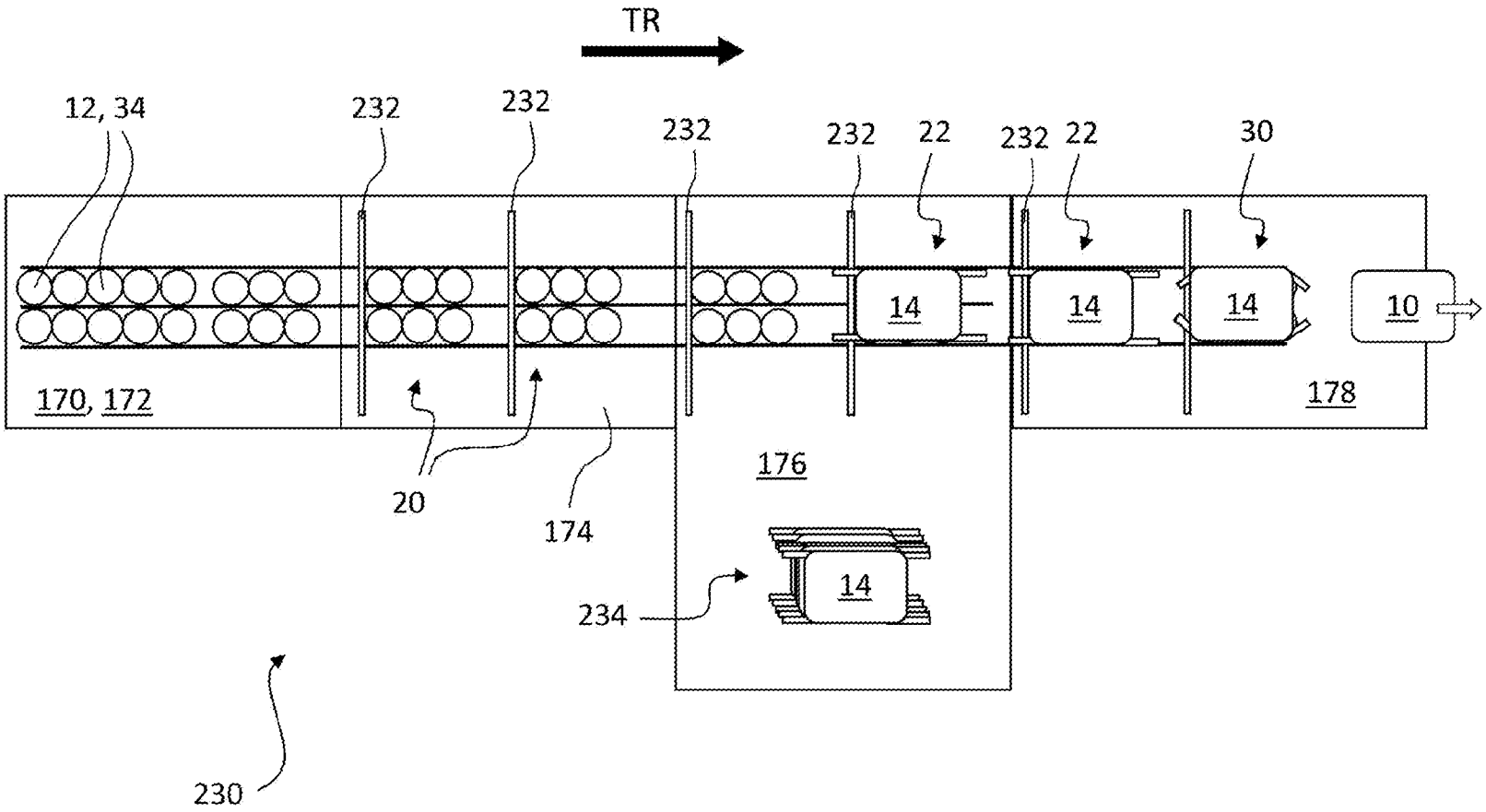
FIGS. 14A, 14B, and 14C show alternative transport sections in which packaging units can be formed and produced.
Figure 14B:
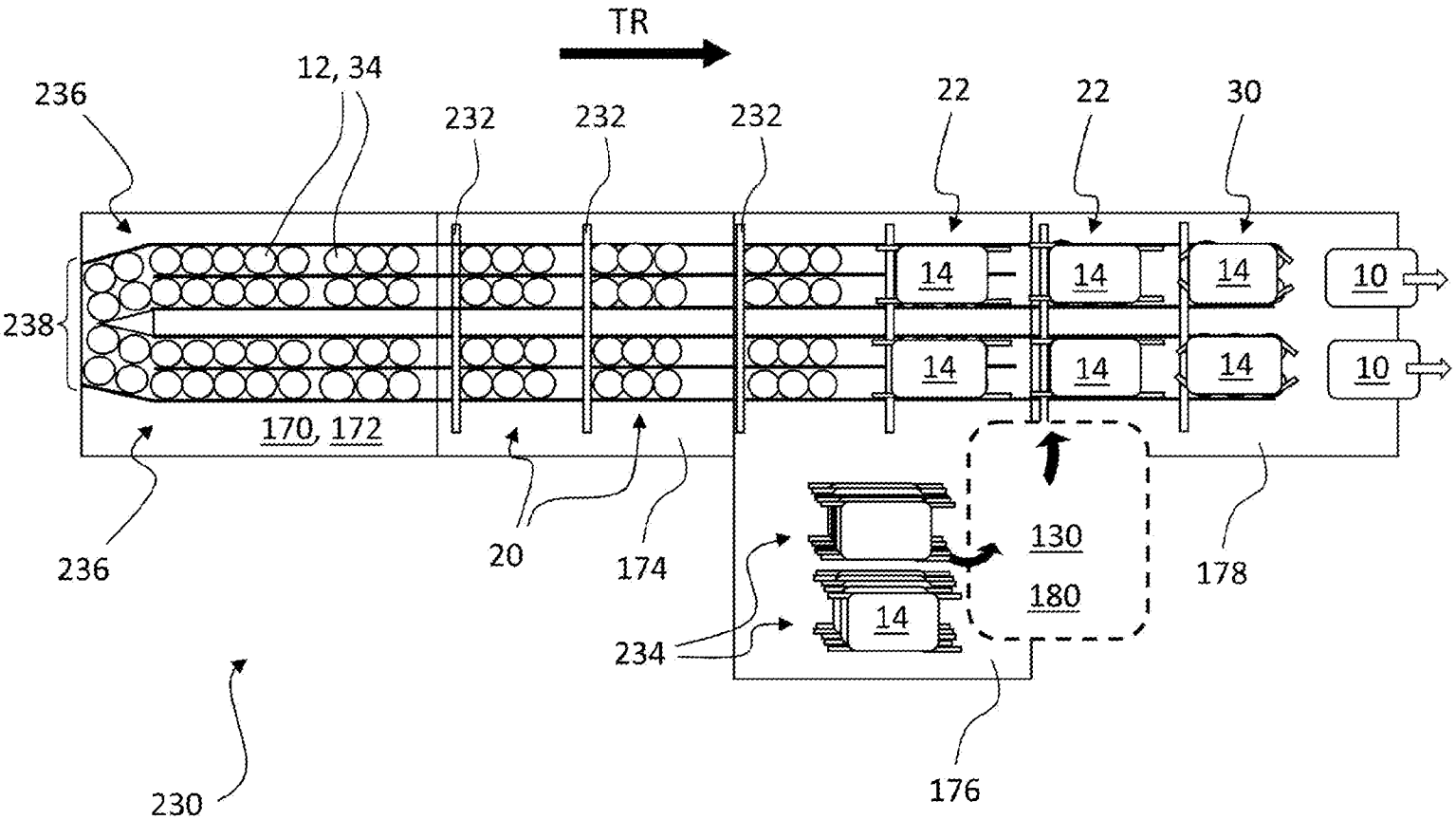
Figure 14C:
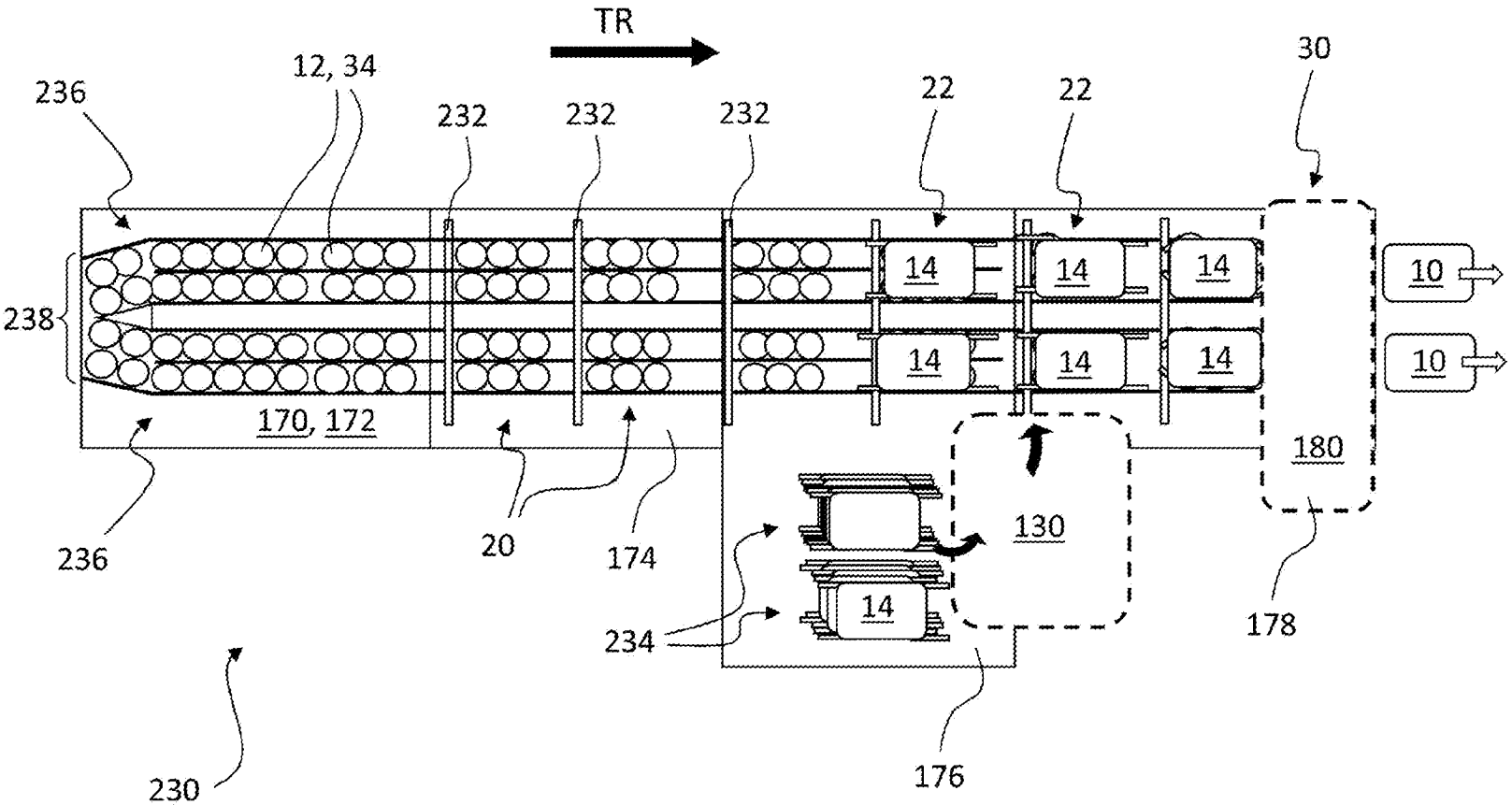

Finally, the in total three schematic plan views of FIGS. 14A, 14B, and 14C show possible embodiment variants of transport sections 230, which can have the modules schematically indicated in FIG. 9 in combined and sequential form.

For example, FIG. 14A illustrates a first section that can be formed by the dividing module 170. There, the articles 12 or beverage cans 34 are conveyed in two parallel lanes in the transport direction TR by a horizontal conveying device not described in detail here, which is why the dividing module 170 is also combined with the aisle guide 172. However, it should be mentioned at this point that the division into the two parallel lanes has already taken place beforehand, i.e., in a region not shown here to the left of the section of the transport section 230 shown in FIG. 14A.

The dividing module 170 and the aisle guide 172 are followed in the transport direction TR (from left to right in FIG. 14A) by the grouping module 174, where suitable dividing devices, which can be formed here by push rods or by other sliders 232, are used to group and divide the articles 12 or beverage cans 34, previously conveyed in uninterrupted succession, into two parallel rows of three. As a result, the article arrangements or article groupings 20, consisting of a total of six articles 12 or beverage cans 34 grouped in a rectangular arrangement, are already formed in the grouping module 174, as explained several times before.

Such article groupings 20 are in each instance suitably equipped in the subsequent application module 176 with the packaging blanks 14 taken from a stockpile, supply point, or magazine 234 or otherwise fed or provided, wherein the primary fixing element 22 are normally produced and formed in the application module 176.

In the subsequent strapping module 178, the secondary fixing element 30 are produced—in particular, by producing the strapping sections mentioned several times above. The packaging units 10 equipped in this way with primary and secondary fixing element 22, 30 and thus completed can then be conveyed further in the transport direction TR, which is not shown here in more detail, but is merely indicated by a directional arrow on the packaging unit 10 shown on the far right.

In addition, FIG. 14B illustrates a more efficient variant of such a transport section 230, in which the formation of grouped article arrangements 20 and their further processing takes place in two transport lanes 146 processed in parallel, such that this can result in a doubling of the processing capacity in the same processing time.

In turn, the transport section 230 shown comprises a first section, which can be formed by the dividing module 170. There, the articles 12 or beverage cans 34 are conveyed in two parallel lanes in the transport direction TR by a horizontal conveying device not described in detail here, which is why the dividing module 170 is also combined with the aisle guide 172. However, as can be seen in FIG. 14B, the division is made into a total of four parallel lanes, in each instance combined in pairs in the two transport lanes 236 that are spaced apart but run parallel. A mass flow 238 for the articles 12 or beverage cans 34 can be arranged upstream of the aisle guide 172, which is arranged in pairs.

The dividing module 170 and the aisle guide 172, which is doubled by the two parallel transport lanes 236, is followed in the transport direction TR (in FIG. 14B, from left to right or from bottom to top) by the grouping module 174, where suitable dividing devices such as, for example, sliders 232 are used to group and divide the articles 12 or beverage cans 34, previously conveyed in uninterrupted succession, into two parallel rows of three, and this is done in each of the two parallel transport lanes 236. As a result, the article groupings 20, consisting of a total of six articles 12 or beverage cans 34 grouped in a rectangular arrangement, are formed in the grouping module 174.

Such article groupings 20 are in each instance suitably equipped in the subsequent application module 176 with the packaging blanks 14 taken from a magazine 234 or otherwise fed or provided, wherein the primary fixing element 22 are normally produced and formed in the application module 176. This also takes place in parallel in the two transport lanes 236 running next to one another. The application of the packaging blanks 14 to the article groupings 20 conveyed in the transport lanes 236 can be carried out, for example, by an application head 130 (not shown in detail here).

In the subsequent strapping module 178, the secondary fixing element 30 are produced—in particular, by producing the strapping sections mentioned several times above by the strapping heads 180. The packaging units 10 equipped in this way with primary and secondary fixing element 22, 30 and thus completed can then be conveyed further in the transport direction TR, which is not shown here in more detail, but is merely indicated by the two parallel directional arrows on the packaging units 10 shown on the far right.

The schematic top view of FIG. 14C shows an arrangement of a transport section 230 that substantially corresponds to FIG. 14B. There, however, a strapping head 180 is assigned to the strapping module 178, while only an application head 130 is assigned to the application module 176. Thus, the secondary fixing element 30 are produced there by forming the aforementioned strapping sections by the strapping heads 180 only in the strapping module 178.

Here as well, the packaging units 10 completed in this way can be transported further in the transport direction TR in a manner not described in detail.

The schematic plan views of FIGS. 15A through 15C show various embodiment variants of a packaging blank 14, as can be used for the production of the packaging units 10 shown above. In order to be able to clarify the differences between the three variants shown in detail, the variant of the packaging blank 14 already shown in FIGS. 1A and 1C is shown again in FIG. 15A, together with all the corresponding reference numerals.

FIGS. 15B and 15C, on the other hand, can illustrate that the strip sections 28, which extend the side surfaces 24 towards both narrow sides on both opposite narrow sides of the side surfaces 24 to be folded over onto the shell surfaces 26 of the articles 12 or beverage cans 34 (cf. in this regard FIG. 1C) of the packaging blank 14, can certainly be designed differently.

Optionally, the strip sections 28 according to FIG. 15C, which are attached on both sides to the narrow sides of the side surfaces 24 to be folded in the direction of the shell surfaces 26 of the articles 12 or beverage cans 34 and extend these in both directions parallel to their longitudinal extension directions, can all be of the same length.

With the alternative variant of the packaging blank 14 shown in the schematic plan view of FIG. 15B, the strip sections 28 of one side face 24 can be shorter, while the two strip sections 28 on the other side face 24 must be correspondingly longer, so that the overlapping strip sections 28 on both narrow sides of the article grouping 20 can in each instance be connected to form the strapping sections that are to form the secondary fixing element (cf. in this regard FIGS. 1E and 1F).

With the variant shown in FIG. 15B, the left and right side surfaces 24, which adjoin the longitudinal sides of the main surface 18 of the packaging blank 14, are designated with different reference numerals for better clarification. The side surface on the left with respect to the transport direction TR is designated by the reference numeral 24L, while the side surface on the right is designated by the reference numeral 24R.

In order to make the left and right side surfaces 24L and 24R distinguishable and to clearly identify them, in FIGS. 15A through 15C, the transport direction TR is indicated, which points from left to right in the representations. In addition, the main axes 42 and 44 described above of the associated article grouping (cf. FIG. 1C) are drawn, in order to better illustrate the different levels of symmetry of the differently-designed packaging blanks 14.

The two side surfaces 24L and 24R differ with regard to the length of the strip sections 28 adjoining the respective narrow sides of the side surfaces 24L, 24R. While the two strip sections 28 on the left side surface 24L are longer than in the variant according to FIG. 15A, the two strip sections 28 on the right side surface 24R are shorter than in the variant according to FIG. 15A.

Therefore, the longer strip sections 28 on the left side surface 24L are designated by the reference numeral 28-*l*, while the shorter strip sections on the right side surface 24R are designated by the reference numeral 28-*k*. Due to the different lengths of the respective pairs of strip sections 28-*l* and 28-*k* on the left and right side surfaces 24L and 24R respectively, the packaging blank 14 shown in FIG. 15B is only mirror-symmetrical to the second main axis 44, which runs in the middle through the main surface 18 and transversely to the transport direction TR. A mirror symmetry to the first main axis 42, which runs precisely through the folding region 46 and is parallel to the transport direction TR, is no longer present here.

In contrast, the first variant of the packaging blank 14 according to FIG. 15A, in which all strip sections 28 have the same dimensions, is mirror-symmetrical with respect to both the first main axis 42 and the second main axis 44.

Finally, with the third variant of the packaging blank 14 shown in FIG. 15C, the two strip sections 28-*k* and 28-*l* of each of the two side surfaces 24L and 24R are of different lengths. The two side surfaces 24L and 24R differ with regard to the length of the strip sections 28 adjoining the respective narrow sides of the side surfaces 24L, 24R.

While the front strip section 28-*k*, pointing in the direction of the transport direction TR, on the left side surface 24L is shorter than in the variant according to FIG. 15A, the strip section 28-*l*, pointing in the opposite direction (pointing backwards with respect to the transport direction TR), on the left side surface 24L is longer than in the variant according to FIG. 15A.

In addition, the front strip section 28-*k*, which points in the direction of the transport direction TR, on the right side surface 24R is longer than in the variant according to FIG. 15A, while the strip section 28-*k*, which points in the opposite direction (backwards with respect to the transport direction TR), on the right side surface 24R is shorter than in the variant according to FIG. 15A.

Thus, the packaging blank 14 shown in FIG. 15C is no longer mirror-symmetrical with respect to either of the two main axes 42, 44.

In the two variants of the packaging blank 14 according to FIG. 15B and FIG. 15C, the strip sections 28-*l*, 28-*k* of different lengths on both narrow sides of the article grouping 20 overlap eccentrically to the corresponding narrow side in each instance, i.e., they lie to the left or right of the first main axis 42. Overall, however, the strip sections 28-*l* and 28-*k* overlapping at the connecting point are long enough to be connected so as to form the strapping sections 32, which form the secondary fixing element 30.

Figure 16A:
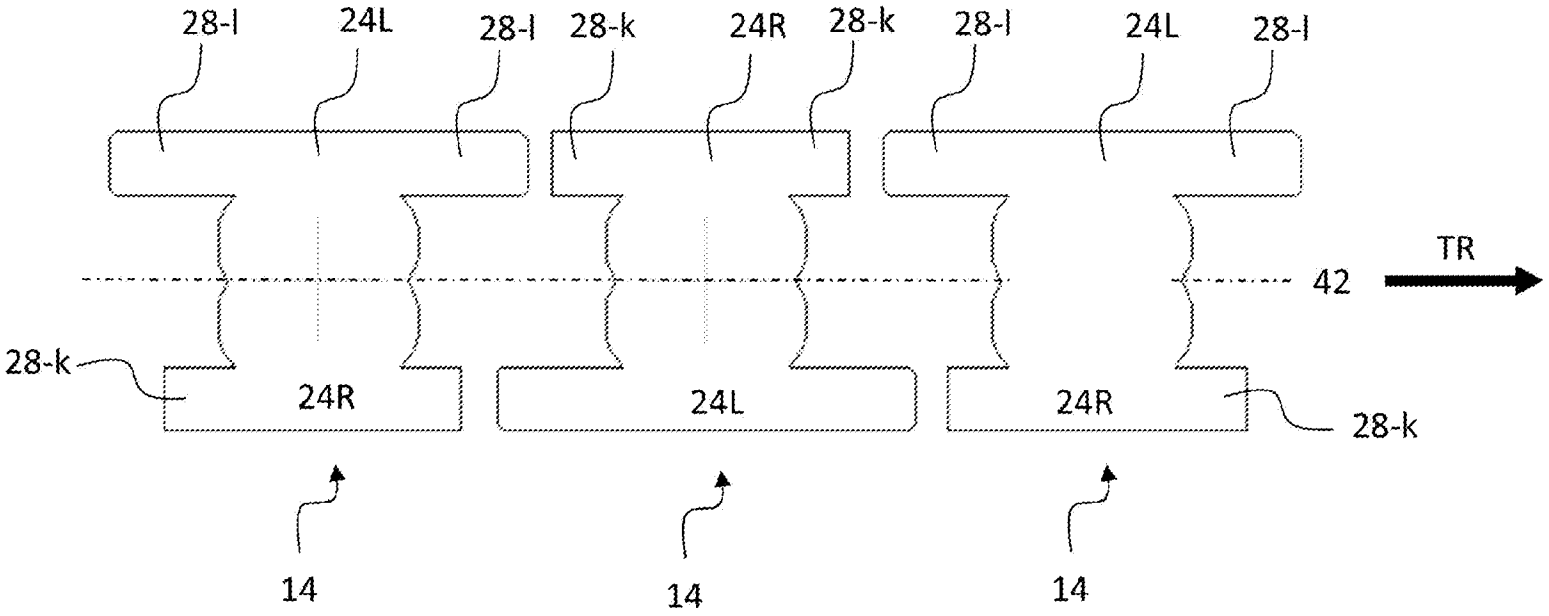
FIGS. 16A and 16B show practical sets of several packaging blanks that can be produced from a cardboard sheet or other suitable flat packaging material in a punching process.
Figure 16B:
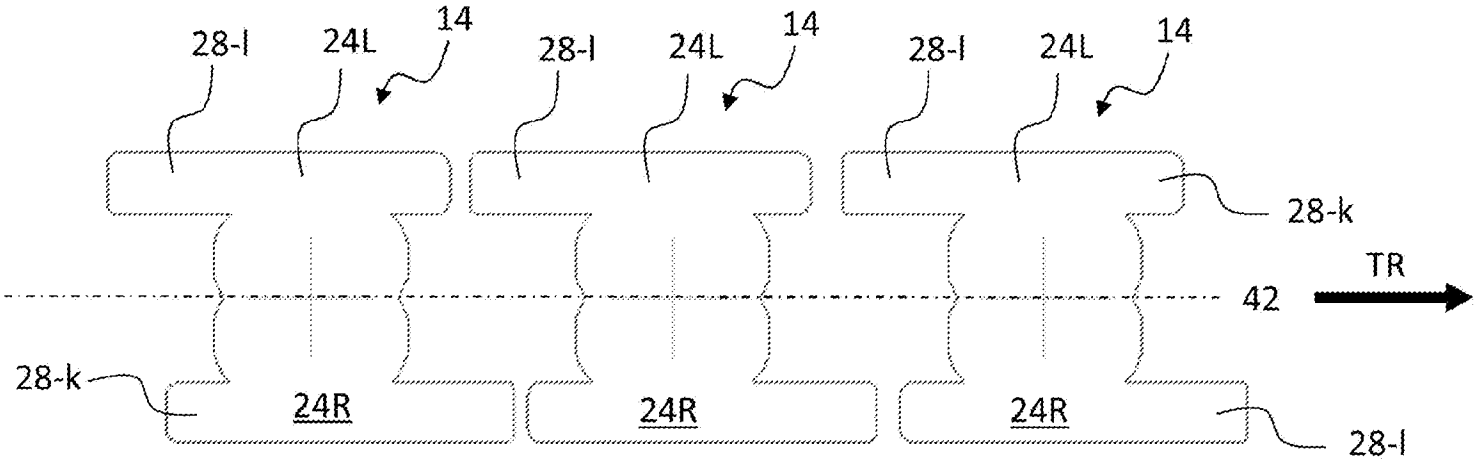

Finally, FIGS. 16A and 16B show practical sets of several packaging blanks 14 that can be produced from a cardboard sheet or other suitable flat packaging material in an economical punching process, without producing an undesirably high level of waste.

FIG. 16A shows several packaging blanks 14 arranged in a row, which are shaped according to FIG. 15B. Such packaging blanks 14, which are in each instance designed to be mirror-symmetrical to the second main axis 44, are alternately rotated through 180°, such that a left side surface 24L with longer strip sections 28-*l* of a packaging blank 24 is always aligned with a right side surface 24R with shorter strip sections 28-*k* of an adjoining further packaging blank 14. The same applies to the respective other sides, because the packaging blanks 14 lie one behind the other with their aligned first main axes 42 and can thus be punched out of a larger cardboard sheet or similar flat packaging material.

Such an arrangement, as shown in FIG. 16A, can also be practical for mechanical removal from a magazine 234, as previously explained with reference to FIGS. 14A, 14B, and 14C. Here as well, it can be advantageous if the packaging blanks 14 are made available to the handling tool 56 or the application head 130 successively in the manner shown.

Furthermore, FIG. 16B shows several packaging blanks 14 arranged in a row, which are shaped according to FIG. 15C. Such packaging blanks 14, each of which is not symmetrical to the first or second main axis 42, 44, adjoin one another, such that the left side surface 24L of a packaging blank 14 is always aligned with a left side surface 24L of an adjoining further packaging blank 14. The same applies to the respective other side surfaces 24R, because the packaging blanks 14 lie one behind the other with their aligned first main axes 42 and can thus be punched out of a larger cardboard sheet or similar flat packaging material.

Such an arrangement, as shown in FIG. 16B, can also be practical for mechanical removal from a magazine 234, as previously explained with reference to FIGS. 14A through 14C. Here as well, it can be advantageous if the packaging blanks 14 are made available to the handling tool 56 and/or the application head 130 successively in the manner shown.

The following is given as a supplementary note to the above statements. If, in the context of the embodiment variants shown in the figures and their descriptions above, reference is also made often or also generally to "schematic" representations and views, this by no means suggests that the figure representations and their description are to be of subordinate importance with regard to the disclosure of the invention. The person skilled in the art is certainly able to derive sufficient information from the schematically and abstractly drawn representations that will make it easier for the person skilled in the art to understand the invention, without being confused in any way by the drawn and possibly not precisely true-to-scale proportions of parts of the packaging device, their details, or other drawn elements. Rather, the figures enable the skilled person as reader to derive a better understanding of the inventive idea—which has been formulated in more general and/or more abstract terms in the claims and in the general part of the description, at least with regard to some aspects—on the basis of the more specifically explained implementations of the method according to the invention and the more specifically explained structure of the packaging device according to the invention.

The invention has been described with reference to a preferred embodiment. However, it is conceivable for a person skilled in the art that modifications or changes can be made to the invention without departing from the scope of protection of the following claims.

LIST OF REFERENCE SIGNS

10 Packaging unit, bundle
12 Article
14 Packaging blank
16 Upper end face
18 Main surface (packaging blank)
20 Article grouping, arrangement, article arrangement
22 Primary fixing element
24 Side surface (packaging blank)
24L Left side surface
24R Right side surface
26 Shell surface (article, article grouping)
28 Strip section
28-*l* Long strip section
28-*k* Short strip section
30 Secondary fixing element
32 Strapping section
34 Beverage can, can
36 Base region, lower base region, can base
38 Lower end face
40 Lid region, upper lid region, can lid
42 First main axis, first horizontal main axis (of the article grouping)
44 Second main axis, second horizontal main axis (of the article grouping)
46 Folding region (packaging blank, main surface)
48 Recess, slot-like recess
50 Roof-shaped transition
52 Collar section (packaging blank)
54 Bonding (strip section)
56 Handling tool
58 Base plate
60 Folding tool
62 Stripping tool
64 Lower longitudinal edge (stripping tool)
66 Flank (stripping tool)
68 Feed direction
70 Folding punch, blade-like folding punch
72 Adjusting lever
74 Stroke direction
76 Pivot bracket
78 Pivot axis
80 Pivot movement
82 Gap
84 Transport module, shuttle
86 Base plate
88 Receptacle, shell-type receptacle
90 Rim, bar-like rim
92 Separating bar
94 Separating wing
96 Limiting bar
98 Adjusting lever, adjusting pin
100 Transport aisle
102 Separating bar
104 Limiting bar
106 Centering pin
108 Receiving hole
110 Negative pressure gripper, suction gripper
112 Molded part
114 Folding tool
116 Folding fingers
118 Transverse beam
120 Endless traction device
122 Guide wheel
124 Guide slot
130 Application head
132 Application unit
134 Carrier frame (application head)
136 Arm section
138 Suction element
140 Suction punch
142 Negative pressure line
144 Contact plate
146 Recess, circular recess
148 Linear motor, linear drive
150 Lower frame section
152 Shaping element, knife-like shaping element, blade-shaped shaping element
154 Folding blade
156 Recess, slot-like recess
158 Folding element, lateral folding element
160 Tool, folding tool
162 Bevel, ramp-like bevel
170 Dividing module
172 Aisle guide
174 Grouping module
176 Application module
178 Strapping module
180 Strapping head
182 Cross member

184 Suspension
186 Roll
188 Second handling element, second handling elements
190 Molded part, deformable molded part, elastically-deformable molded part
192 Base section
194 Holder
196 Tool section
198 Leg, first leg
200 Leg, second leg
202 Shaping element, elastic shaping element
204 Body
206 Cavity
208 Strips, connecting strips
210 Rail system
212 Sheet metal holder
214 Drive motor
216 Guide pin
218 Guide slot
220 Curved section
222 Mouth region
230 Transport section
232 Slider
234 Stockpile, supply point, magazine
236 Transport lane
238 Mass flow
a Opening angle (of the reshaped folding region)
A Distance, horizontal distance
B Distance, vertical distance
C Feed direction
D Actuating force
E Reverse movement, deviating movement
D Pivot movement
G Parallel displacement, transverse displacement
H Deviating movement, deformation movement
TR Transport direction
UR Direction of circulation

The invention claimed is:

1. A packaging device for producing packaging units (10), comprising at least two articles (12), which at least two articles (12) are held together by at least one packaging blank (14) with primary and with secondary fixing elements (22, 30), and which packaging device comprises at least:

an application device (176) capable of applying a main surface (18) of at least one packaging blank (14) to one or more first end faces (16) of the at least two article or grouped articles (20) and capable of establishing a connection between the articles (12) and a primary fixing element (22) of the packaging blank (14), wherein the application device (176) comprises at least one controllable application head (130) capable of moving within a defined movement space, wherein the at least one controllable application head (130) can apply a packaging blank (14) to at least one article grouping (20) located or moving within the movement space, wherein the at least one controllable application head (130) is capable of receiving, holding, and releasing the packaging blanks (14) and capable of placing the respective packaging blank (14) on an upper side of the respective article grouping (20), a shaping device (60, 158) capable of folding over at least one side surface (24) adjacent to a longitudinal side of the main surface (18) of the packaging blank (14), thus forming a secondary fixing element (30) interacting with one or more shell surfaces (26) of the articles (12), and a fixing device (178, 180) capable of forming the secondary fixing elements (30) formed by strapping sections (32), which strapping sections (32) surround defined regions of the shell surfaces (26) of the articles (12) and fixes the articles (12) in a parallel or an approximately parallel alignment to one another.

2. The packaging device of claim 1, wherein the receiving device comprises at least one suction device.

3. The packaging device of claim 1, wherein the at least one controllable application head (130) comprises two or more application units (132) capable of synchronously or approximately synchronously equipping two or more separate article groupings (20) with packaging blanks (14).

4. The packaging device of claim 1 wherein each of the at least one controllable application unit (132) comprises a contact plate (144) capable of moving vertically between two end positions, and comprises at least one controllable suction element (138).

5. The packaging device of claim 1 wherein each of the at least one controllable application unit (132) comprises a shaping element (202) capable of deforming a defined folding region (46) of a packaging blank (14) placed on a respective article grouping (20) and thus form the primary fixing element (22) establishing mechanical connections between the articles (12) and the packaging blank (14).

6. The packaging device of claim 1 wherein each of the at least one controllable application unit (132) comprises folding elements (158) capable of folding over side surfaces (24) of the packaging blank (14) and of preparing the secondary fixing element (30) between the article grouping (20) and the packaging blank (14).

7. The packaging device of claim 6, wherein the contact plate (144), one or more suction elements (138), the folding elements (158), and the shaping element (202) of each application unit (132) are capable, in conjunction with the application head (130), of being be lowered onto the article grouping (20) or lifted therefrom.

8. A method for producing packaging units (10), comprising at least two articles (12), wherein the at least two articles (12) are held together by at least one packaging blank (14), comprising:

taking at least one packaging blank (14) from a stockpile or from a magazine (234) by an application head (130), holding ready in the application head (130), and applying the at least one packaging blank (14), by lowering the application head (130), to an article grouping (20), thus forming a primary fixing element (22), applying a main surface (18) of the packaging blank (14) to one or more first end faces (16) of a group of articles (12), forming a connection between the grouped articles (12) and the primary fixing element (22) of the packaging blank (14), which the primary fixing element (22) fixes positions of the articles (12) relative to one another, folding over at least one side surface (24) adjacent to a longitudinal side of the main surface (18) of the packaging blank (14), forming a secondary fixing element (30) interacting with one or more shell surfaces (26) of the articles (12), wherein the secondary fixing element (30) are formed by one or more strapping sections (30) that surround defined regions of the one or more shell surfaces (26) of the articles (12) and fixes the articles (12) in a parallel or an approximately parallel alignment to one another.

9. The method of claim 8, wherein two side surfaces (24) adjacent to opposite longitudinal sides of the main surface (18) of the packaging blank (14) are folded over, forming secondary fixing element (30) interacting with one or more shell surfaces (26) of the articles (12).

10. The method of claim 8, wherein the strapping sections (32) of the secondary fixing element (30) are formed by strip sections (28) of the packaging blank (14) that extend one or more side faces (24) in directions along the longitudinal extension directions of the side faces (24).

11. The method of claim 10, wherein the one or more side surfaces (24) and the strip sections (28) are folded over by one or more handling devices (56) and reshaped into strapping sections (32), wherein one or more overlapping end regions are fixed to one another or to the one or more shell surfaces (26) of the articles (12).

12. The method of claim 8, wherein the main surface (18) of the packaging blank (14) is reshaped, folded, or notched in a region between bordering articles (12), wherein adjacent primary fixing element (22), together with the articles (12) held therein, are brought closer to one another until the adjacent articles (12) are in touching contact.

13. The method of claim 8, wherein the application head (130) is moved within a movement space between a stockpile, a supply point, or a magazine (234) for the flat packaging blanks (14) and the article grouping (20).

14. The method of claim 8, wherein the application head (130) comprises at least two modular application units (132) are located next to one another, as a result of which two similar article groupings (20) can be processed or handled in parallel and equipped with packaging blanks (14).

15. The method of claim 8, further comprising lowering a flat contact plate (144) in the respective application unit (132), while at the same time deactivating a negative pressure on suction elements (138) that holds the packaging blank (14) in place in the respective application unit (132), or lowering the contact plate (144) relative to the suction elements (138) located in a fixed position in the respective application unit (132) of the application head (130), as a result of which the packaging blank (14) is spaced apart from the suction elements (138) and detached.

16. The method of claim 8, wherein the packaging blank (14):

forms a connection between the articles (12) and primary fixing element (22) of the packaging blank (14) with a main surface (18), and is applied to one or more first end faces (16) of the grouped articles (12), wherein the primary fixing element (22) fixes positions of the articles (12) relative to one another, has, on at least one longitudinal side of the main surface (18), an adjacent side surface (24) that is folded over and is applied to the respective shell surfaces (26) of the articles (12), forming secondary fixing element (30) interacting with shell surfaces (26) of the articles (12), and has one or more strapping sections (30), forming the secondary fixing element (30), which surround defined regions of the shell surfaces (26) of the articles (12) and fixes the articles (12) in a parallel or an approximately parallel alignment to one another.

17. The method of claim 16, wherein two side surfaces (24) adjacent to opposite longitudinal sides of the main surface (18) of the packaging blank (14) are folded over to form secondary fixing element (30) interacting with shell surfaces (26) of the articles (12).

18. The method of claim 17, wherein the strapping sections (32) of the secondary fixing element (30) are formed by strip sections (28) of the packaging blank (14), which extend the side faces (24) in directions along the longitudinal extension directions of the side faces (24).

19. The method of claim 16, wherein the main surface (18) of the packaging blank (14) is reshaped, folded, or notched in a region between bordering articles (12), and wherein adjacent primary fixing element (22), together with the articles (12) held therein, are brought closer to one another, forming a touching contact of the respective adjacent articles (12).

* * * * *